US011219907B1

(12) United States Patent
McCafferty et al.

(10) Patent No.: US 11,219,907 B1
(45) Date of Patent: Jan. 11, 2022

(54) FOAM PRODUCING AND DISPENSING APPARATUS AND METHOD

(71) Applicant: HE-PRODUCTS LLC, Caldwell, ID (US)

(72) Inventors: Matthew Robert McCafferty, Caldwell, ID (US); Zachary Gerald Soles, Nampa, ID (US)

(73) Assignee: HE-PRODUCTS LLC, Caldwell, ID (US)

( * ) Notice: Subject to any disclaimer, the term of this patent is extended or adjusted under 35 U.S.C. 154(b) by 0 days.

(21) Appl. No.: 16/237,378

(22) Filed: Dec. 31, 2018

Related U.S. Application Data

(60) Provisional application No. 62/611,859, filed on Dec. 29, 2017.

(51) Int. Cl.
*B05B 7/00* (2006.01)
*A62C 5/02* (2006.01)

(52) U.S. Cl.
CPC ..... *B05B 7/0025* (2013.01); *B05B 7/0037* (2013.01); *A62C 5/022* (2013.01)

(58) Field of Classification Search
CPC ... B05B 7/0018; B05B 7/0025; B05B 7/0031; B05B 7/0037; A62C 5/022; A62C 31/12; A62C 5/02; A47K 5/14
See application file for complete search history.

(56) References Cited

U.S. PATENT DOCUMENTS 2,549,258 A * 4/1951 Stover ..... B05B 7/0037 261/24
3,268,212 A 8/1966 Ziselberger
(Continued)

FOREIGN PATENT DOCUMENTS

| | | |
|---|---|---|
| AU | 6438286 | 10/1986 |
| AU | 201701931 | 4/2017 |
| KR | 20140021865 | 2/2014 |

OTHER PUBLICATIONS

Windex; Example of Eductor Using Pressurized Water to Draw in Surfactant.

(Continued)

*Primary Examiner* — Alex M Valvis
(74) *Attorney, Agent, or Firm* — AP Patents; Alexander Pokot

(57) ABSTRACT

An apparatus that produces and dispenses foam comprises a housing, an adjustable water flow member, an adjustable foam concentrate flow member, a first mixing chamber comprising an outlet, a water pressure reducing member with a portion thereof disposed within the first mixing chamber, a second mixing chamber in a communication with the outlet from the first mixing chamber, an air pressure reducing member with a portion thereof disposed within the second mixing chamber, a third mixing chamber in a communication with an outlet from the second mixing chamber, the third mixing chamber comprising a port in a communication with an external environment to the housing, and a screen member disposed within the third mixing chamber and configured to convert a mixture of air, water and foam concentrate exiting the outlet of the second mixing chamber into the foam, the foam being dispersed through the port during operation of the apparatus.

26 Claims, 23 Drawing Sheets

(56) References Cited

U.S. PATENT DOCUMENTS

| | | | | |
|---|---|---|---|---|
| 3,388,868 | A | 6/1968 | Watson et al. | |
| 3,430,865 | A | 3/1969 | McDougall | |
| 3,979,326 | A * | 9/1976 | Chatterton | A01M 7/0092 261/75 |
| 4,200,207 | A * | 4/1980 | Akers | B01F 3/04446 222/190 |
| 4,366,081 | A | 12/1982 | Hull | |
| 4,420,047 | A * | 12/1983 | Bruensicke | A62C 5/02 169/53 |
| 5,029,758 | A | 7/1991 | Chayer | |
| 5,096,389 | A | 3/1992 | Grady | |
| 5,113,945 | A | 5/1992 | Cable | |
| 5,255,747 | A | 10/1993 | Teske et al. | |
| 5,382,389 | A | 1/1995 | Goodine et al. | |
| 5,445,226 | A | 8/1995 | Scott et al. | |
| 5,575,341 | A | 11/1996 | Baker et al. | |
| 5,779,158 | A * | 7/1998 | Baker | B05B 7/0018 169/15 |
| 6,082,586 | A * | 7/2000 | Banks | B05B 11/3087 222/95 |
| 6,138,926 | A | 10/2000 | Russo | |
| 6,455,017 | B1 | 9/2002 | Kasting, Jr. et al. | |
| 6,733,004 | B2 | 5/2004 | Crawley | |
| 7,516,907 | B2 | 4/2009 | Stone et al. | |
| 7,717,059 | B2 * | 5/2010 | Wanthal | B05B 7/1263 118/669 |
| 7,964,544 | B2 | 6/2011 | Smith et al. | |
| 8,454,270 | B1 | 6/2013 | Benaske | |
| 8,512,642 | B2 | 8/2013 | Fujio | |
| 2005/0255247 | A1 | 11/2005 | Mattia et al. | |
| 2006/0102745 | A1 | 5/2006 | Dexter | |
| 2007/0187528 | A1 | 8/2007 | Roth et al. | |
| 2013/0233441 | A1 * | 9/2013 | Ciavarella | A47K 5/1211 141/18 |
| 2014/0110434 | A1 * | 4/2014 | Ciavarella | B05B 11/3087 222/133 |
| 2015/0122512 | A1 * | 5/2015 | Wu | A62C 5/022 169/9 |

OTHER PUBLICATIONS www.lafftertyequipment.com; Model #970550DU-A-50 DU Airless Foamer.

www.laffertyequipment.com; Model #976500 Timed Entryway Foam Sanitizer.

* cited by examiner

FOAM PRODUCING AND DISPENSING APPARATUS AND METHOD

CROSS-REFERENCE TO RELATED APPLICATIONS

This present non-provisional application claims benefit of and priority from U.S. Provisional Patent Application Ser. No. 62/611,859 filed on Dec. 29, 2017, the entire contents of which are hereby incorporated by reference thereto.

STATEMENT REGARDING FEDERALLY SPONSORED RESEARCH AND DEVELOPMENT

Not Applicable

REFERENCE TO SEQUENCE LISTING, A TABLE, OR A COMPUTER PROGRAM LISTING COMPACT DISC APPENDIX

Not Applicable

TECHNICAL FIELD

The subject matter relates to foam production and dispensing.

BRIEF DESCRIPTION OF THE DRAWINGS

The accompanying drawings are incorporated in and constitute part of the specification and illustrate various embodiments. In the drawings.

DETAILED DESCRIPTION OF EXEMPLARY EMBODIMENTS

Figure 1:
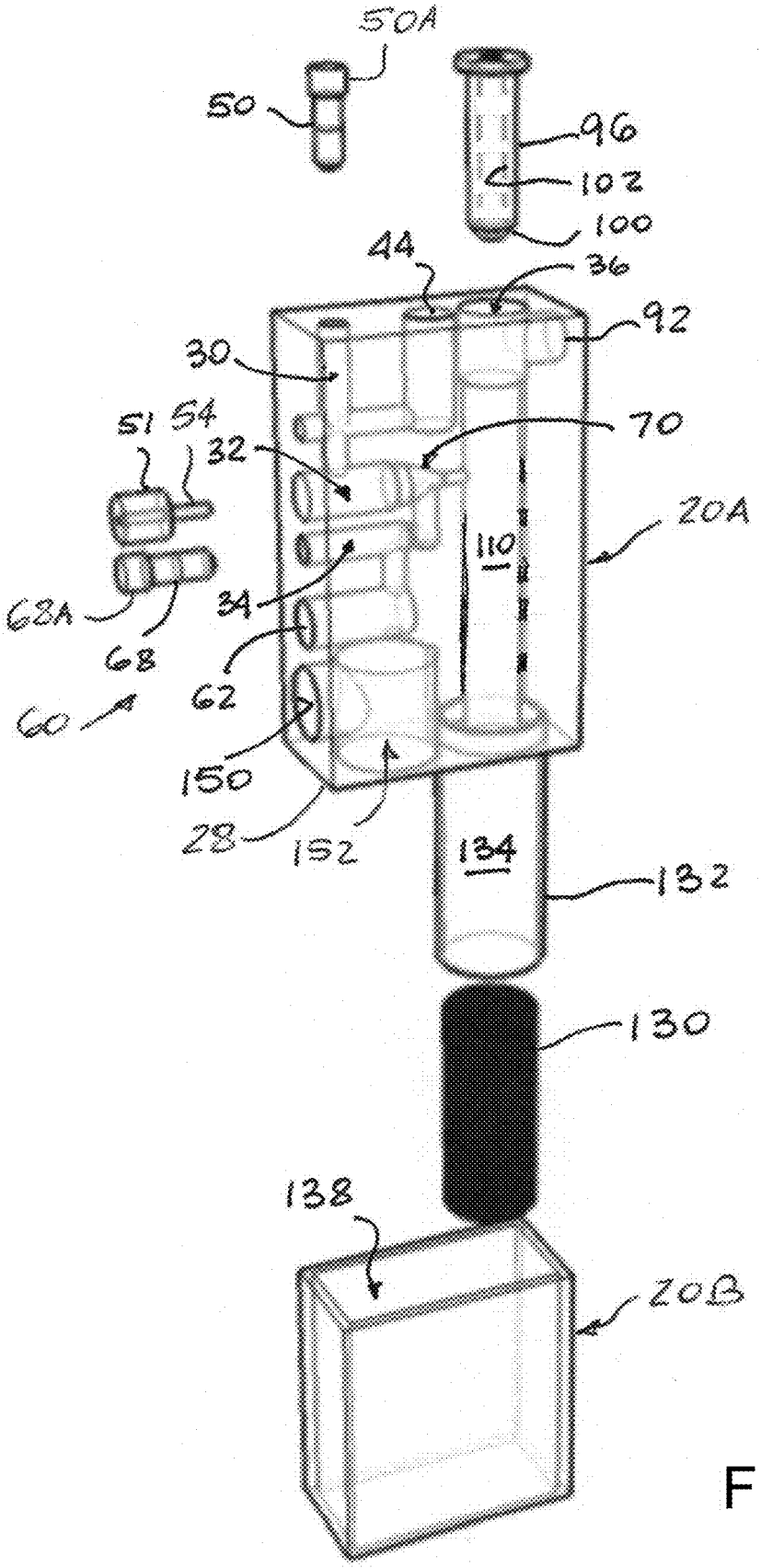
FIG. 1 illustrates an exploded 3D view of an exemplary apparatus that produces and dispenses foam.

Prior to proceeding to the more detailed description of the present subject matter, it should be noted that, for the sake of clarity and understanding, identical components which have identical functions have been identified with identical reference numerals throughout the several views illustrated in the drawing figures.

The following detailed description is merely exemplary in nature and is not intended to limit the described examples or the application and uses of the described examples. As used herein, the words "example", "exemplary" or "illustrative" means "serving as an example, instance, or illustration." Any implementation described herein as "example", "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims.

For purposes of description herein, the directional and/or relationary terms such as "upper," "top," "lower," "bottom," "left," "right," "rear," "back," "front," "apex," "vertical," "horizontal," "lateral," "exterior," "interior," and derivatives thereof are relative to each other and are dependent on the specific orientation of an applicable element or article, and are used accordingly to aid in the description of the various embodiments and are not necessarily intended to be construed as limiting.

Spatially relative terms, such as "beneath," "below," "lower," "above," "upper," and the like, may be used herein for ease of description to describe one element or feature's relationship to another element(s) or features) as illustrated in the figures. It will be understood that the spatially relative terms are intended to encompass different orientations of the device in use or operation in addition to the orientation depicted in the figures. For example, if the device in the figures is turned over, elements described as "below" or"beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

It will be understood that, although the terms "first," "second," "third" etc. may be used herein to describe various elements, components, regions, layers and/or sections, these elements, components, regions, layers and/or sections should not be limited by these terms. These terms are only used to distinguish one element, component, region, layer, or section from another element, component, region, layer or section. Thus, "a first element," "component," "region," "layer," or "section" discussed below could be termed a second element, component, region, layer, or section without departing from the teachings herein.

Furthermore, there is no intention to be bound by any expressed or implied theory presented in the preceding technical field, background, or the following detailed description. It is also to be understood that the specific devices and processes illustrated in the attached drawings, and described in the following specification, are simply examples of the inventive concepts defined in the appended claims. Hence, specific dimensions and other physical characteristics relating to the examples disclosed herein are not to be considered as limiting, unless the claims expressly state otherwise.

The term "or" when used in this specification and the appended claims is not meant to be exclusive; rather the term is inclusive, meaning either or both.

The term "couple" or "coupled", when used in this specification and appended claims, refers to an indirect or direct physical connection between the identified elements, components, or objects. Often the manner of the coupling will be related specifically to the manner in which the two coupled elements interact.

The term "directly coupled" or "coupled directly", when used in this specification and appended claims, refers to a physical connection between identified elements, components, or objects, in which no other element, component, or object resides between those identified as being directly coupled.

The term "operatively coupled", when used in this specification and appended claims, refers to a physical connection between identified elements, components, or objects, wherein operation of one of the identified elements, components, or objects, results in operation of another of the identified elements, components, or objects.

The terms "removable", "removably coupled", "removably disposed," "readily removable", "readily detachable", "detachably coupled", "separable," "separably coupled," "releaseably attached", "detachably attached" and similar terms, when used in this specification and appended claims, refer to structures that can be uncoupled, detached, uninstalled, or removed from an adjoining structure with relative ease (i.e., non-destructively, and without a complicated or time-consuming process), and that can also be readily reinstalled, reattached, or coupled to the previously adjoining structure.

The terms "volume percent," "vol-%," "percent by volume," "% by volume," and variations thereof, when used in this specification and appended claims, refer to the concentration of a substance as the volume of that substance divided by the total volume of the composition and multiplied by 100. It is understood that, as used here, "percent," "%," and the like are intended to be synonymous with "volume percent," "vol-%," etc.

The term "about", when used in this specification and appended claims, refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions or different reaction levels for a composition resulting from a particular initial mixture. Whether or not modified by the term "about", the claims include equivalents to the quantities.

The term "sanitizer", when used in this specification and appended claims, refers to an agent that reduces the number of bacterial contaminants to safe levels as judged by public health requirements. In an embodiment, sanitizers for use in this invention will provide at least a 99.999% reduction (5-log order reduction). These reductions can be evaluated using a procedure set out in *Germicidal and Detergent Sanitizing Action of Disinfectants*, Official Methods of Analysis of the Association of Official Analytical Chemists, paragraph 960.09 and applicable sections, 15th Edition, 1990 (EPA Guideline 91-2). According to this reference a sanitizer should provide a 99.999% reduction (5-log order reduction) within 30 seconds at room temperature, 25±2° C., against several test organisms.

The term "disinfectant", when used in this specification and appended claims, refers to an agent that kills all vegetative cells including most recognized pathogenic microorganisms, using the procedure described in *A.O.A.C. Use Dilution Methods*, Official Methods of Analysis of the Association of Official Analytical Chemists, paragraph 955.14 and applicable sections, 15th Edition, 1990 (EPA Guideline 91-2). As used herein, the term "high level disinfection" or "high level disinfectant" refers to a compound or composition that kills substantially all organisms, except high levels of bacterial spores, and is effected with a chemical germicide cleared for marketing as a sterilant by the Food and Drug Administration. As used herein, the term "intermediate-level disinfection" or "intermediate level disinfectant" refers to a compound or composition that kills Mycobacteria, most viruses, and bacteria with a chemical germicide registered as a tuberculocide by the Environmental Protection Agency (EPA). As used herein, the term "low-level disinfection" or "low level disinfectant" refers to a compound or composition that kills some viruses and bacteria with a chemical germicide registered as a hospital disinfectant by the EPA.

As used herein, the term "mechanical foam" refers to an object formed by trapping pockets of gas in a liquid or a solid. The term "mechanical foam" also refers to a dispersed medium that consists of two media that do not mix. More specifically, it contains discrete elements of one medium which are dispersed in a continuous second medium. The two media can be of very different nature.

As used herein, the term "bubble" refers to a globule of one substance another, usually gas in a liquid.

As used herein, the term "homogeneous mixture" refers to a solid, liquid, or a gaseous mixture that has the same proportions of its components throughout any given sample.

The terms and words used in the following description and claims are not limited to the bibliographical meanings, but, are merely used to enable a clear and consistent understanding of the exemplary embodiments. Accordingly, it should be apparent to those skilled in the art that the following description of exemplary embodiments is provided for illustration purpose only and not for the purpose of limiting the invention as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

The particular embodiments of the present disclosure generally provide apparatuses and methods directed to producing and dispensing foam by mixing water and chemical in a first stage and then mixing water and chemical mixture with air in a second stage.

In particular embodiments, a foam producing and dispensing apparatus is configured as a stationary mounted apparatus.

In particular embodiments, a foam producing and dispensing apparatus is configured as a hand-held apparatus.

In particular embodiments, a foam producing and dispensing apparatus is configured as a mobile apparatus.

In particular embodiments, a foam producing and dispensing apparatus is employed in industrial sanitization of surfaces particularly, but not exclusively in the food industry.

In particular embodiments, a foam producing and dispensing apparatus is employed in industrial disinfection of surfaces particularly, but not exclusively in the food industry.

In particular embodiments, a foam producing and dispensing apparatus comprises a housing, a means within the housing for generating a homogeneous mixture of liquid and foam concentrate, a means within the housing for generating a homogenous foam solution flow, a screen member, positioned within the housing downstream of the homogenous foam solution flow, that generates the mechanical foam, and a means for dispersing the mechanical foam.

Now in a reference to FIGS. 1-9, therein is illustrated an exemplary apparatus 10 that produces and dispenses foam, for example such as a mechanical foam.

FIG. 1 illustrates an exploded view of the apparatus 10 that comprises a two-piece housing 20 with an upper portion 20A and a lower portion 20B, a liquid flow adjusting valve 50, a liquid jet 51, a foam concentrate adjusting valve 68, and a screen member 130.

Figure 2:
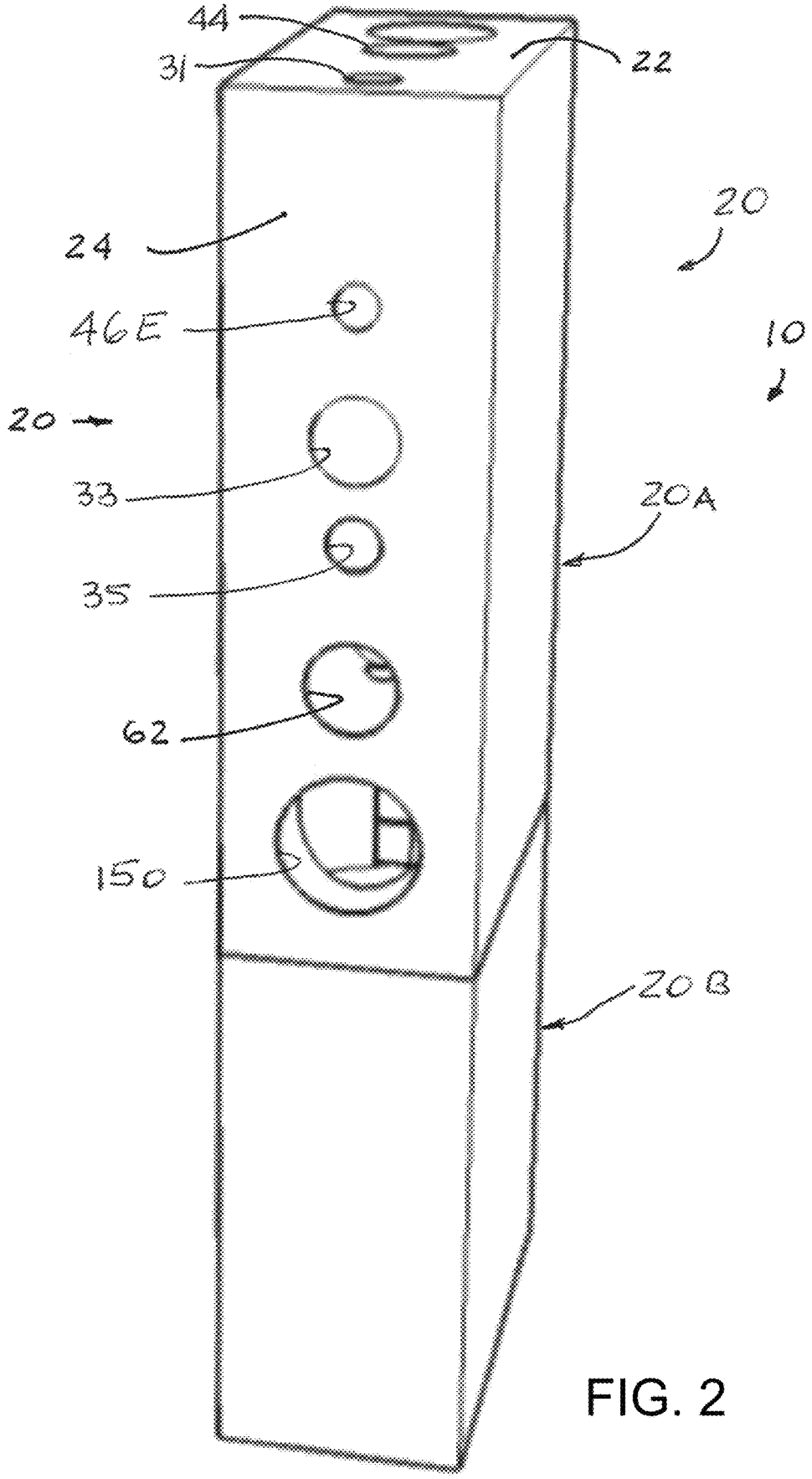
FIG. 2 illustrates a 3D view of a housing of the apparatus of FIG. P1.

The housing 20, as illustrated in FIG. 2, comprises generally planar exterior surfaces. The housing 20 can be configured to be mounted to a rigid or moveable structure. In a non-limiting example, a rigid structure can be a wall. When the housing 20 is configured to be mounted to a rigid structure, the housing 20 can be adapted with one or more mounting apertures 29. Each mounting aperture provides a passage for a fastener through two opposite surfaces of the housing 20. In a non-limiting example, a movable structure can be a member of a mobile cart. In this example, the housing 20 can be adapted with the same mounting apertures 29, other or additional apertures (not shown) or external mounting flanges (not shown). The housing 20 can be configured to be held by a hand of the user. When the housing 20 is configured to be held by a hand of the user, one or more exterior surfaces of the housing 20 can be adapted with indentations and/or protrusions (not shown) to provide an ergonomic means for holding the apparatus 10 during use. When the housing 20 is configured to be held by a hand of the user, the above described mounting apertures 29 can be eliminated. The housing in FIG. 1 is illustrated as a one-piece housing.

Figure 3:
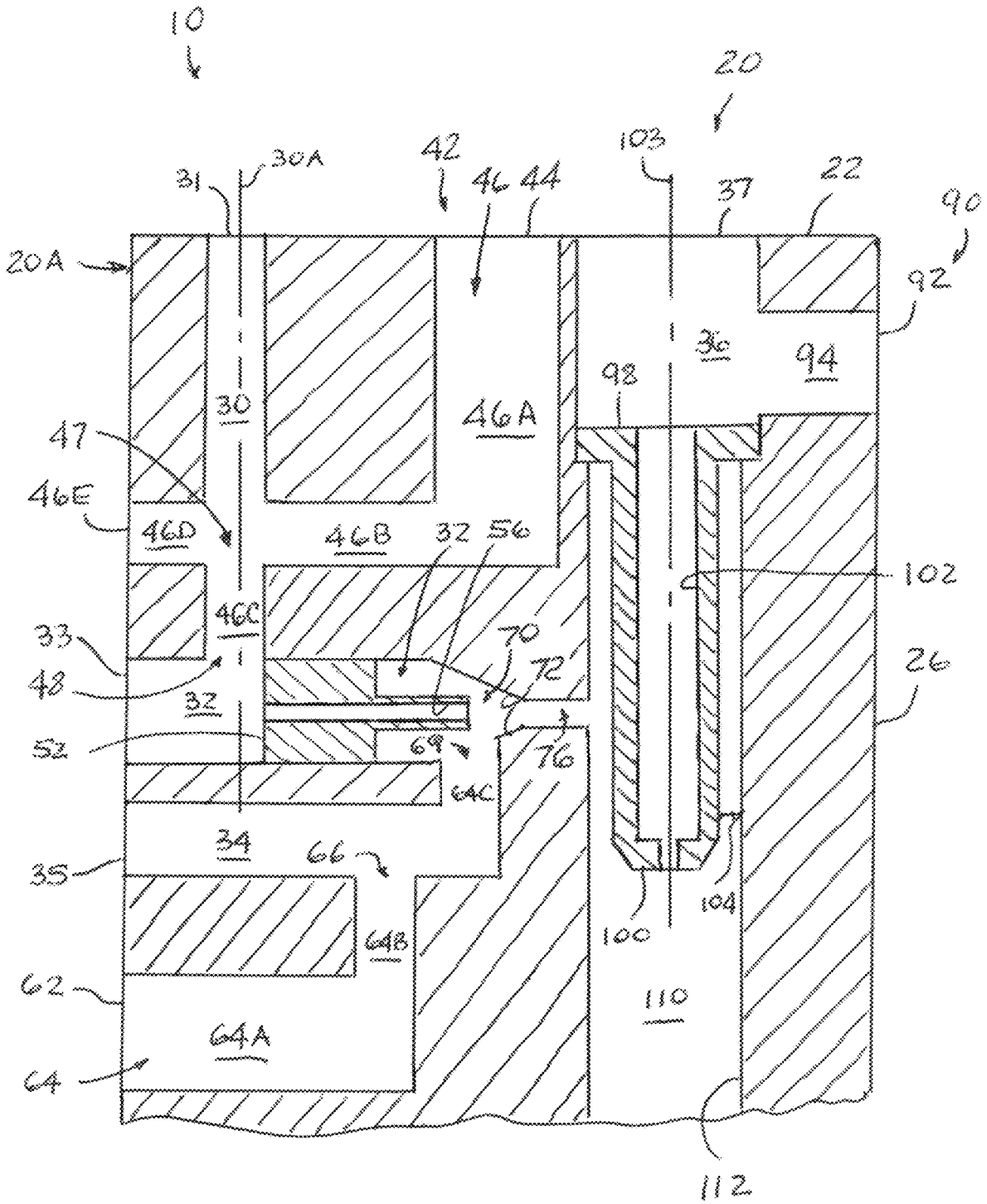
FIG. 3 illustrates a partial cross-sectional view of the apparatus of FIG. 1.

In either example, the housing 20 comprises a plurality of internal bores or cavities in the upper portion 20A, best illustrated in FIG. 3. Some bores or cavities define a corresponding opening or port in a surface of the upper portion 20A as it will be described later in this document. Various threads that could be employed within the apparatus 10 are omitted in FIG. 3, for the sake of clarity of internal passageways.

The apparatus 10 comprises a liquid flow member 42. The liquid flow member 42 comprises a liquid flow inlet opening or port 44 in an exterior surface 22 of the housing 20. The liquid flow inlet port 44 is being in a liquid communication with a supply of liquid flow under a first pressure. In a non-limiting example, the liquid can be water. In this example, the first pressure can be a pressure as is available from a municipal water supply, typically in a range between 52 pounds per square inch (PSI) and 85 PSI. The liquid flow member 42 also comprises a liquid passageway 46. The liquid passageway 46 is being illustrated as having a Z-shaped configuration comprising three portions 46A, 46B and 46C. The portion 46A is in a direct communication with the liquid flow inlet opening or port 44. The portion 46B is disposed generally perpendicular to the portion 46A. The portion 46C extends from the portion 46B, generally perpendicular thereto and generally parallel to portion 46A. The liquid passageway 46 is essentially a series of bores or a cavity in the housing 20. The portion 46A near the liquid flow inlet opening or port 44 can be adapted to operatively receive a fitting of a liquid supply member, for example such as a hose. The operatively received can refer here to a connection between the liquid passageway 46 and the fitting that prevents liquid leakage and further prevents unintended disengagement of the fitting from the liquid passageway 46. In an example, the connection can be a threaded connection, with the portion of the liquid passageway 46 near the liquid flow inlet opening or port 44 being adapted with an internal thread to receive a threaded fitting. In an example, the connection can be of a quick connect type. In this example, the fitting can be provided as a quick connect or disconnect fitting of either a male or a female type with the portion 46A near the liquid flow inlet opening or inlet port 44 being adapted to receive such fitting.

The liquid flow member 42 further comprises a liquid flow control member 50. In an example, as is illustrated in various figures, the liquid flow control member 50 is being operatively mounted within a bore or a cavity 30 in the upper portion 20A of the housing 20 in a liquid communication with the liquid passageway 46. The bore or cavity 30 defines an opening 31 in a surface of the housing 20. The bore or cavity 30 is illustrated as being substantially axially aligned with the portion 46C along an axis 30A. The passageway 46 and the bore or cavity 30 can be provided within the housing 20 by any one of a machining process, a molding process, a casting process and a 3d printing process. In an example, the liquid flow control member 50 can be mounted within the cavity or bore 46D being substantially axially aligned with the portion 46B. Term "substantially" refers herein to a misalignment between axes that can occur due to a manufacturing process. For example, the passageway 46, including the bore 46D, can be provided within the housing 20 by any one of a molding process, a casting process and a 3d printing process. The passageway 46 can be provided by a machining process, where the portion 46B is essentially an extension of the bore 46D and the portion 46C is essentially an extension of the cavity or bore 30. Or, the passageway 46 can be provided within the housing 20 by any one of a molding process, a casting process and a 3d printing process and the bore 46D can be provided by a machining process. In either example, some misalignment can occur due to manufacturing tolerances. The cavity 46D, when provided defines an opening 46E in an exterior surface 24 of the housing 20. The cavity or bore 46D can be provided to, even when the liquid flow control member 50 is mounted as illustrated, to define the portion 46B, for example by a machining process. In this example, the opening 46E will be closed after machining process to prevent undesirable liquid flow therethrough.

In either example, the liquid flow control member 50 is configured to control a rate of flow of liquid within the liquid flow inlet opening or port 44 to the portion 46C. In other words, the liquid flow control member 50 controls the amount of liquid flowing through the passageway 46 from the inlet opening or port 44. In other words, the liquid flow control member 50 is an adjustable liquid flow control member disposed within the housing 20 in a communication with a supply source of water flow through the liquid inlet port 44. The liquid flow control member 50 can be a needle valve inserted through the opening 31. In this example, a portion of the bore or cavity 30 near the exterior surface 22 of the housing 20 is threaded to threadably receive a threaded portion 50A of the needle valve 50. In this manner the needle valve 50 can be manually adjusted to move linearly, along the axis 30A, within the bore or cavity 30 and adjust a transition area 47 between the portions 36B and 46C. It would be understood that reduction in the transition area 47 reduces flow of liquid through the liquid passageway 46, while increase in the transition area 47 increases flow of liquid through the liquid passageway 46 and through a liquid outlet port 48 from the portion 46C.

In an example, the liquid flow control member 50 can be an external flow control valve. Such external control valve can be anyone of a gate valve, a ball valve, globe valve, a butterfly valve, a pneumatically operated valve, a hydraulically operated valve, and servo operated valve. The external control valve can be provided to control a pressure of the liquid into the apparatus 10. Such pressure control valve can be any one of a pressure-reducing valve, a pressure relieve valve and the like valves. The external valve can be of an in-line type. Such external valve can be detachably attached using the above described threaded portion in the bore 30 or can be an external fitting secured on the exterior surface of the housing 20.

The liquid flow member 42 additionally comprises a liquid flow jet 51 being mounted within a bore or a cavity 32 in the housing 20. The liquid flow jet 51 is configured to reduce a pressure of the liquid exiting the passageway 46 as compared with the liquid pressure received at liquid inlet port 44. In an example, the liquid flow jet 51 provides a removable and a replaceable member. In this example, the liquid flow jet 51 comprises one end 52 thereof being disposed, during use, adjacent the liquid flow outlet port 48. The liquid flow jet 51 also comprise a portion 54 of a smaller diameter and further comprises an axial bore 56 through the liquid flow jet 51 in a liquid communication with the liquid flow outlet port 48 and in a direction of the liquid flow. The axial bore 56 has a cross-sectional area thereof being smaller than a cross-sectional area of the liquid flow outlet port 48, so that the liquid flow jet 51 is being configured to generate a liquid flow under a second pressure, the second pressure being smaller than the first pressure. In this example, the liquid flow jet 51 is generally inserted through the opening 33 in the exterior surface 24, defined by the cavity or bore 32, in the exterior surface 24 of the housing 20. The liquid flow jet 51 allows the apparatus 10 to be configured as a variable liquid flow apparatus by using liquid flow jet 51 with axial apertures 56 of different cross-sections. This is advantageous when the apparatus 10 is to be used with different foam concentrates and/or in different applications. In an example, when the liquid flow jet 51 is configured as a removable and a replaceable member, the exterior surface of the liquid flow jet 51 can be adapted with an external thread to compliment an internal thread within the cavity or bore 32. In an example, when the liquid flow jet 51 is configured as a removable and a replaceable member, the exterior surface of the liquid flow jet 51 can be adapted with a resilient and compressible material or coating to allow a simple insertion into and retention of the liquid flow jet 51 within the cavity or bore 32. The bore 32 can be machined within the housing 20 and then closed, for example by a welding process or with a plug, as viewed from the exterior surface 24 of the housing 20 to define a cavity and to prevent leakage. It will be understood that the liquid flow jet 51 is configured or functions as a liquid pressure reducing member. In other words, the liquid flow jet 51 is a member with a through aperture, where the liquid flow under pressure at one end of the member and at one end of the through aperture exists the opposite end of the through aperture and subsequently opposite end of the member under a reduced pressure.

The apparatus 10 also comprises a foam concentrate flow member 60. The foam concentrate flow member 60 comprises a foam concentrate inlet port 62 in the exterior surface 22 of the housing 20, the foam concentrate inlet port 62 being in an operative communication with a supply of a foam concentrate flow. The foam concentrate flow can be provided through a hose having a connection with the foam concentrate inlet port 62. The foam concentrate flow member 60 further comprises a foam concentrate passageway 64 in a communication with the foam concentrate inlet port 62 in the surface 24 of the housing 20, the foam concentrate passageway 64 defining a foam concentrate outlet port 66. The exemplary foam concentrate passageway 64 is being illustrated as comprising portions 64A, 64B and 64C that define a Z-shape structure of the exemplary foam concentrate passageway 64. The portion 64A essentially contains the foam concentrate inlet port 62 at one end thereof. The portion 64B essentially contains the foam concentrate outlet port 66 at one end thereof. The foam concentrate flow member 60 additionally comprises a foam concentrate flow control member 68 being operatively mounted within a cavity or bore 34 in the housing 20 in an operative communication with the foam concentrate passageway 64. The cavity or bore 34 defines an opening 35 in the exterior surface 22 of the housing 20. The foam concentrate flow control member 68 controls a rate of flow of foam concentrate through the foam concentrate passageway 64. In other words, the foam concentrate flow control member 68 controls the amount of foam concentrate flowing through the foam concentrate passageway 64. In other words, foam concentrate flow control member 68 comprises an adjustable foam concentrate flow member disposed within the housing 20 in a communication with a supply source of foam concentrate flow through inlet port 62. The foam concentrate flow control member 68 can be a needle valve inserted through the opening 35. In this example, a portion of the bore or cavity 34 near the exterior surface 22 is threaded to threadably receive a threaded portion 68A of the needle valve 68. In this manner the needle valve 68 can be manually adjusted to move linearly within the bore or cavity 34 and adjust an area of the foam concentrate outlet port 66. It would be understood that reduction in the area of the foam concentrate outlet port 66 reduces foam concentrate flow through the foam concentrate passageway 64, while increase in the area of the foam concentrate outlet port 66 increases flow of the foam concentrate through the foam concentrate passageway 64 and through the foam concentrate outlet port 66.

In an example, the foam concentrate flow control member can be an external flow control valve (not shown). Such external control valve can be anyone of a gate valve, a ball valve, globe valve, a pressure-reducing valve, a butterfly valve, and the like valves. The external valve can be of an in-line type. Such external valve can be detachably attached using the above described threaded portion in the bore 34 or can be an external fitting secured on the exterior surface of the housing 20.

The apparatus 10 additionally comprises a mixing chamber 70 positioned adjacent an opposite end of the liquid flow member 42 and in a flow communication with the foam concentrate outlet port 66. The mixing chamber 70 comprises a frustoconical shape defined by surface 72 tapering inwardly away from the liquid flow jet 51. The mixing chamber 70 is configured to receive the liquid flow through the axial aperture 56 in the liquid flow jet 51 and the foam concentrate flow through a second foam concentrate outlet port 69 from the portion 64C after the flow of the foam concentrate has been regulated by the foam concentrate flow control member 68. The second pressure of the liquid flow through the liquid flow jet 51 being sufficient to generate a suction of the foam concentrate flow into the mixing chamber 70 and further generate a homogeneous mixture of the liquid and the foam concentrate.

The mixing chamber 70 and the liquid flow jet 51 essentially define a venturi member or a venturi configuration within the apparatus 10.

Furthermore, testing indicated that the mixing chamber 70 and the liquid flow jet 51 are configured to draw or siphon foam concentrate from a holding container, for example such as anyone of a bag, a tote, a tank, a pail, at low liquid flow rates, thus enabling reduced liquid usage. In other words, the apparatus 10 can function without external pump device pumping the foam concentrate.

Thus, the apparatus 10 comprises a means 40 for generating the homogeneous mixture of the liquid and the foam concentrate. In an embodiment, the means 40 for generating the homogeneous mixture of the liquid and the foam concentrate can comprise a liquid flow member 42 that comprises a liquid flow inlet port 44 in an exterior surface of the housing 20, the liquid flow inlet port 44 being in a fluid communication with a supply of liquid flow under a first pressure, a liquid passageway 46, the liquid passageway 46 defining a liquid outlet port 48, and a liquid flow jet 52 comprising one end 52 thereof disposed adjacent the liquid outlet port, an aperture 56 disposed through the liquid flow jet 51 in a liquid communication with the liquid outlet port 48 and in a direction of liquid flow, the aperture 56 having a cross-sectional area thereof being smaller than a cross-sectional area of the liquid outlet port 48, the liquid flow jet 51 being configured to generate a liquid flow under a second pressure, the second pressure being less than the first pressure. The means 40 further comprises a foam concentrate flow member 60 comprising a foam concentrate inlet port 62 in the exterior surface of the housing 20, the foam concentrate inlet port 62 being in an operative communication with a supply of a foam concentrate flow, and a foam concentrate passageway 64 in a communication with the foam concentrate inlet port, the foam concentrate passageway defining a foam concentrate outlet port. The means 40 additionally comprises a mixing chamber 70 positioned adjacent an opposite end of the liquid flow jet 51 and in a communication with the foam concentrate outlet port 69, the mixing chamber 70 comprising a frustoconical shape, the mixing chamber 70 configured to receive the liquid flow through the axial aperture 56 in the liquid flow jet 51 and the foam concentrate flow through the foam concentrate outlet port 69, the second pressure being sufficient to generate a suction of the foam concentrate flow into the mixing chamber 70 and further generate a homogeneous mixture of the liquid and the foam concentrate. It has been found that to draw a sufficient amount of the foam concentrate into the mixing chamber 70 due to suction, the free end of the portion 54 of the liquid flow jet 51 should be positioned about mediate the opening of the second foam concentrate outlet port 69.

In an embodiment, the means 40 for generating the homogeneous mixture of the liquid and the foam concentrate can comprise a liquid flow inlet port 44 in an exterior surface 22 of the housing 20, the liquid flow inlet port 44 in a liquid communication with a supply of liquid flow under a first pressure, a foam concentrate inlet port 62 in the exterior surface 24 of the housing 20, the foam concentrate inlet port 62 being in an operative communication with a supply of a foam concentrate flow, and a venturi member in a liquid communication with the liquid flow inlet port 44 and in a communication with the foam concentrate inlet port 62, the venturi member configured to generate a suction, with the liquid flow from the liquid flow inlet port 44, of the foam concentrate flow from the foam concentrate inlet port 62 into the mixing chamber 70 and further generate a homogeneous mixture of the liquid and the foam concentrate.

The generated homogeneous mixture of liquid and foam concentrate exits, under a second pressure, the mixing chamber 70 through the passageway 76 into a mixing chamber 110. In other words, the passageway 76 defines an outlet from the mixing chamber 70. Furthermore, this outlet is provided in FIGS. 1-9 in a direct flow communication with the mixing chamber 110. The mixing chamber 70 can be also referred to as a first mixing chamber 70 or a first chamber 70 and the mixing chamber 110 can be referred to as a second mixing chamber 110 or a second chamber 110.

Figure 4:
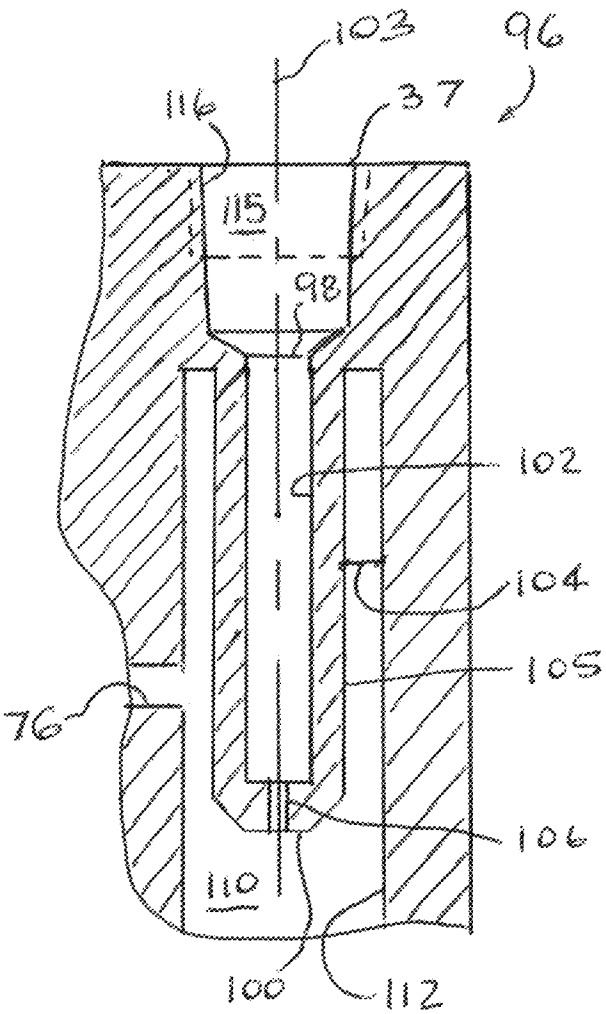
FIG. 4 illustrates an elevation view of an exemplary gas jet member that can be employed within the apparatus of FIG. 1.
Figure 7:
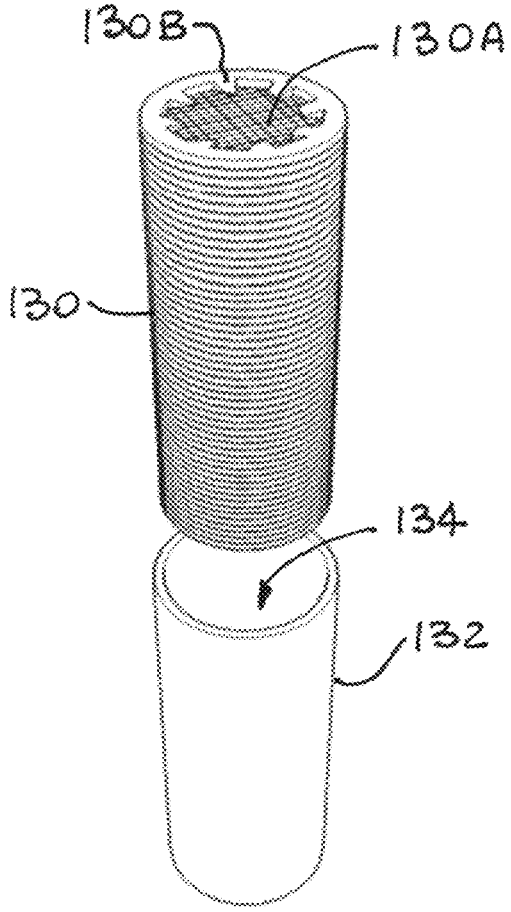
FIG. 7 illustrates an exploded 3D view of a screen member employed within the apparatus of FIG. 1.
Figure 8:
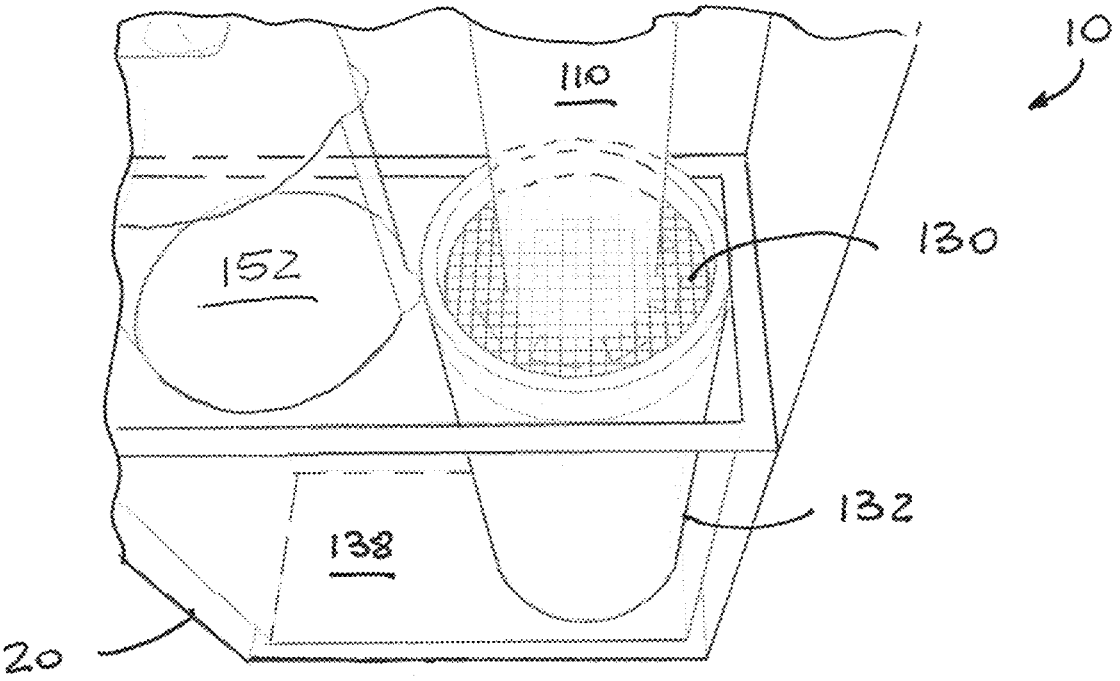
FIG. 8 illustrates a partial 3D view of a lower portion of the apparatus of FIG. 1.

The apparatus 10 of FIGS. 1-9 further comprises a gas flow member 90. In a further reference to FIG. 3, the gas flow member 90 can comprise a gas inlet port 92 in an exterior surface 26 of the housing 20. The gas flow inlet port 92 is being in an operative communication with a supply of gas flow under a pressure. A gas passageway 94 is also being provided in a flow communication with the gas inlet port 92 and essentially with the mixing chamber 70. The apparatus 10 also comprises a gas flow jet 96 that is configured to deliver the gas flow under a reduced pressure into the mixing chamber 110 for mixing with the homogeneous mixture of liquid and foam concentrate exiting the mixing chamber 70 through the passageway 76. In an example of FIGS. 3 and 5, the gas flow jet 96 comprises an elongated body with one end 98 thereof positioned adjacent the gas inlet port 92 and an opposite second end 100 of the gas flow jet 96 disposed at a distance from the one end 98 along a length of the gas flow jet 96 and along the axis 103 running between ends 98 and 100 of the gas flow jet 96. The end 100 can be chamfered. The main portion of the gas flow jet 96, including the end 100, is disposed within the mixing chamber 110. The gas flow jet 96 further comprises a cavity or bore 102 and an aperture 106 aligned with the cavity or bore 102 along the axis 103. The cavity or bore 102 being in a gas flow communication with the gas inlet port 92. There aperture 106 terminates the cavity or bore 102 at the second end 100. A cross-sectional area of the aperture 106 being smaller than a cross-sectional area of cavity or bore 102. The cavity or bore 102 and the aperture 106 can be machined through the bore 36 defining an opening 37 with the exterior surface 22 of the upper portion 20A of the housing 20. The opening 37 can be closed after machining operation. Furthermore, a cross-sectional area of a peripheral surface of the gas flow jet 96 in a plane normal to the length thereof is sized smaller than a cross-sectional area of the mixing chamber 110 to define a peripheral gap 104 between an inner wall 112 of the gas passageway 94 and the exterior surface 105 of the gas flow jet 96. The gas flow jet 96 being in an operative communication with the gas flow inlet member 92 to generate a gas flow under a third pressure external to the opposite second end 100 and within the mixing chamber 110. The end 98 of the gas flow member 90 can be adapted with an optional external thread (not shown) to threadably engage an internal thread (not shown) within the cavity or bore 36. In an example of FIG. 4, the gas flow jet 96 is provided as an integral feature of the housing 20, and particularly as an integral feature of the upper portion 20A. In other words, the gas flow jet 96 in the embodiment of FIG. 4 is provided as one or more cavities or bores within the upper portion 20A. A through aperture or a bore 102 is disposed axially along the axis 103 in a direction of gas flow from one end 98 through the opposite end 100. The cavity or bore 102 being in a gas flow communication with the gas inlet opening 37. There is also an aperture 106 terminating the cavity or bore 102 at the second end 100. A cross-sectional area of the aperture 106 being smaller than a cross-sectional area of cavity or bore 102. Furthermore, a cross-sectional area of a peripheral surface of the gas flow jet 96 in a plane normal to the length thereof is sized smaller than a cross-sectional area of the mixing chamber 110 to define a peripheral gap 104 between an inner wall 112 of the gas passageway 94 and an exterior surface 105 of the gas flow jet 96. The gas flow jet 96 being in an operative communication with the gas flow inlet member 92 to generate a gas flow under a third pressure external to the opposite second end 100 within the mixing chamber 110. In this example, the gas flow jet 96 is provided as a non-removable, a non-replaceable and a non-interchangeable member. A thread 116 can be provided within an upper portion or cavity 115 of the gas flow jet 96 of FIG. 4 for connection to an external source of gas flow under pressure. It would be further understood, that the cavity 115 with or without the thread 116 can be disposed adjacent the exterior surface 26 of the upper portion 20A of the housing 20, thus replacing the above described gas flow inlet member 92. In an example of FIG. 6, the gas flow jet 96 essentially comprises an elongated body with one end 98 and an opposite second end 100 of the gas flow jet 96 disposed at a distance from the one end 98 along a length of the gas flow jet 96 and along the axis 103 within the mixing chamber 110. A through cavity or bore 102 is disposed axially though the body of the gas flow jet 96 in a direction of gas flow from one end 98 through the opposite end 100. The cavity or bore 102 being in a gas flow communication with the gas inlet port 92. There is also an aperture 106 terminating the cavity or bore 102 at the second end 100. A cross-sectional area of the aperture 106 being smaller than a cross-sectional area of cavity or bore 102. Furthermore, a cross-sectional area of a portion of the gas flow jet 96, in a plane normal to the length thereof, being disposed within the mixing chamber 110 is sized smaller than a cross-sectional area of the mixing chamber 110 to define a peripheral gap 104 between an inner wall 112 of the gas passageway 94 and an exterior surface 105 of the gas flow jet 96. The gas flow jet 96 being in an operative communication with the source of gas flow under pressure to generate a gas flow under a third pressure external to the opposite second end 100 within the mixing chamber 110. The gas flow jet 96 also comprises an external thread 114 that is configured to compliment an internal thread within the bore 36 so that the gas flow jet 96 can be made removable, replaceable or interchangeable. Furthermore, the end 98 comprises the above described cavity 115 with an internal thread 116 that is configured to connect to the source of the gas under pressure, for example such as a hose fitting (not shown). The cavity 115 is in gas communication with the source of the gas flow under pressure and with the cavity or bore 102 and the aperture 106. The hose fitting (not shown) can be secure to the end of the hose (not shown) or can be provided as a separate fitting of a quick disconnect type. It would be understood, that in the example of FIG. 6, the gas inlet port 92 is not needed and is being essentially replaced by the cavity 115.

It will be understood that the gas flow jet 96 is configured or functions as a gas pressure reducing member. In other words, the gas flow jet 96 is a member with an internal cavity and a through aperture connecting the internal cavity with an external environment, where the gas flow under pressure within the internal cavity and at one end of the through aperture exists the opposite end of the through aperture under a reduced pressure.

In either example of the gas flow jet 96, the mixing chamber 110 is configured to receive the homogeneous mixture of liquid and foam concentrate from the mixing chamber 70 through the passageway 76 so as to generate the homogeneous mixture of gas, liquid and foam concentrate. The third pressure is being sufficient to draw the homogenous mixture of liquid and foam concentrate from the mixing chamber 70 that first fills the peripheral gap 104 and then mixes with gas flow under a reduced pressure from the aperture 106. In other words, the gas flow from the gas flow jet 96 generates sufficient suction (or an effective amount of suction) to draw the homogeneous mixture of liquid and foam concentrate into the mixing chamber 110, where the homogeneous mixture of liquid and foam concentrate mixes with the gas flow to produce a homogeneous mixture of gas, liquid and foam concentrate.

As it has been described above, the gas flow jet 96 can be configured as a replaceable or an interchangeable member. In other words, the gas flow jet 96 can be inserted into or removed from the bore 36 through the opening 37. More specifically, the size of the cavity or bore 102, the size of the aperture 106 and the external diameter or the peripheral surface of the gas flow jet 96 can be varied depending on a type of the foam concentrate, application and desired consistency or viscosity of a resulting mechanical foam 2. In other words, the gas flow jet 96 comprises a gas pressure reducing member mounted within the housing, the air pressure reducing member with a portion thereof disposed within the second mixing chamber 110 and with a through bore 102, 106 extending axially through a length of the air pressure reducing member, the through bore 102, 106 of the air pressure reducing member being in a communication with a supply source of air flow to circulate the air flow under a second pressure within the second mixing member 110, the air flow circulating under the second pressure within the second mixing chamber 110 being sufficient to draw a mixture of the water and the foam concentrate from the outlet of the first mixing chamber 70 for mixing with the air flow circulating under the second pressure.

Figure 6:
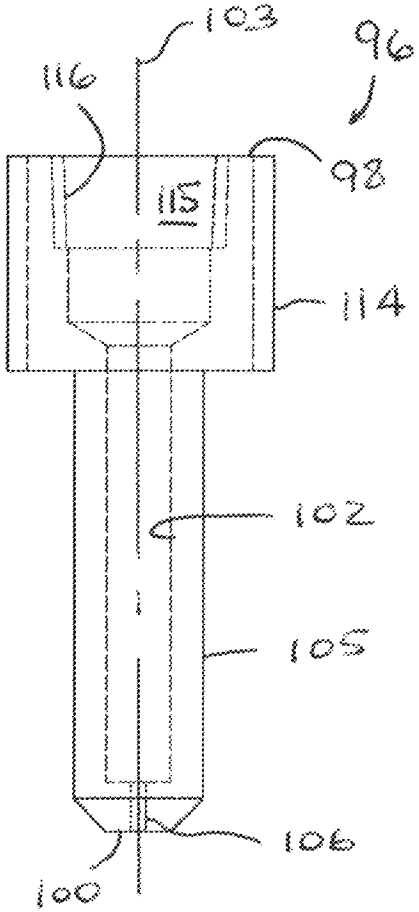
FIG. 6 illustrates an elevation view of an exemplary gas jet member that can be employed within the apparatus of FIG. 1.
Figure 5:
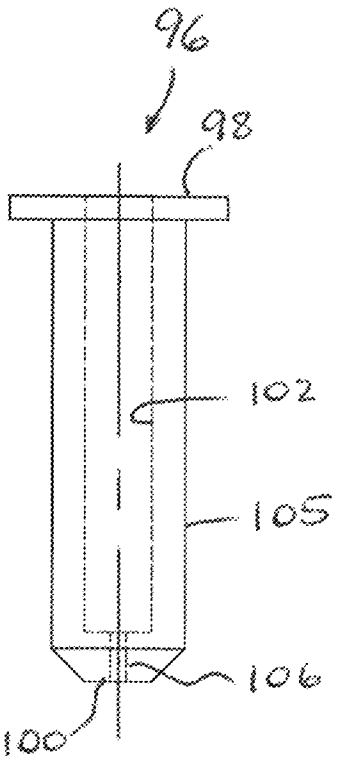
FIG. 5 illustrates an elevation view of an exemplary gas jet member that can be employed within the apparatus of FIG. 1.

The gas flow jet 96, particularly of FIGS. 5 and 6 can be used, as a field replacement, to improve foam producing and dispersing unit in use by drilling and/or threading a required bore arrangement and sizing the gas flow jet 96 for the application.

The mixing chamber 110 and the gas flow jet 96 essentially define another or a second venturi member or a second venturi configuration within the apparatus 10.

The second mixing chamber 110 also comprises an outlet 113.

Figure 3A:
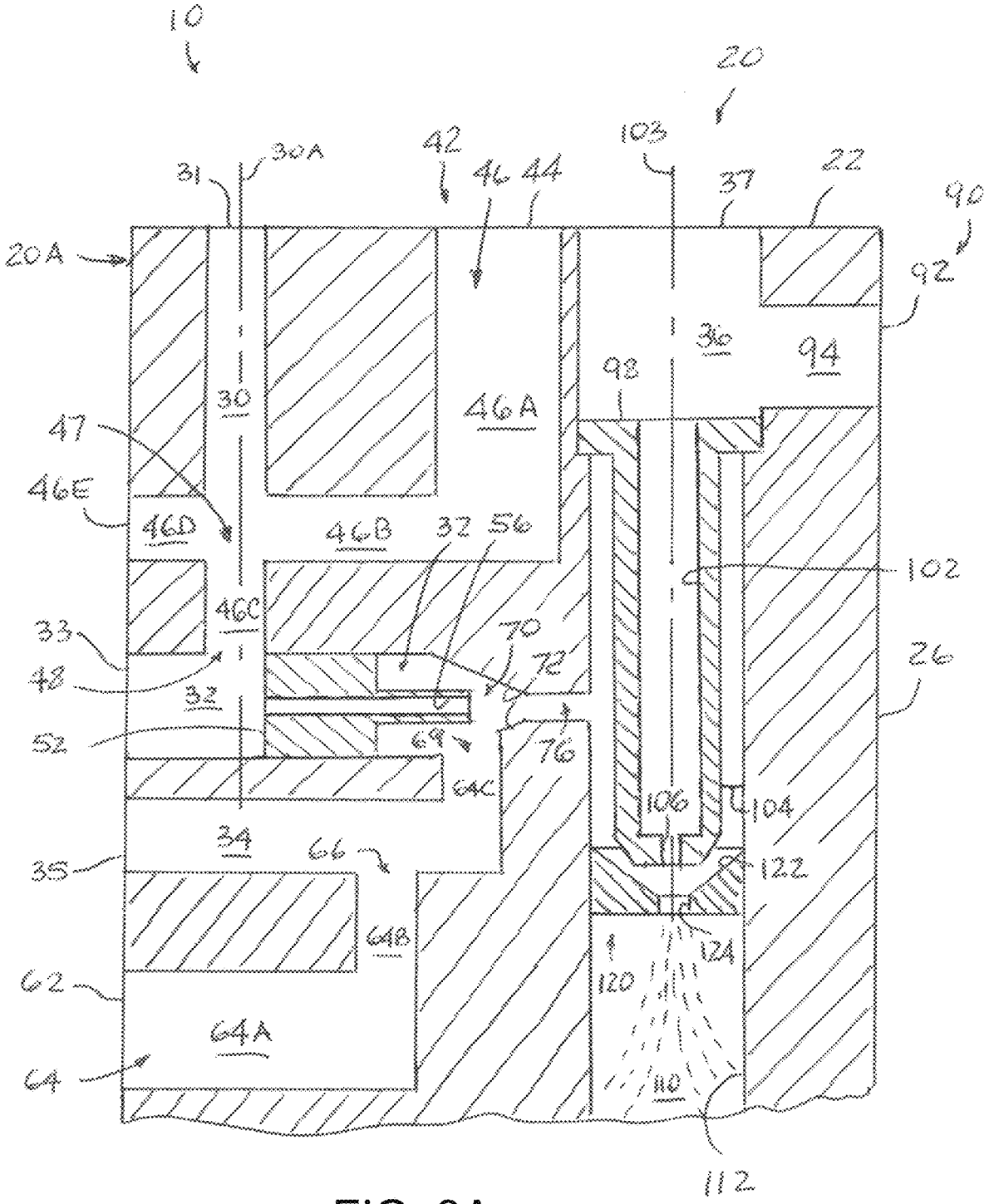
FIG. 3A illustrates a partial cross-sectional view of the apparatus of FIG. 1.

FIG. 3A illustrates that the apparatus 10 can be adapted with an optional member 120 mounted during use within the mixing chamber 110 in a close proximity to the end 100 of the gas flow member 96 but allowing a flow around the end 100. The member 120 essentially divides the mixing chamber 110 in two parts. An upper part disposed above the member 120 and surrounds the gas flow member 96 and a lower part disposed below the member 120. The optional member 120 comprises a frustoconical inner surface 122 and an axial aperture 124. The axial aperture 124 is axially aligned with the bore 102 and the aperture 106 along the axis 103. Both the aperture 124 and the frustoconical inner surface 122 are configured to receive a flow of gas, liquid and foam concentrate mixture from the upper portion of the mixing chamber 110 and to disperse it into a lower portion of the mixing chamber 110 in a pattern that deviates from direct flow in an area adjacent the end 100 of the gas flow member 96. The member 120 can be considered and is configured as another venturi within the apparatus 10.

Thus, in an embodiment, the apparatus 10 comprises a means for generating the foam solution flow, where the means can comprise a gas flow inlet port 92 being in the exterior surface of the housing 20, the gas inlet flow port 92 being in an operative communication with a supply of gas flow under pressure and a venturi member in a communication with the gas inlet port 92 and the above described means 40 within the housing 20 for generating the homogeneous mixture of liquid and foam concentrate. In this embodiment, the venturi member is configured to generate a suction, due to a gas flow from the gas flow jet 96 and further generate a homogeneous mixture of gas, liquid and foam concentrate.

Such homogeneous mixture of gas, liquid and foam concentrate passes through a screen member 130 disposed within another, or mixing third, chamber 134 to produce the mechanical foam 2. The third chamber 134 is being in a communication with the outlet 110A. The screen member 130 comprises perforations that are sized to generate required mechanical foam consistency. In an example of FIGS. 7-8, the screen member 130 is illustrated as a stack of perforated members 130A spaced apart from each other, with spacers 130B, and being disposed within a hollow interior (foam augmentation or third mixing chamber) 134 of a sleeve 132. The screen member 130 can be provided as a cartridge or a magazine. Furthermore, the perforated members 130A can be replaced with a medium, for example such as an aerator stone, having perforations or opening causing the augmentation of the passing solution of foam concentrate, liquid and gas. The screen member 130 can be also replaced with a static type mixer, as well as perforated member 202, described in details below.

The space between a pair of adjacent perforated members 130A defined by a spacer 130B is needed to generate to allow formation of a generally spherical and downwardly moving bubble separating from a perforated member 130. As the bubble of compressed air trapped within a "shell" of a water and foam concentrate medium begins to separates from the perforated screen 130A, it has a tear drop or a balloon shape. When the bubble completely separates from the perforated member 130A and is disposed within the space defined by spacer 130B, it transforms into a substantially spherical shape until it is forced through next perforated member 130A. In other words, all bubble in the resulting mechanical foam 2 form within the spaces define by spacers 130B. The number of layers of the perforated members 130A depends at least on the foam concentrate and is selected to be sufficient to stabilize and control the pressure within the screen member 130 so as to maintain the resulting bubble integrity in the dispersed mechanical foam 2. In other words, as the mixture of liquid foam concentrate and gas travels through the screen member 130, the original pressure of gas flow from the aperture or bore 106 decreases in a downward direction. This gas pressure has to be maintained at a sufficient level to maintain surface tension of the bubbles within the mechanical foam 2. Insufficient gas pressure will decrease the surface tension and a subsequent life of the bubble, while higher than desired gas pressure will prematurely rupture the surface tension of the bubble.

The mixture of gas, liquid and foam concentrate, passing or flowing through the screen member 130, flows into a foam accumulation chamber 138 which is advantageously being the hollow interior of the lower portion 20B of the housing 20. The resulting mechanical foam 2 is being dispersed external to the housing 20 through a foam dispersion port 150 in the exterior surface 24. The foam dispersion (outlet) port 150 terminates a foam passageway 152 being in a communication with the foam accumulation chamber 138 to disperse the mechanical foam 2 external to the housing 20.

In other words, the screen member 130 is configured to convert a mixture of gas, liquid, and foam concentrate exiting the outlet 110A of the second mixing chamber 110 into a mechanical form, the mechanical form dispersing through the foam dispersion outlet port 150 during operation of the apparatus 10.

Figure 9:
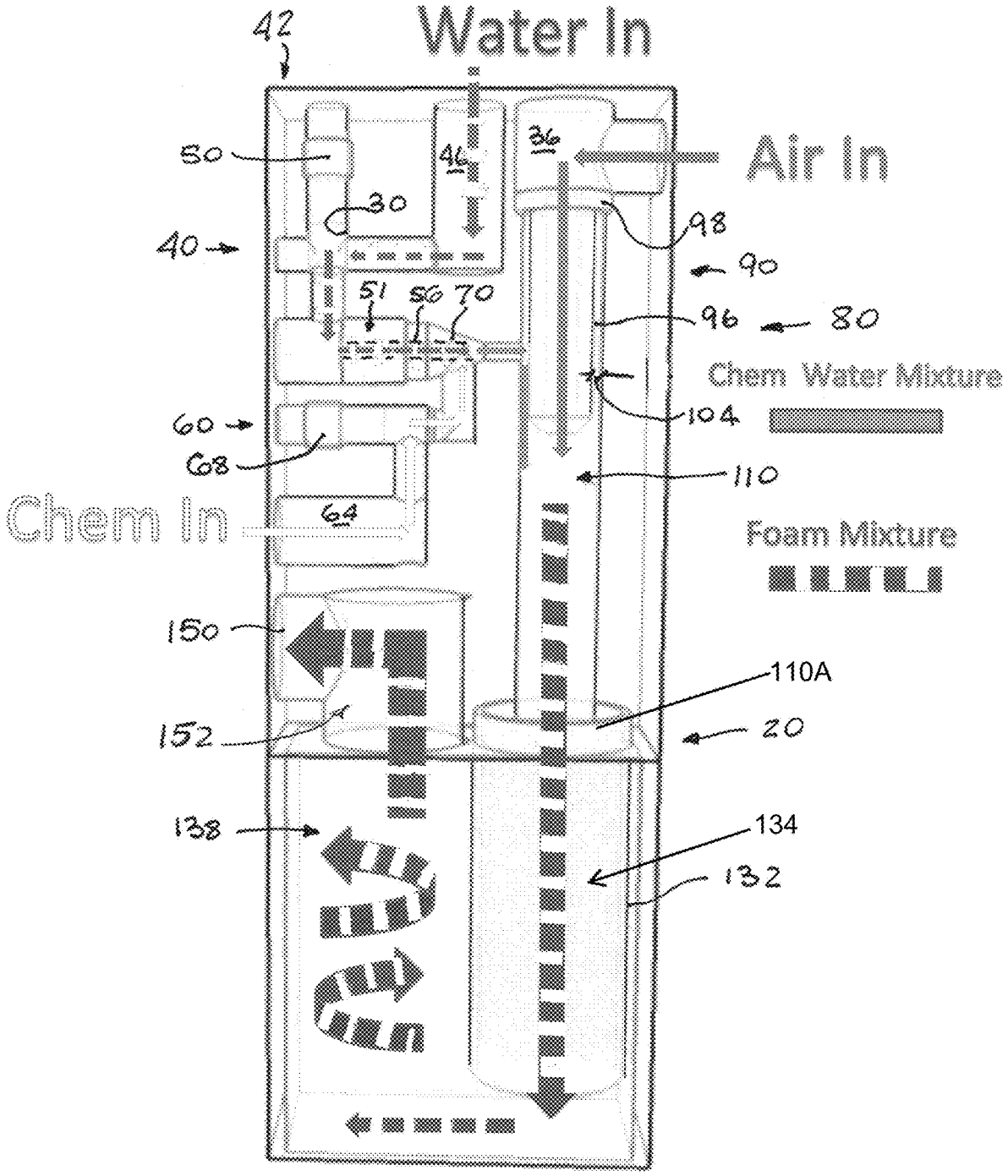
FIG. 9 illustrates a diagrammatic view of the apparatus of FIG. 1, particularly showing flows of liquid, gas, foam concentrate and resulting foam solution and foam.
Figure 10:
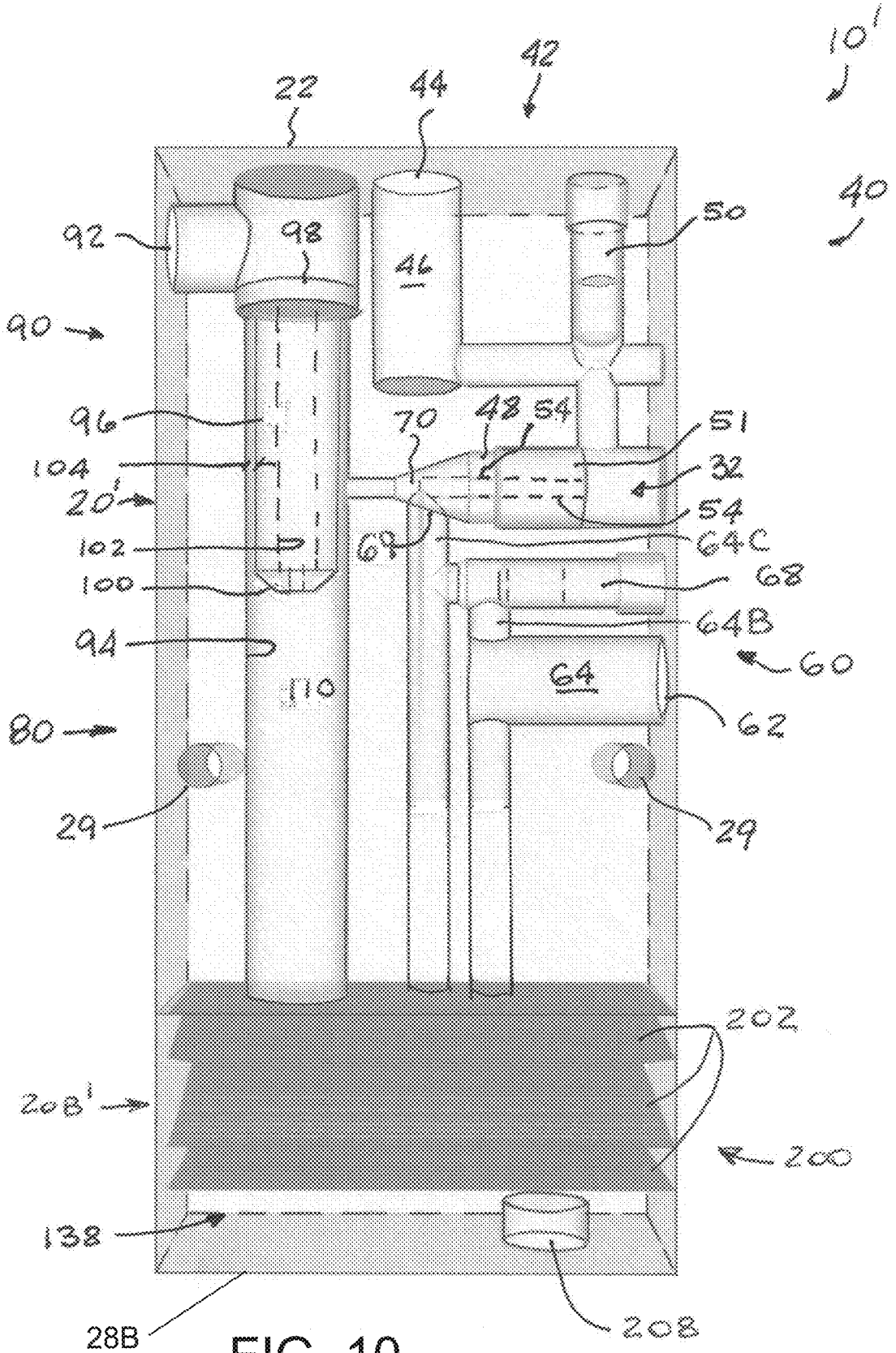
FIG. 10 illustrates a diagrammatic view of an exemplary apparatus that produces and dispenses foam.

The operation of the apparatus 10 of FIGS. 1-8 can be best explained in a reference to FIG. 9, particularly when liquid is water and the gas is air. During operation of the apparatus 10, water flow enters the unit through the water inlet port 44. The water can be from a conventional municipal supply, generally under a pressure in a range of between 52 PSI and 85 PSI. However, it would be understood, that this pressure can be regulated (increased or decreased) depending on the application and performance necessary to operate to desired specifications.

It has been found that the water pressure can have a direct influence on the suction or vacuum to draw the sanitizing chemical. A lower viscosity sanitizing foam concentrate (or dilution) may require less water pressure. There is a direct relationship to pressure and volume. The needle valve 50 reduces/increases the volume of water, for example, while maintaining a desired pressure. So there is a direct performance relationship, and controllability of concentrate amount, for example in particles per million (ppm), to water flow and/or pressure that can take place concurrently. As the water pressure reduces, more foam concentrate is required to maintain the desired longevity of the mechanical foam 2.

The water flows through the passageway 46 past the needle valve 50 which controls its flow and is adjustable. Next, the water flow moves into a chamber 32 before the water jet 51. The water flow is then forced into the aperture 55 (narrow porting) of the water jet 51. As the water flow exits the water jet 51, it creates a reduced pressure area or turbulence briefly in the mixing (injection) chamber 70 between a peripheral surface of the narrow portion 54 and interior surface of the chamber 70. Water flow through the mixing chamber 70 creates a siphon effect which draws foam concentrate into the mixing chamber 70 from the chemical inlet port 62. The foam concentrate also flows past a needle valve 68 which controls its flow as it moves toward the mixing chamber 70. Water and foam concentrate flow past the mixing chamber 70 together to enter the mixing chamber 110. Air is injected through the air inlet port 92 and then into the bore 102 and through the aperture 106 (narrow porting) of the air jet 96. Low pressure at the discharge end 100 of the air jet 96 draws water and foam concentrate mixture from the outlet of the passageway 76 into the mixing chamber 110 where incipient foam solution develops. The location of the passageway 76 mediate a length of the narrow portion of the gas flow jet 96 generates a turbulence between the exterior surface 105 of the gas flow jet 96 and the inner wall 112 of the mixing chamber 110, and aiding in draw of the liquid and foam concentrate mixture into the mixing chamber 110. The new foam solution mixture is driven into the augmentation chamber 134 by air and water pressure. In the augmentation chamber 134, the mixture is forced through a series of perforated screens 130A. Pressure and agitation promote volume in the foam while bubbles form or propagate in the gaps (formed by spacers 130B) between the perforated screens 130A and proliferate on the screen surfaces. Mechanical foam 2 pours out of the augmentation or mixing chamber 134 into the accumulation chamber 138. When the accumulation chamber 138 is full, rich mechanical foam 2 dispenses from the foam dispersion or outlet port 150. It is contemplated herein that the mixing chamber 134 can be disposed within the accumulation chamber 138.

FIGS. 10-14 illustrate an embodiment of the apparatus 10' that produces and dispenses mechanical foam. The apparatus 10' is constructed similar if not identical to the apparatus 10, except for a different screen member and dispersion of the mechanical foam 2 through a bottom of the housing.

Figure 11:
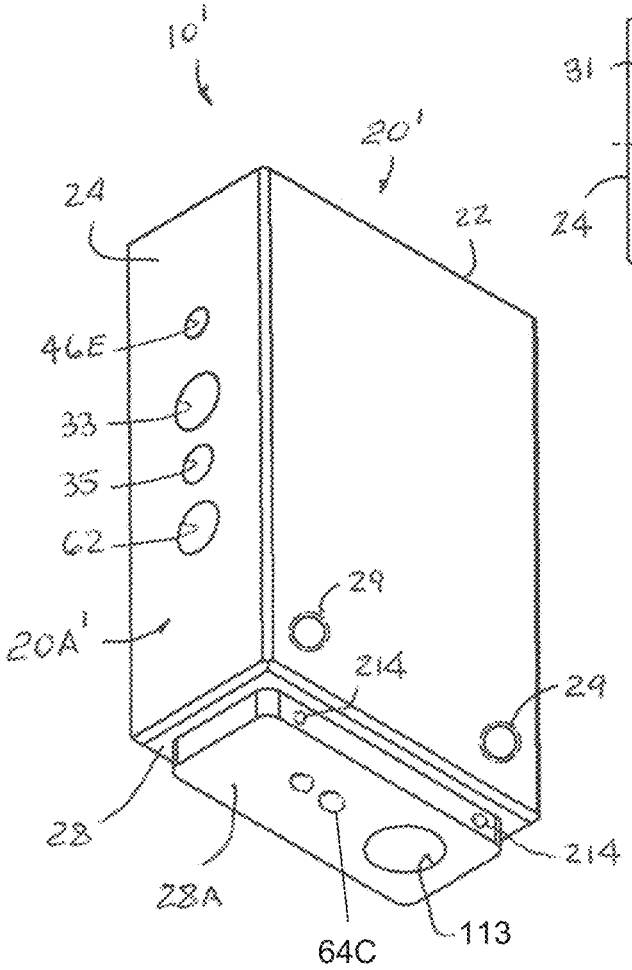
FIG. 11 illustrates a 3D view of an upper portion of a housing of apparatus of FIG. 10.
Figure 13:
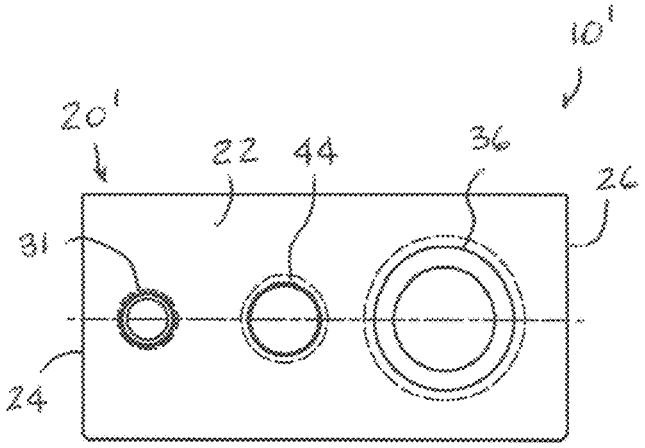
FIG. 13 illustrates a top view of the upper portion of the housing of FIG. 11.

The housing 20' of the apparatus 10' is provided without the above described foam dispersion port 150 and the foam passageway 152. In other words, the upper portion 20A' is illustrated in FIG. 11, as having only four apertures. Instead, the foam dispersion port 208 is provided through a bottom wall of the lower portion 20B' of the housing 20' in a communication with the exterior surface 28B thereof. Furthermore, the mixing chamber 110 defines an opening 113 in the surface 28A of the upper portion 20A'. FIG. 11 also illustrates that the above described portion 64C can be provided as a bore from the exterior surface 28B and later plugged to prevent leakage. FIG. 13 illustrates a top view of the housing 20', particularly illustrating the gas flow jet 96 of FIG. 6.

The screen member 200 of the apparatus 10' comprises a plurality of perforated panels or screen panels 202 disposed within the foam accumulation chamber 138 either parallel to each other or at an incline to each other. The screen panels 202 as well as the above described perforated members or disks 130A can be manufactured from any material suitable for use with sanitizing foam solution. In a non-limiting example, such material can be a stainless steel woven wire material.

The lower portion 20B' can be welded to the upper portion 20A' to prevent leakage of the mechanical foam 2 and essentially provide a one-piece integral housing 20'.

Figure 12:
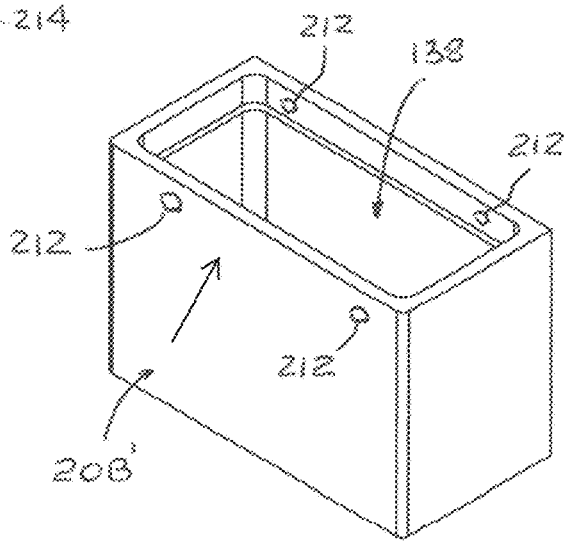
FIG. 12 illustrates a 3D view of a lower portion of a housing of apparatus of FIG. 10.
Figure 14:
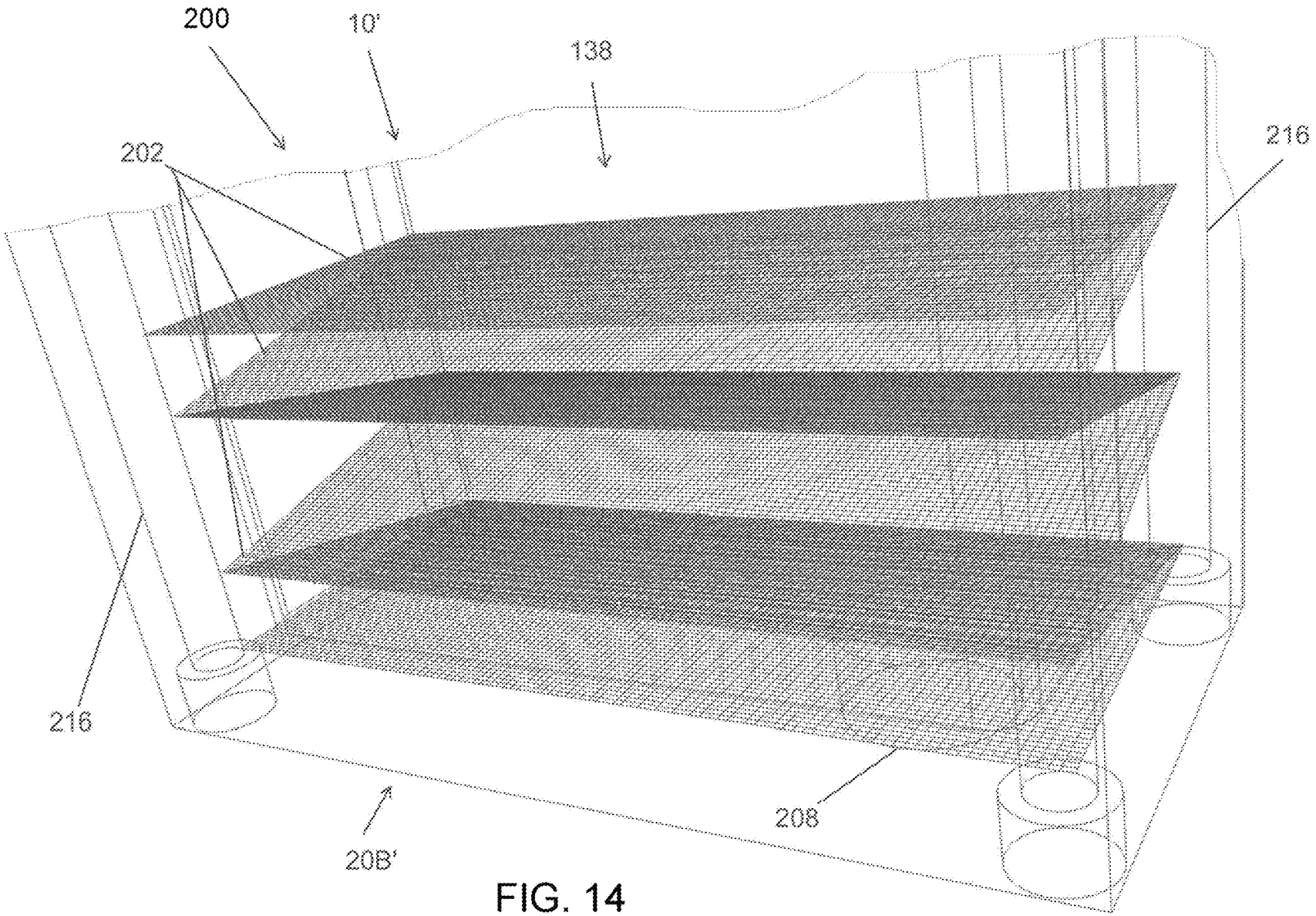
FIG. 14 illustrates a partial 3D view a lower portion of a housing of apparatus of FIG. 10.

It is contemplated herein that the lower portion 20B' of the housing 20' can be detachably or removably attached to the upper portion 20A', for example by inclusion of through aperture(s) 212 through walls of the lower portion 20B' and mating aperture(s) 214 within a thickness of the upper portion 20A', for example between the surfaces 28A and 28, as is best illustrated in FIGS. 11 and 12. When the, lower portion 20B' is detachably attached to the upper portion 20A', the screen panels 202 can be cleaned and/or replaced. The replaced screen panels 202 can comprise perforations of different shapes and/or sizes. In other words, the screen member 200 with or without lower portion 20B' can be easily adapted for a particular type of the mechanical foam 2 and/or a particular application. In an example of FIG. 14, fasteners can be passed through bores 216 from the surface 29 in the lower portion 20B' for engagement into complimentary apertures (not shown) within the surface 28.

The apparatus 10' is not limited to use of threaded fasteners in coupling the lower portion 20B' to the upper portion 20A', and swing fasteners, or clamp fasteners are also being contemplated herein.

It would be understood that the connection between a lower portion 20B' and upper portion 22A' will be sealed from leakage, for example with a gasket (not shown) or any other suitable sealing arrangements. It would be also understood that the housing 20 of the apparatus 10 can be adapted with the same apertures 210 and 212.

Figure 15:
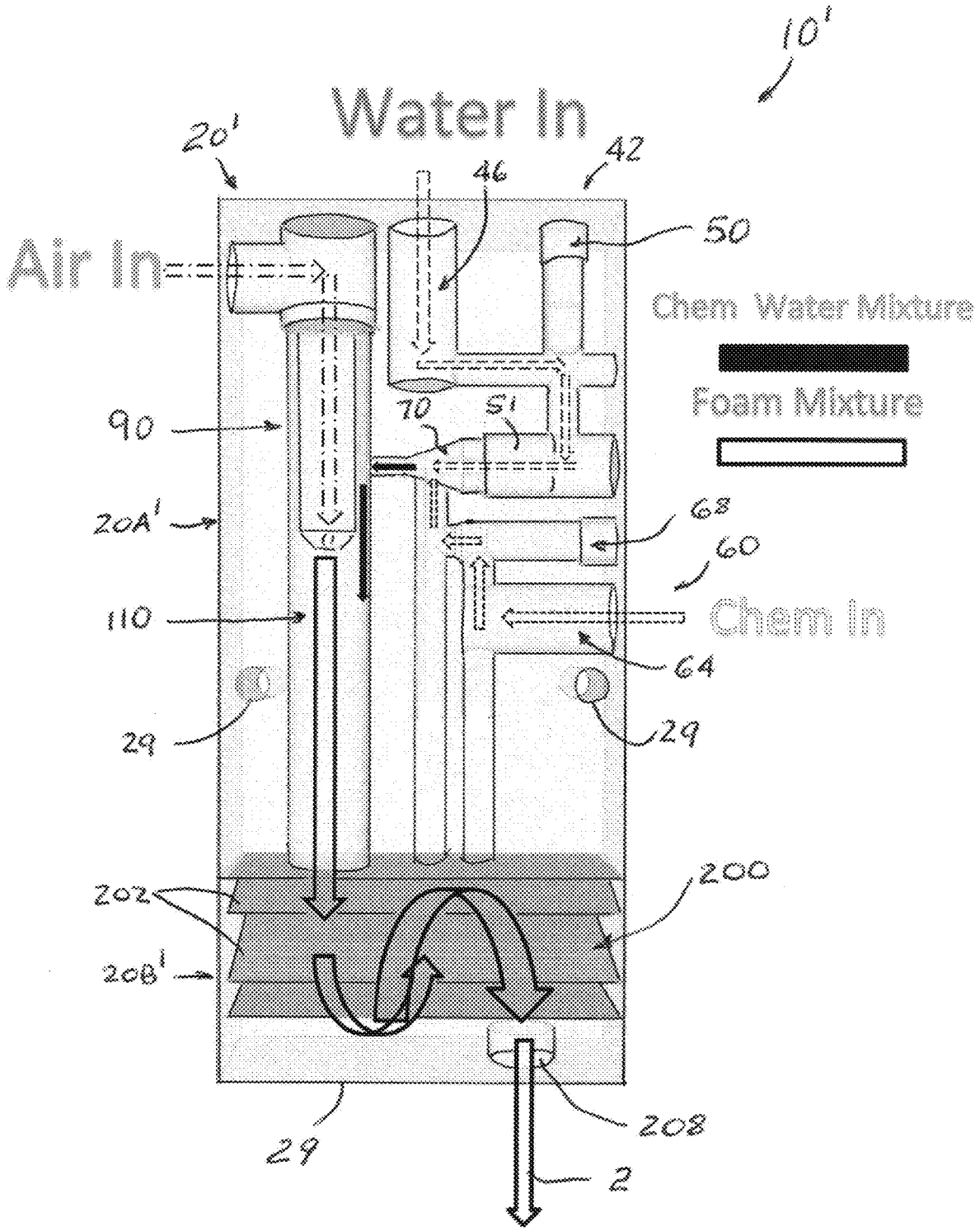
FIG. 15 illustrates a diagrammatic view of the apparatus of FIG. 10.

The operation of the apparatus 10' can be best explained in a reference to FIG. 15, particularly when liquid is water and the gas is air. During operation of the apparatus 10', water flow enters the unit through the water inlet port 44. The water can be from a conventional municipal supply, generally under a pressure in a range between 52 PSI and 85 PSI. The air source can be from a conventional shop air lines/source. The water flows through the passageway 46 past the needle valve 50 which controls its flow and is adjustable. Next, the water flow moves into a chamber 32 before the water jet 51. The water flow is then forced into the aperture 55 (narrow porting) of the water jet 51. As the water flow exits the water the aperture 55 of the jet 51, it creates a reduced pressure area briefly in the mixing (injection) chamber 70. Water circulation within the mixing chamber 70 creates a siphon effect which draws foam concentrate into the chamber 70 from the chemical inlet port 62. The foam concentrate also flows past a needle valve 68 which controls its flow as it moves toward the mixing chamber 70. Water and foam concentrate flow through the passageway 76 and past the mixing chamber 70 together to enter the mixing chamber 110. Air is injected through the air inlet port 92 and then into the cavity or bore 102 and through the aperture 106 (narrow porting) of the air jet 96. Low pressure at the discharge end 100 of the air jet 96 draws water and foam concentrate into the mixing chamber 110 where incipient foam solution develops. The new foam solution mixture is driven into the augmentation chamber 134 by air and water pressure. In the augmentation chamber 134, the mixture is forced through a series of screen panels 202. Pressure and agitation promote volume in the foam while bubbles propagate in the gaps between the screen panels 202 and proliferate on the screen surfaces. When the accumulation chamber 138 is full, rich mechanical foam 2 dispenses from the foam dispersion port 208.

Figure 16:
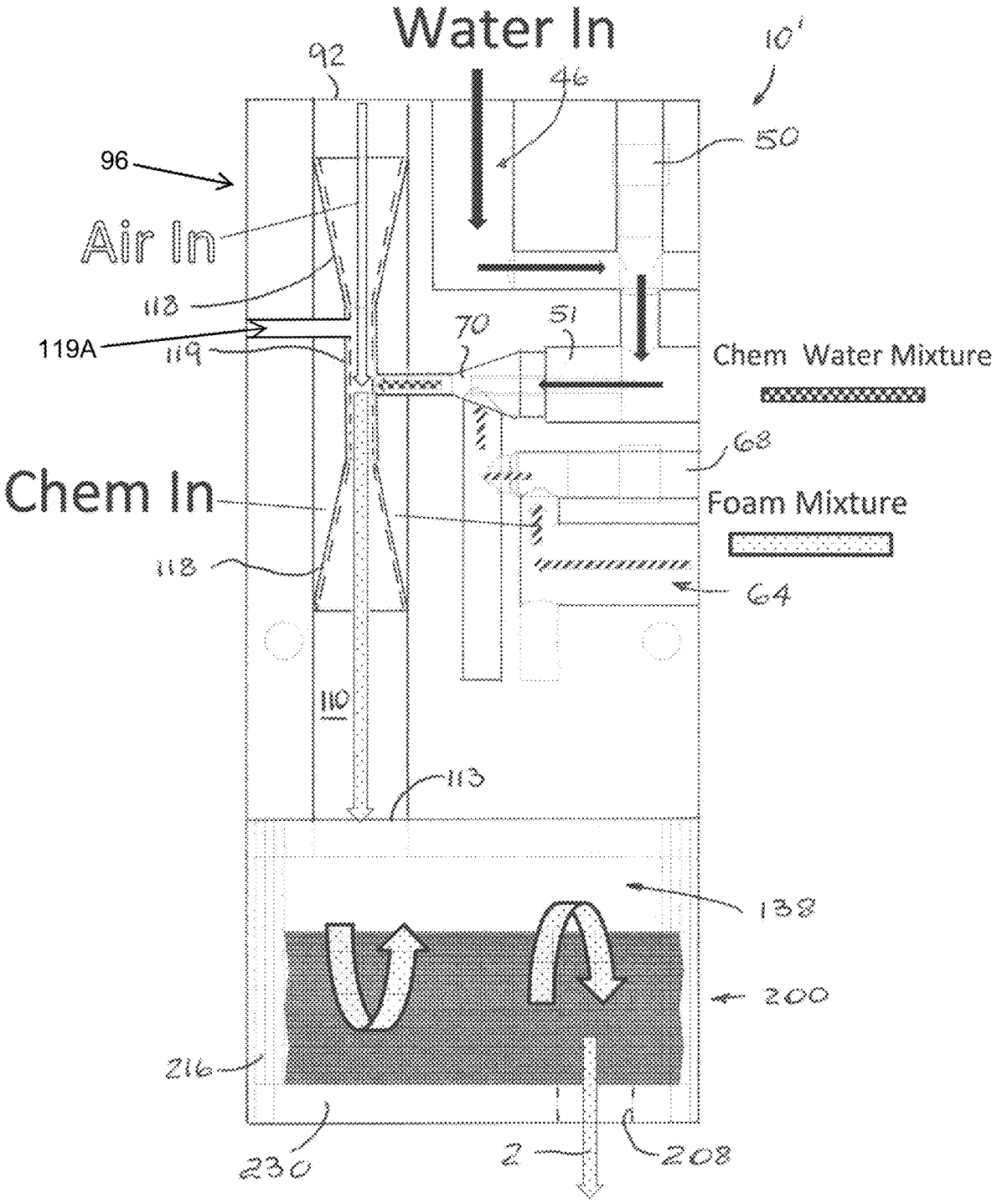
FIG. 16 illustrates a diagrammatic view of the apparatus of FIG. 10.

FIG. 16 illustrates an exemplary embodiment of the apparatus 10' where the gas flow valve 96 comprises a pair of frustoconical end portions 118 joined with a middle straight portion 119. The passageway 76 from the mixing chamber 70 is connected to the middle portion 119 and is being in a flow communication therewith. In other words, the mixture of liquid and foam concentrate existing the mixing chamber 70 through the passageway 76 mixes with gas flow supplied through the upper end portion 118 and exists through a lower end portion 118 which is in flow communication with the mixing chamber 110. It would be understood that the lower end portion 118 can be an extension of the mixing chamber 110. In the exemplary embodiment of FIG. 16, the liquid flow pressure is reduced within the straight middle portion 119 as compared with the liquid flow pressure in the upper end portion 118. As the mixture of gas, liquid and foam concentrate exists the straight middle portion 119 into the lower end portion 118, the pressure of the foam solution remains low, while the flow velocity of the foam solution is higher than the flow velocity of the mixture of liquid and foam concentrate entering the middle portion 119.

FIG. 16 also illustrates an optional passageway 119A into the straight middle portion 119 that is positioned above the passageway 76. The passageway 119A can be adapted with an internal thread to receive a flow control (adjusting) member, for example such as a needle valve (not shown) or configured for connection to an external flow control member (not shown). Such flow control member will increase or decrease volume of gas, and further restrict, if desired, the venturi port.

FIG. 16 additionally illustrates a removable bottom wall or end wall 230 and attachment of a lower portion of the housing 20 to the upper portion of the housing 20 with fasteners (not shown), as will be explained in more details further in this document. The end wall 230 may be omitted in a direct mounting of the apparatus 10, 10' to a vessel.

It is to be understood that the above described apparatus 10 of FIGS. 1-9 can be also adapted with the gas flow valve 96 of FIG. 16.

Figure 17:
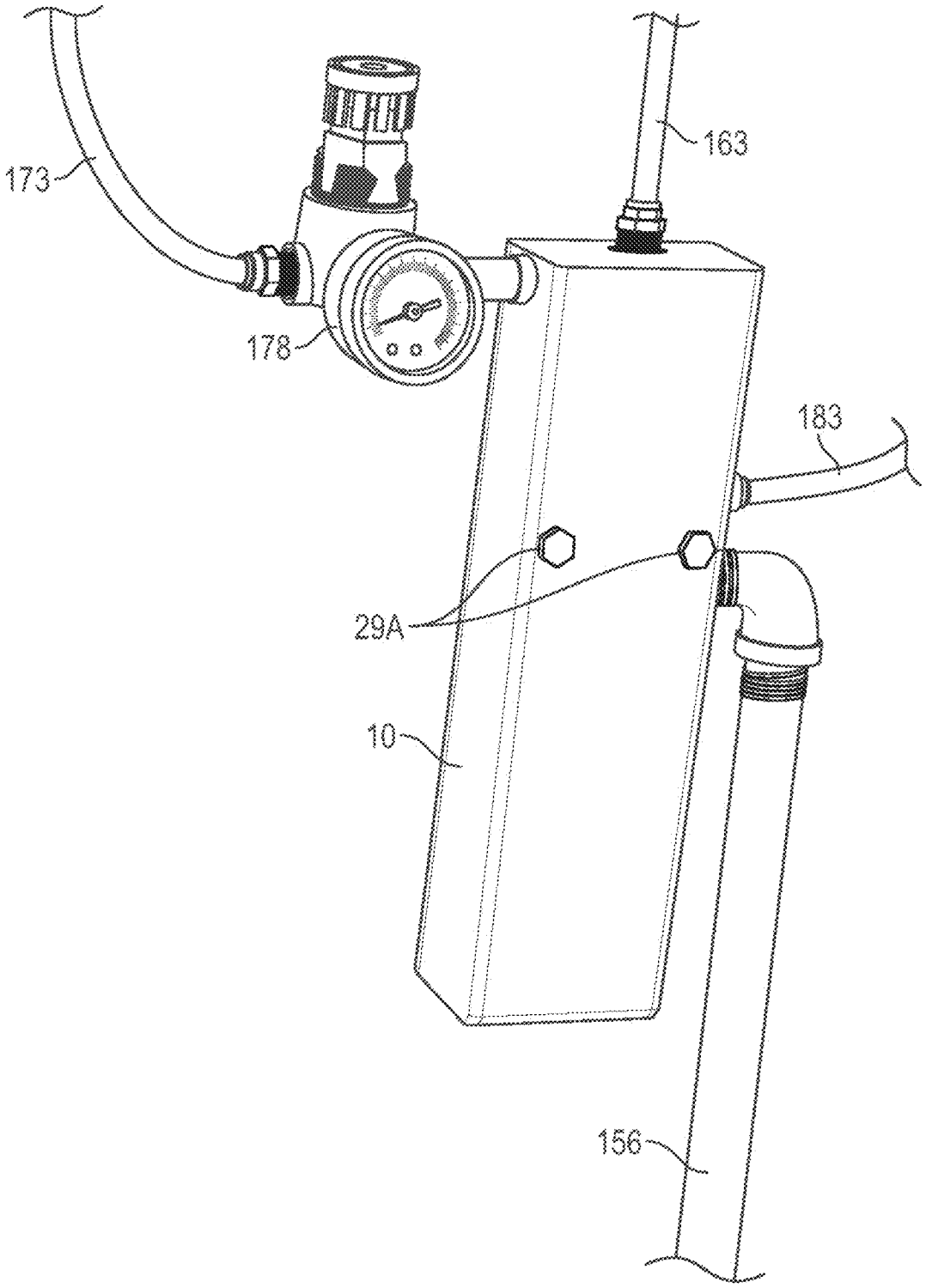
FIG. 17 illustrates an environmental view of the apparatus of FIG. 1.
Figure 18:
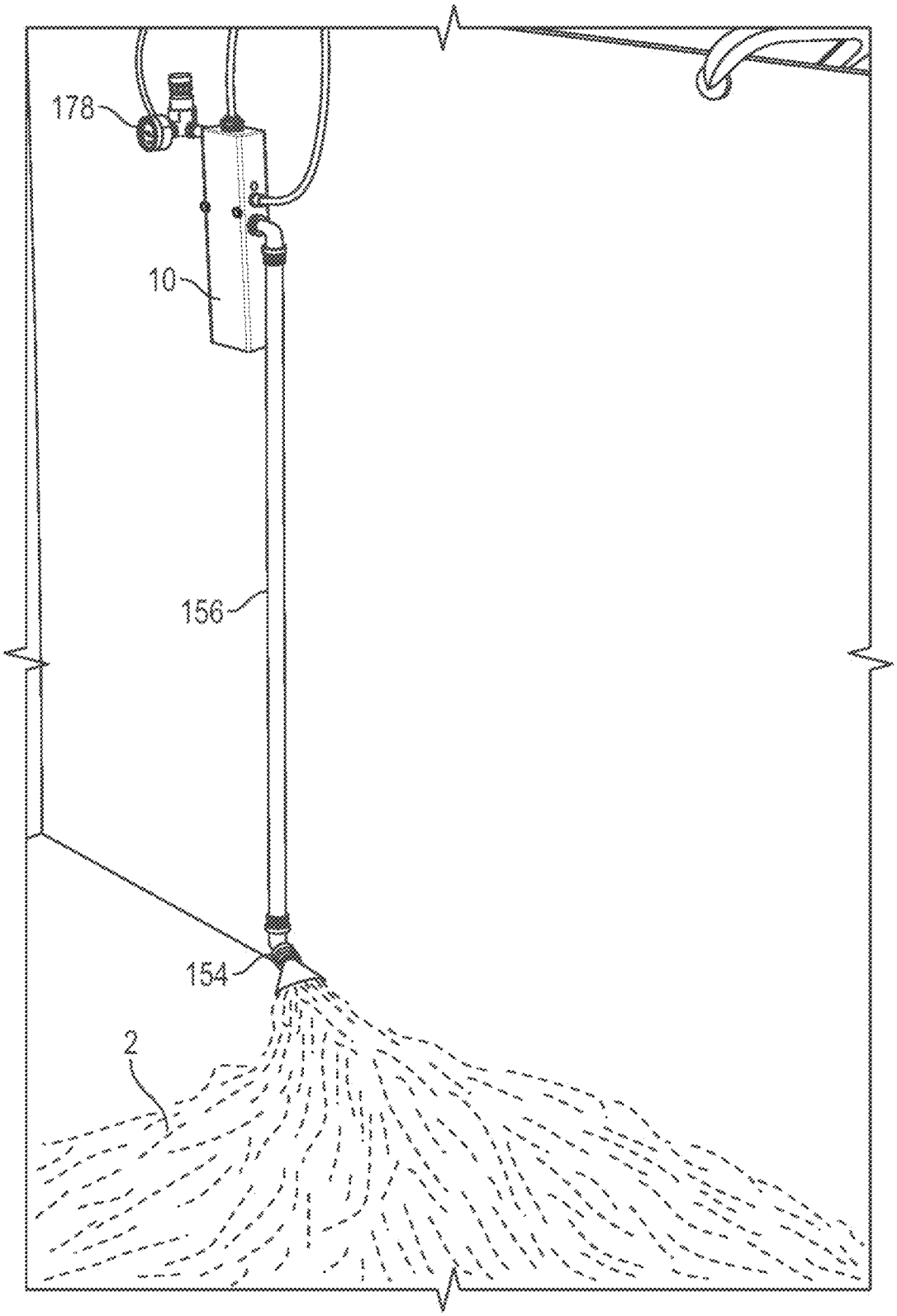
FIG. 18 illustrates an environmental view of the apparatus of FIG. 1.

FIGS. 17-18 illustrate the apparatus 10 mounted for use to a vertical structure with fasteners 29A passed through apertures 29. Other non-limiting attachment arrangements can include clamps, adhesive tape, hook and loop fasteners and the like. FIGS. 17-18 further illustrate a foam dispersion member or nozzle 154 positioned at a distance from the housing 20 and a connection 156 between the foam dispersion port 150 and the foam dispersion member 154. Such connection 156 is shown as a rigid pipe supporting the foam dispersion member 154 at a distal end thereof but can be also a hose when the nozzle 154 is mounted independently. The nozzle 154 can be also referred to as "emitter' in this document. The nozzle 154 is selectable based on application requirements and is not a limiting feature of this disclosure. In an example, a nozzle with a single port of about 0.56 inch in diameter can disperse foam about 9.0 feet deep and about 12.0 inches wide. In an example a nozzle with an opening of about 4.75 inch wide by 0.18 high can disperse foam about 3 feet wide by 2 feet deep. In an example, a nozzle with an opening of about 2.5 inches wide by about 0.18 high opening would disperse about 3.0 feet wide by 4.0 feet deep.

It would be understood that in the embodiment of the apparatus 10' mounted in a similar manner, the connection 156 will extend from the bottom surface 28B of the housing 10'.

In an embodiment, the apparatus can comprise a housing, a water flow member comprising a water flow inlet port in an exterior surface of the housing, the water flow inlet port in a fluid communication with a supply source of water flow under a first pressure, a water passageway, the water passageway defining a water outlet port, a water flow control member in a water communication with the water passageway, the water flow control member controlling a rate of flow of water, and a water flow jet comprising one end thereof disposed adjacent the water outlet port, a first aperture disposed through the water flow jet in a water communication with the water outlet port and in a direction of water flow, the first aperture having a cross-sectional area thereof being smaller than a cross-sectional area of the water outlet port, the water flow jet is configured to generate a water flow under a second pressure, the second pressure being less than the first pressure. The apparatus can further comprise a foam concentrate flow member comprising a foam concentrate inlet port in the exterior surface of the housing, the foam concentrate inlet port in an operative communication with a supply source of a foam concentrate flow, a foam concentrate passageway in a communication with the foam concentrate inlet port, the foam concentrate passageway defining a foam concentrate outlet port, and a foam concentrate flow control member in an operative communication with the foam concentrate passageway, the foam concentrate flow control member controlling a rate of flow of the foam concentrate. The apparatus 10 can further comprise a first mixing chamber positioned adjacent an opposite end of the water flow jet and in a communication with the foam concentrate outlet port, the first mixing chamber comprising a frustoconical shape, the first mixing chamber configured to receive the water flow through the axial aperture in the water flow jet and the foam concentrate flow through the foam concentrate outlet port, the second pressure being sufficient to generate a suction of the foam concentrate flow into the first mixing chamber and further generate a homogeneous water and foam concentrate mixture. The apparatus can further comprise an air flow inlet member comprising an air inlet port in the exterior surface of the housing 20, the air inlet port in an operative communication with a supply source of air flow under a third pressure, an air passageway in a communication with the air inlet port and with the first mixing chamber, and an air flow jet disposed in the air passageway, the air flow jet comprising one end thereof positioned adjacent the air inlet port, an opposite second end, a second aperture disposed though the air flow jet in a direction of air flow, the second aperture in an air flow communication with the air inlet port, and a cross-sectional area of the air flow jet being smaller than a cross-sectional area of the air passageway, and the air flow jet being in an operative communication with the air flow inlet member to generate an air flow under a second pressure external to the opposite second end. The apparatus 10 can further comprise a second mixing chamber configured to receive the homogeneous water and foam concentrate mixture from the first mixing chamber due to an air flow from the air flow jet, the air flow under the third pressure being sufficient to draw the homogeneous water and foam concentrate mixture into the second mixing chamber where the homogeneous water and foam concentrate mixture mixes with the air flow to produce a foam solution flow. The apparatus can further comprise a foam augmentation chamber disposed in a flow path of the foam solution. The apparatus can further comprise a screen stack positioned in the foam augmentation chamber, the screen stack comprises perforated screens disposed in a spaced apart relationship with each other in a path of the foam solution flow, the foam solution flow passes through perforations within the perforated screens and exits the screen stack as the mechanical foam. The foam solution changes from a low pressure flow to a high pressure flow after passage through the screen stack. The apparatus can further comprise a foam accumulation chamber disposed downstream of the foam augmentation chamber after the screen stack, the foam accumulation chamber receiving the mechanical foam passed through the screen stack. The apparatus can additionally comprise a foam dispersion port in the exterior surface of the housing 20, the foam dispersion port in a communication with the foam accumulation chamber to disperse the mechanical foam external to the housing.

In an embodiment, an apparatus that produces and dispenses mechanical foam can comprise a housing, a water flow member comprising a water flow inlet port in an exterior surface of the housing, the water flow inlet port being in a fluid communication with a supply of water flow under a first pressure, a water passageway, the water passageway defining a water outlet port, a water flow control member in a water communication with the water passageway, the water flow control member controlling a rate of flow of the water, and a water flow jet comprising one end thereof disposed adjacent the water outlet port, a first aperture disposed through the water flow jet in a water communication with the water outlet port and in a direction of water flow, the first aperture having a cross-sectional area thereof being smaller than a cross-sectional area of the water outlet port, the water flow jet is configured to generate a water flow under a second pressure, the second pressure being less than the first pressure. The apparatus can further comprise a foam concentrate flow member comprising: a foam concentrate inlet port in the exterior surface of the housing, the foam concentrate inlet port in an operative communication with a supply of a foam concentrate flow, a foam concentrate passageway in a communication with the foam concentrate inlet port, the foam concentrate passageway defining a foam concentrate outlet port, and a foam concentrate flow control member in an operative communication with the foam concentrate passageway, the foam concentrate flow control member; controlling a rate of flow of the foam concentrate; a first mixing chamber positioned adjacent an opposite end of the water flow jet and in a communication with the foam concentrate outlet port, the first mixing chamber comprising a generally frustoconical shape, the first mixing chamber configured to receive the water flow through the axial aperture in the water flow jet and the foam concentrate flow through the foam concentrate outlet port, the second pressure being sufficient to generate a suction of the foam concentrate flow into the first mixing chamber and further generate a homogeneous mixture of the water and the foam concentrate, an air flow inlet member comprising an air inlet port in the exterior surface of the housing, the air inlet port in an operative communication with a supply of air flow under a third pressure, an air passageway in a communication with the air inlet port and with the first mixing chamber, and an air flow jet disposed in the air passageway, the air flow jet comprising one end thereof positioned adjacent the air inlet port, an opposite second end, a second aperture disposed though the air flow jet in a direction of air flow, the second aperture in an air flow communication with the air inlet port, and a cross-sectional area of the air flow jet being smaller than a cross-sectional area of the air passageway, the air flow jet being in an operative communication with the air flow inlet member to generate an air flow under a second pressure external to the opposite second end; a second mixing chamber configured to receive water and foam concentrate mixture from the first mixing chamber due to an air flow from the air flow jet, the air flow under the third pressure being sufficient to draw the water and foam concentrate mixture into the second mixing chamber where the water and foam concentrate mixture mixes with the air flow to produce a flow of the mechanical foam, and a foam dispersion port in the exterior surface of the housing, the foam dispersion port in a communication with the second mixing chamber to disperse the flow of the mechanical foam external to the housing.

In any of the above embodiments, a threaded connection/arrangement can be replaced by any one of a force (press) fit arrangement, an adhesive, a glue and even a welded arrangement.

In any of the above embodiments, the foam concentrate (or foam producing agent) can be one of an aqueous film-forming foams (AFFFs), Class A foams, Class B foams, Class C foams, wetting agents, high-expansion foam concentrates, and protein foams. The foam concentrate may be a foam liquid concentrate. The foam liquid concentrate may be any one of the known products commonly used for the generation of mechanical foam. These include the protein and synthetic types. The fluorinated surfactants and the detergents are examples of the latter type.

The gas that can be used in mechanical foam generation 10, 10' is commonly air since it is the most available one. Other nonflammable gases such as nitrogen may also be used, however.

When a control of the apparatus 10, 10' is to be automated (i.e. other than manual ON/OFF), a control system or arrangement of the apparatus of FIGS. 1-18 can be illustrated based on exemplary embodiments of FIGS. 19-22.

Figure 19:
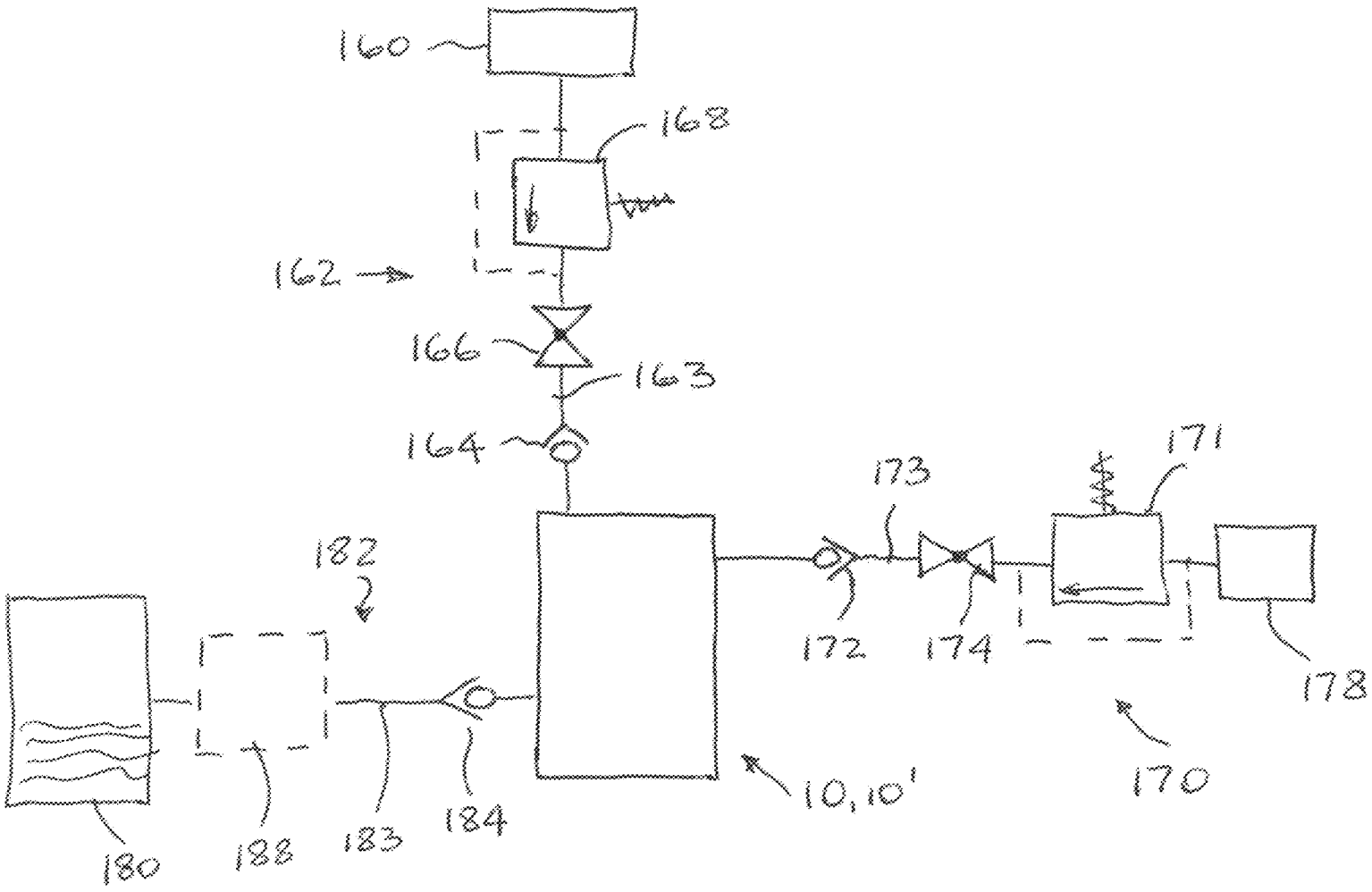
FIG. 19 illustrates an exemplary control block diagram of the apparatus of FIG. 1 or 10.

Now in a reference to FIG. 19, an exemplary embodiment of a control system or arrangement for the apparatus 10, 10' can comprise a connection 162 with the supply source 160 of the water/liquid flow. This connection 162 can comprises any one of a check valve 164, an ON/OFF valve 166 and a pressure regulator 169, all connected by a pipe or hose 163. The pressure regulator 169 is needed when the pressure of water/liquid need to be at a different level than the pressure coming from the source of water/liquid flow. The apparatus 10, 10' can additionally comprise the supply source 160 of water flow, the supply source 160 of water flow being at least one of a water main, a stationary container, a portable container, a mobile container, a fixed tank, a movable tank, and a mobile tank. The apparatus 10 can comprise a connection 182 with the supply source 180 of the foam concentrate. The connection 182 can comprise an optional pump 188 and a check valve 184. The apparatus 10, 10' can also comprise the supply source 180 of the foam concentrate being one of a packaging tote, a pail, a fixed atmospheric tank, a movable tank, a stationary container, a portable container, a mobile container, a gravity fed vessel, a premix supply line or a pressurized vessel that may utilize compressed air to pressurize a rated vessel. The connection 182 can also comprise piping, tubing or hose 183 connecting all control components with the supply source 180 of foam concentrate. The apparatus 10 can also comprise a connection 170 with the supply source of the air flow. The connection 170 can comprise an air pressure regulator 171. The air flow can be also a gas flow. The gas can be an inert gas.

The connection 170 can also comprise piping, tubing or hose 173 connecting all control components with a supply source 178 of gas under pressure. The hose can be a flexible and even a coiled hose. The exact order of components in FIG. 17 is not essential. In an example, the locations of the ON/OFF valve 166 and the pressure regulator 169 can be reversed. In an example, the locations of the ON/OFF valve 174 and the pressure regulator 171 can be reversed. It would be understood that when an external liquid flow control valve is provided, the control member 50 can be eliminated within the apparatus 10, 10'.

Figure 20:
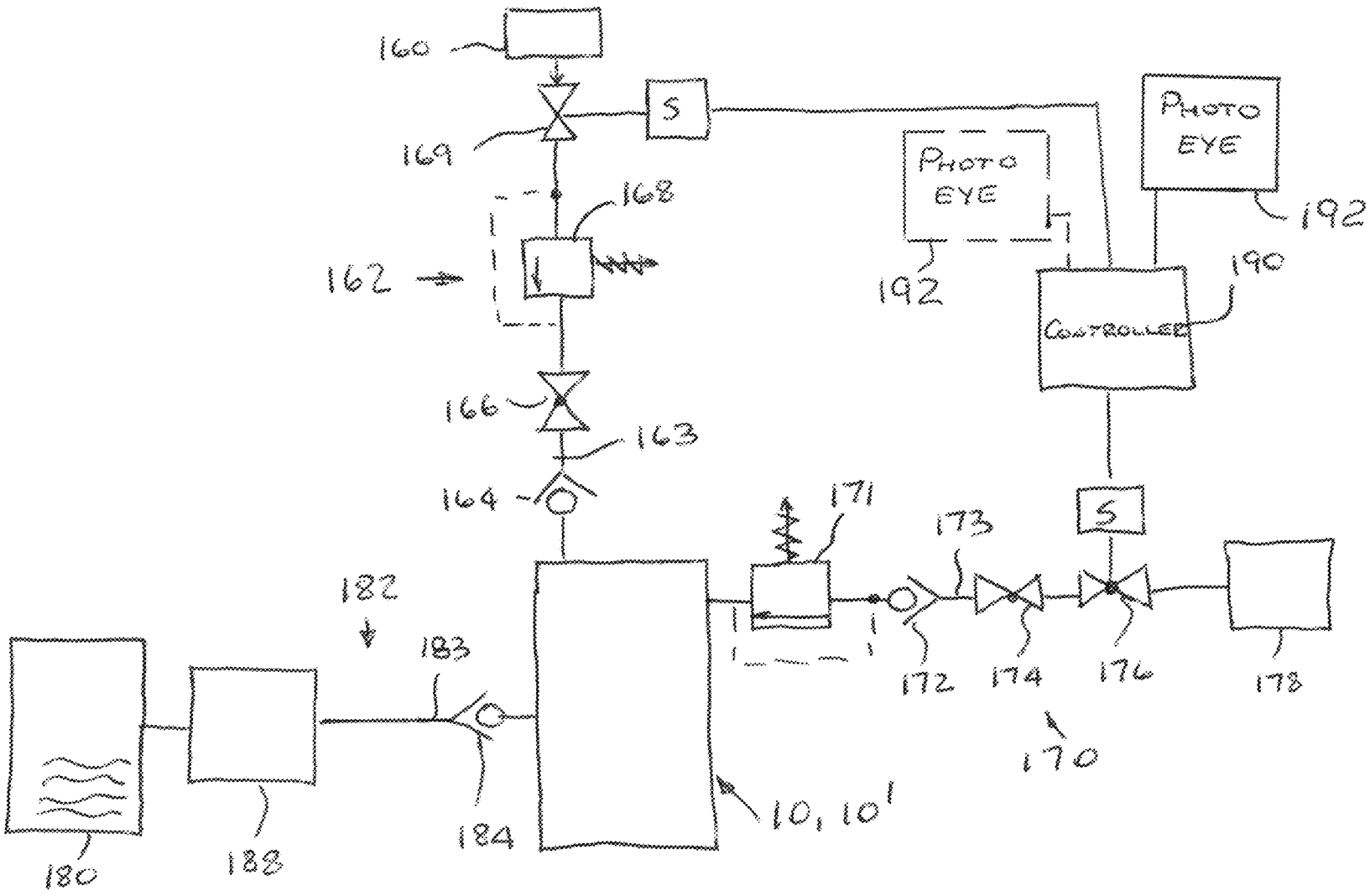
FIG. 20 illustrates an exemplary control block diagram of the apparatus of FIG. 1 or 10.

An exemplary embodiment of the control system of FIG. 20 comprises the water connection 162 that comprises a check valve 164 and a solenoid valve (not shown) being disposed in a series with each other within the water supply line 163. The above described manual control valve 166 and/or pressure regulator 168 can be provided as optional components. The air connection 170 comprises a check valve 172 and a solenoid valve 176 being mounted in a series with each other within the air line 173. The air pressure regulator 171 and/or manual control valve 174 can be provided as optional component(s). A pair of check valves 184, 186 can be disposed within the foam concentrate line 182 to the foam concentrate container 180, although a single check valve 184 or 186 is also contemplated herewithin. The water, air and foam concentrate lines can be constructed from conventional hoses or tubing, either rigid or flexible. A controller 190 can be also provided. The controller 190 can be a microprocessor, a PLC or any other controller that can be connected to various control valves and can execute a set of instructions or logic to selectively supply and discontinue water and air flows, as the flow of the foam concentrate is "pulled" by the pressure in the mixing chamber 70. However, when the pump 188 is provided in an absence of the mixing chamber 70, the controller 190 will control operation of the pump 188 to deliver foam concentrate to the apparatus 10, 10'. Since, the apparatus 10, 10' cycle ON and OFF during use, the controller 190 is programmed with a timer, that can be an adjustable timer, to control such cycling of the apparatus 10, 10'. The controller 190 can be also configured to blow-out or clean the connection 156 so as to prepare it for next cycle of foam production and dispersion. In other words, the controller 190 can execute computer instructions that would enable flow of the gas after the flow of liquid is terminated. The controller 190 can also executes computer instructions that would enable flow of the gas before the flow of liquid is started. In other words, the apparatus 10, 10' can be pre-purged and post-purged relative to dispersion of the mechanical foam 2.

When the mechanical foam inside the connection 156, such as a pipe or a hose, dissolves into liquid, a back pressure condition is created, affecting a subsequent cycle of the apparatus 10, 10', as newly generated mechanical foam is degraded by the remaining liquid.

FIG. 20 also illustrates an optional photo eye sensor 192. Such photo eye sensor 192 can trigger operation of the apparatus 10, 10' only when the photo eye sensor 192 has been crossed, i.e. the beam from the photo eye sensor 192 has been interrupted. This is especially advantageous in applications with an irregular traffic activity either of people of vehicles. More than one photo eye sensor 192 can be used with the same apparatus 10, 10' or with a plurality of apparatuses 10, 10'. In a non-limiting example, a pair of photo eye sensors 192 can be positioned, in a tandem arrangement, along a traffic path to discriminate between a person and a vehicle, where the controller 190 would be programmed or configured to measure a time elapsed between activation of each photo eye sensor 192, with the apparatus 10, 10' being activated only when the second photo eye sensor 192 is being crossed. In other words, the apparatus 10, 10' can be programmed to disperse one amount of mechanical foam due to a foot traffic versus a different amount of foam due to vehicle traffic.

Figure 21:
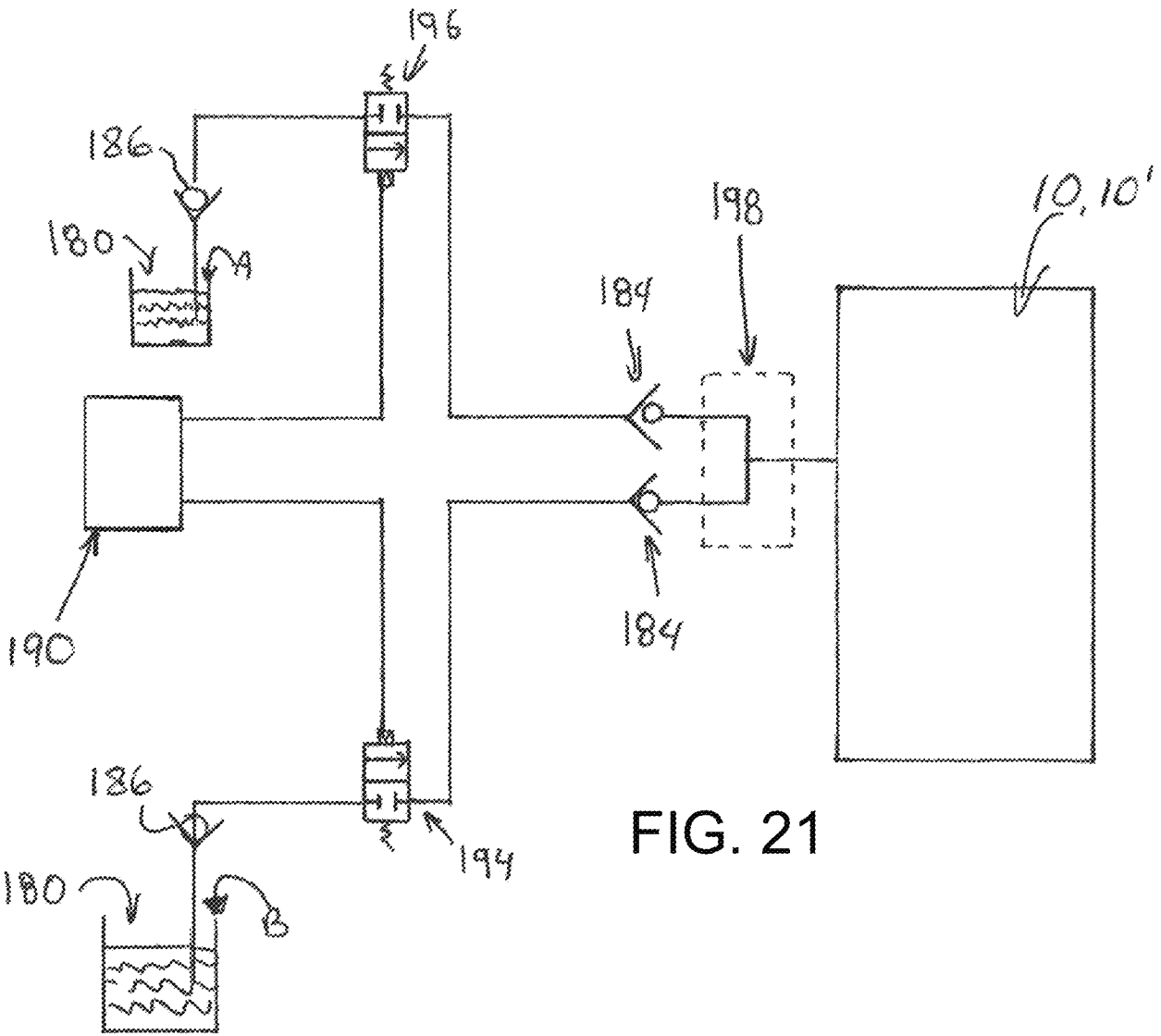
FIG. 21 illustrates an exemplary control block diagram of the apparatus of FIG. 1 or 10.

It is contemplated herein that the apparatus 10, 10' can be connected to more than one supply source 180 of the foam concentrate or other concentrate can be provided. In an exemplary embodiment of FIG. 21 (remaining components from FIGS. 19 and 20 being omitted for the sake of brevity and clarity), there could be provided the supply source 180 of the foam concentrate A and a supply source 180' of a substance B that could be used for a different function. For example, the substance B can be a rinse agent to be mixed with liquid, such as water, either before or after application of the mechanical foam. Or the substance B can be a different foam concentrate. Each source of supply 180, 180' is operatively connected to the apparatus 10, 10' either directly, or by way of an optional member 198. This optional member 198 can be any one of a shuttle valve, a manifold, a sequence valve, a mechanical selector valve, and a priority valve. The check valves 184 can be integrated into the manifold. FIG. 21 further illustrates a pair of solenoid valves 194 and 196 in an electrical connection with the controller 190. The check valves 184 can be also provided to prevent a back flow of either one of the foam concentrate A or the substance B. It will be understood, that in the example of FIG. 21, the controller 190 will be programmed to initiate a sequence of operation of the solenoid valves 194 and 196. Again, controller 190 can energize a coil of the solenoid A before or after energizing a coil of the solenoid valve 196. The controller 190 can be also programmed to clean the passageways within the apparatus 10, 10' by deenergizing each coil of the solenoid valves 194 and 196 and enabling liquid flow only. Or it may be sufficient to mix a small amount of the foam concentrate with the substance B remaining in the manifold 198 and the passageway 64 of the apparatus 10, 10' at a beginning of the cycle. It would be also understood that the manifold 198 can be configured for a connection to more than two sources of supply. Furthermore, in the exemplary embodiment of FIG. 20, the pair of solenoid valves 194, 196 can be replaced with a single 3-way solenoid valve eliminating a need for the manifold 198 and even one check valve 184.

It is further contemplated herein that the control arrangement of FIG. 21 for two or more different supply source of the foam concentrate or another substance can be applied for two or more supply sources 160 of liquid flow and even two or more supply sources 178 of gas flow. In an example, one supply source 160 can be used for water and another supply source 160 can be used for an aqueous solution.

The programmable controller 190 can be replaced with a circuit comprising conventional timer(s) and even relay(s) to essentially provide a relay logic control solution. If the photo eye sensor 192 is used, one or first timer can provide an elapsed time before another or a second timer could pre-blow out a line, and a third timer could energize a solenoid for air and water for a duration of time, and then the first timer would prevent the operation of the apparatus 10, 10' until a set time had elapsed, regardless of how many times the photo eye sensor 192 was crossed. It is to be understood that in this example, the timer functions as a control member or a controller.

Figure 22:
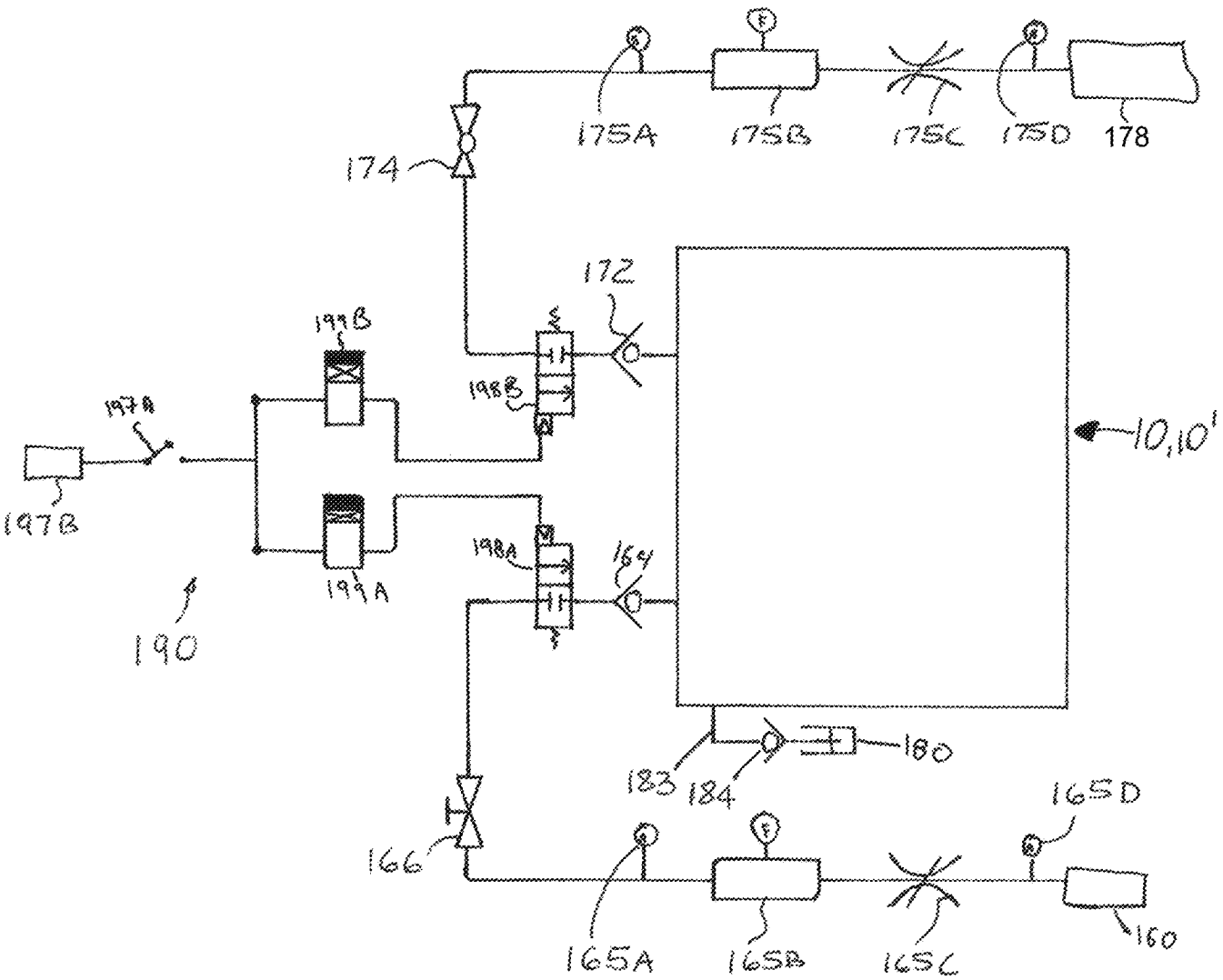
FIG. 22 illustrates an exemplary control block diagram of the apparatus of FIG. 1 or 10.

FIG. 22 illustrates a controller or a control circuit 190 that comprises a solenoid 198A and a timer 199A for supply of water (liquid) from the supply source 160 and a solenoid 198B and a timer 199B for supply of air (gas) from the air supply source 178. The timers 199A,B can be of H3DT-F model manufactured by Omron Corporation of Kyoto, Japan. The timers 199A,B and the solenoids 198A,B are also shown as being electrically coupled to a source of power 197B through a ON/OFF switch 197A, that can be a manually operated switch. The timers 199A,B are shown as ON/OFF timers but either ON timers or OFF timers are also contemplated herein. The ON/OFF timers enable both the pre-purging and post-purging of the connection 156 or the like.

FIG. 22 also illustrates that the liquid connection from the supply source 160 may comprise any one of an optional pressure gage 165A, an optional flow gage 165B, an optional variable orifice (regulator) 165C and an optional pressure gage 165D. Likewise the gas connection from the source 178 may comprise any one of an optional pressure gage 175A, an optional flow gage 175B, an optional variable orifice (regulator) 175C and an optional pressure gage 175D.

It is to be understood that FIGS. 19-22 provide a system that produces and disperses mechanical foam or, in other words, mixes two or more substances together and dispersed the resulting mixture. Such system comprises the above described apparatus 10, 10', one or more valve and one or more control member.

It is within the scope of this document that it is not necessary that the water flow member 42, the foam concentrate flow member 60 and the air flow members 90 are provided within the same housing 20, either of a one-piece or a two-piece construction. It is contemplated that each of the water flow member 42, the foam concentrate flow member 60 and the air flow members 90 can be provided within individual housings or two members may be combined within one housing. In a non-limiting example of FIG. 23, the water flow member 42 and the foam concentrate flow member 60 are being be combined within one housing 20D and operatively connected with the air flow member 90 within a separate housing 20E by way of a connection member 222. It would be understood that the housings 20D and 20E are illustrated as essentially being disposed in a generally in-line arrangement with each other. Such generally in-line arrangement can be advantageous for using apparatus 10, 10' in a fire-fighting applications, for example mounting the apparatus 10, 10' inside the nozzle device 220. It would be understood, that the water and foam concentrate can be (remotely) premixed and supplied for further mixing with air.

One of the advantages of the apparatus 10, 10' used in a held-held application is that the foam can be generated at a handle/sprayer. This obviates a problem with conventional hand-held devices where all of the liquid goes to the floor each time the operator starts up again until foam is present again. Thus, operators frequently stop and start the operation.

Figure 23:
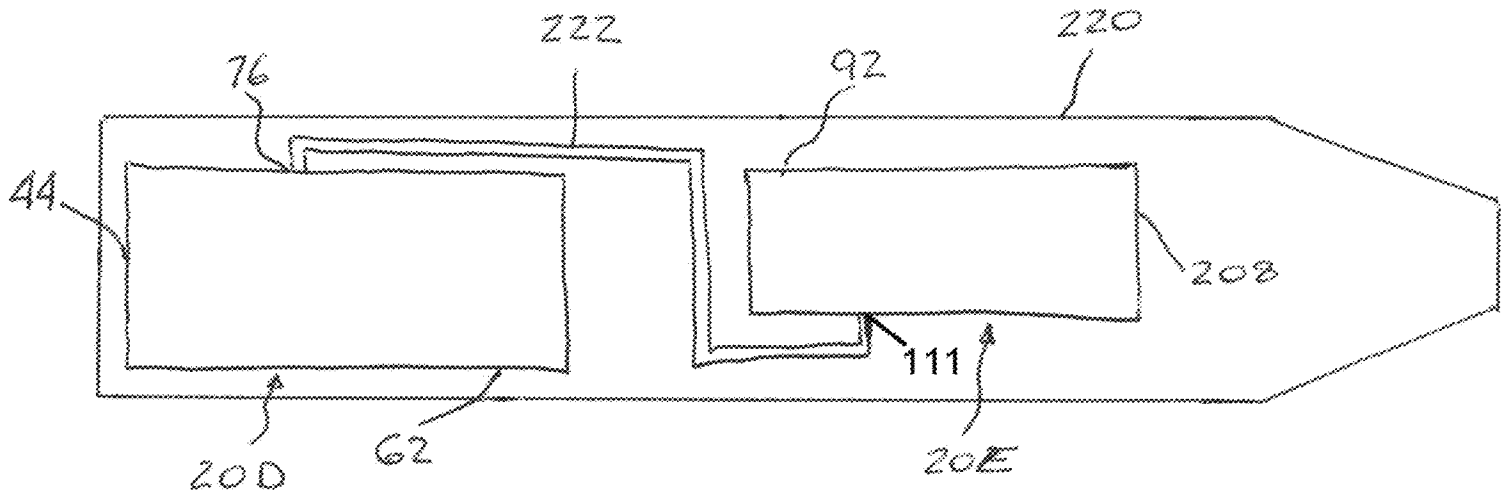
FIG. 23 illustrates a diagrammatic view of an exemplary embodiment of the apparatus of FIG. 1 or 10 that comprises two separate housings.

It is further contemplated in the embodiment of FIG. 23 that the housing 20D and its associated internal components can be eliminated in their entirety with a premixed solution of foam concentrate and water delivered directly for mixing with air in housing 20E. The housing 20E can be adapted with a control valve 50 or similar to balance the relationship between the premixed solution and the compressed air jet for a desired result.

Figure 25:
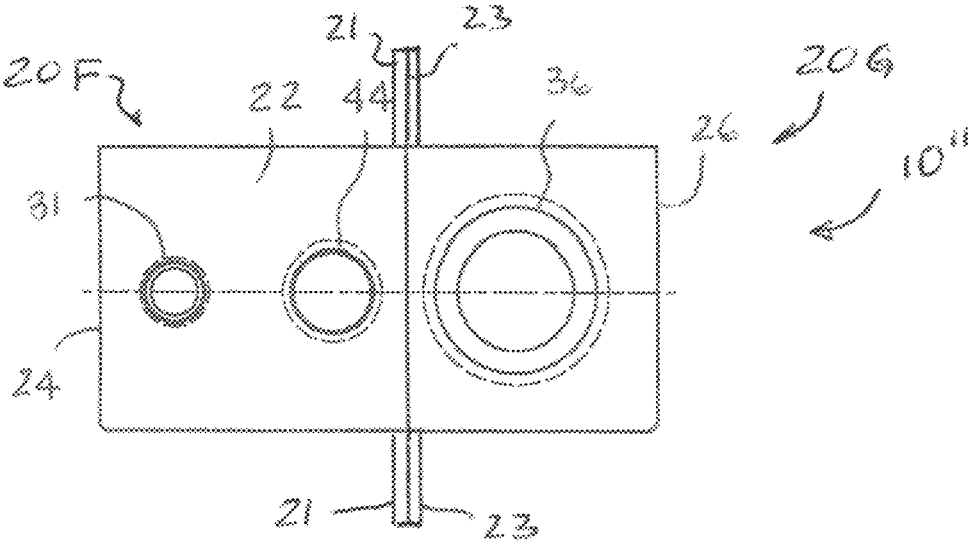
FIG. 25 illustrates a top view of the apparatus of FIG. 24.
Figure 24:
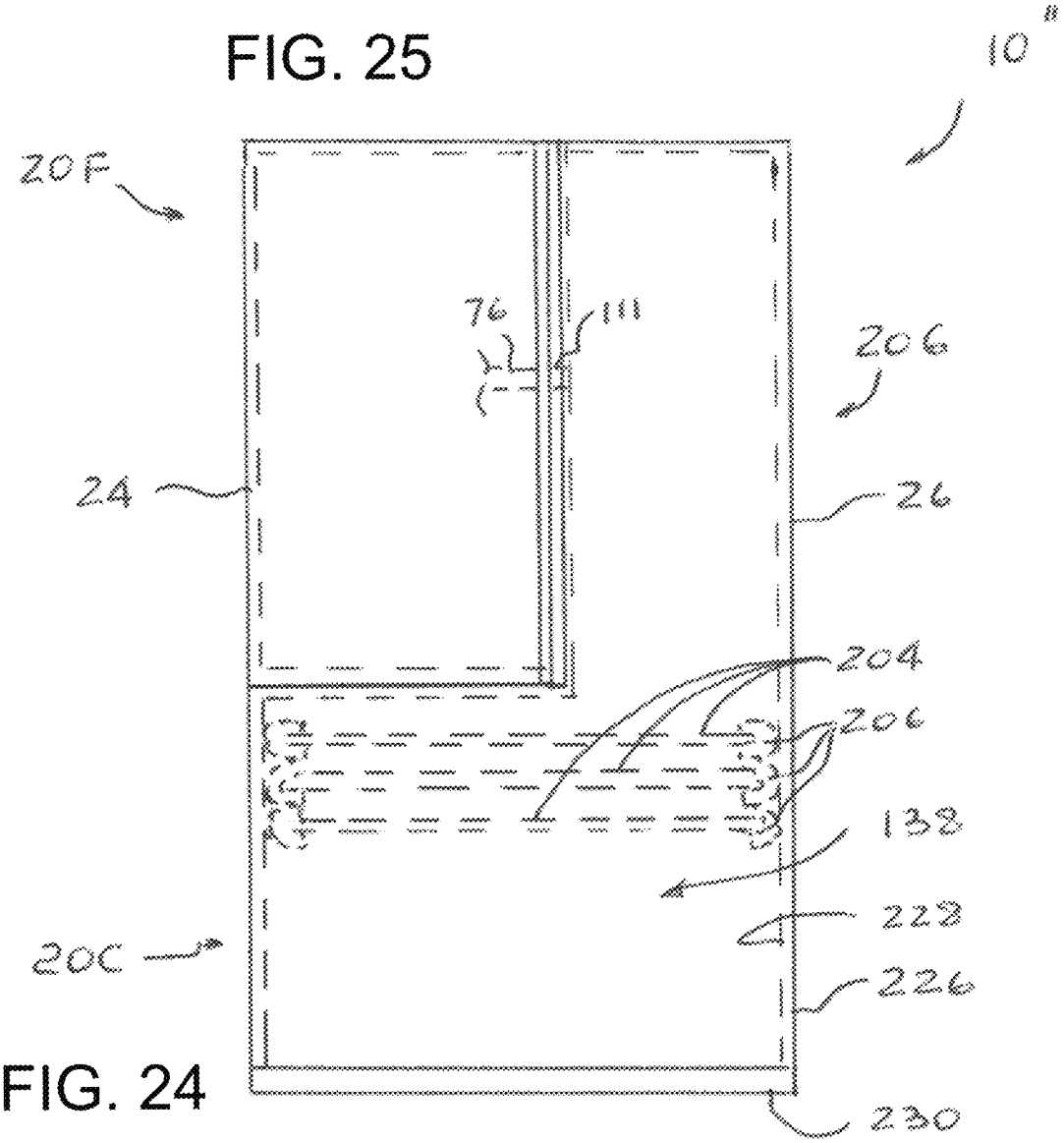
FIG. 24 illustrates an elevation view of view an exemplary apparatus that produces and dispenses foam.

FIGS. 24 and 25 illustrate an exemplary embodiment of a two-piece housing that can be used within the apparatus 10, 10', referenced with a numeral 10". More specifically, FIGS. 24 and 25 illustrate that the water (liquid) flow member 42 and the foam concentrate flow member 60 are disposed within the first housing 20F and the air (gas) flow members 90 and the screen member 130 are disposed within the second housing 20G. The first housing 20F and the second housing 20G are secured or connected therebetween by way of flanges 21 and 23. In an example, fasteners (not shown) can be used to secure or connect flanges 21 and 23. In an example, clamps (not shown) can be used to secure or connect flanges 21 and 23. In an example, one flange, for example such as a flange 21 can be configured as a flexible and a resilient member to receive flange 23 therewithin. The second housing 20G in this embodiment will be adapted with an inlet 111 into the mixing chamber 110, where the inlet 111 will be aligned with the outlet from the passageway 76 during assembly and a subsequent use. In this embodiment, the inlet 111 is in a direct communication with the outlet from the passageway 76. In other words, the mixture of liquid and foam concentrates flows directly into the mixing chamber 110. The second housing 20G is also illustrated in FIG. 24 as comprising a lower portion 20C. The lower portion 20C can be considered as a screen cartridge for an apparatus that mixes two or more substances together. The exemplary screen cartridge comprising a cartridge housing comprising an end wall 230 and a peripheral side wall 226 upstanding on the end wall 230 to define a hollow interior 138 and an opening opposite the end wall 230, the cartridge housing connectable to a housing of the apparatus. The above described port 208 can be provided through the end wall 230 of the cartridge housing. FIG. 24 also illustrates perforated members 204 disposed within the hollow interior 138 during use of the screen cartridge. Flexible members 206 are also provided, with each flexible member 206 from the flexible members configured to couple at interior thereof to a peripheral edge of a respective perforated member 204 and deform at an exterior thereof when positioned within the hollow interior 138 in a contact with an interior surface 228 of the peripheral side wall 226. The flexible members 206 being further sized to space a pair of perforated members 204 at a distance from each other, the distance sufficient to stabilize bubbles generated during mixture of the two or more substances together. The flexible member 206 can comprise a silicone or other resiliently compressible material and can have a generally U-shaped cross-section. It is not necessary for the flexible member 206 to span the entire peripheral edge of the perforated member 204 and the flexible member 206 can be provided as a plurality of flexible members 206 along the peripheral edge of the perforated member 204. Flexible members 206 can be provided only at opposite edges of the perforated member 204.

It is also contemplated herein that the end wall 230 can be omitted when the apparatus 10" when such apparatus is to be directly mounted to a vessel, for example such as a drum.

Figure 26:
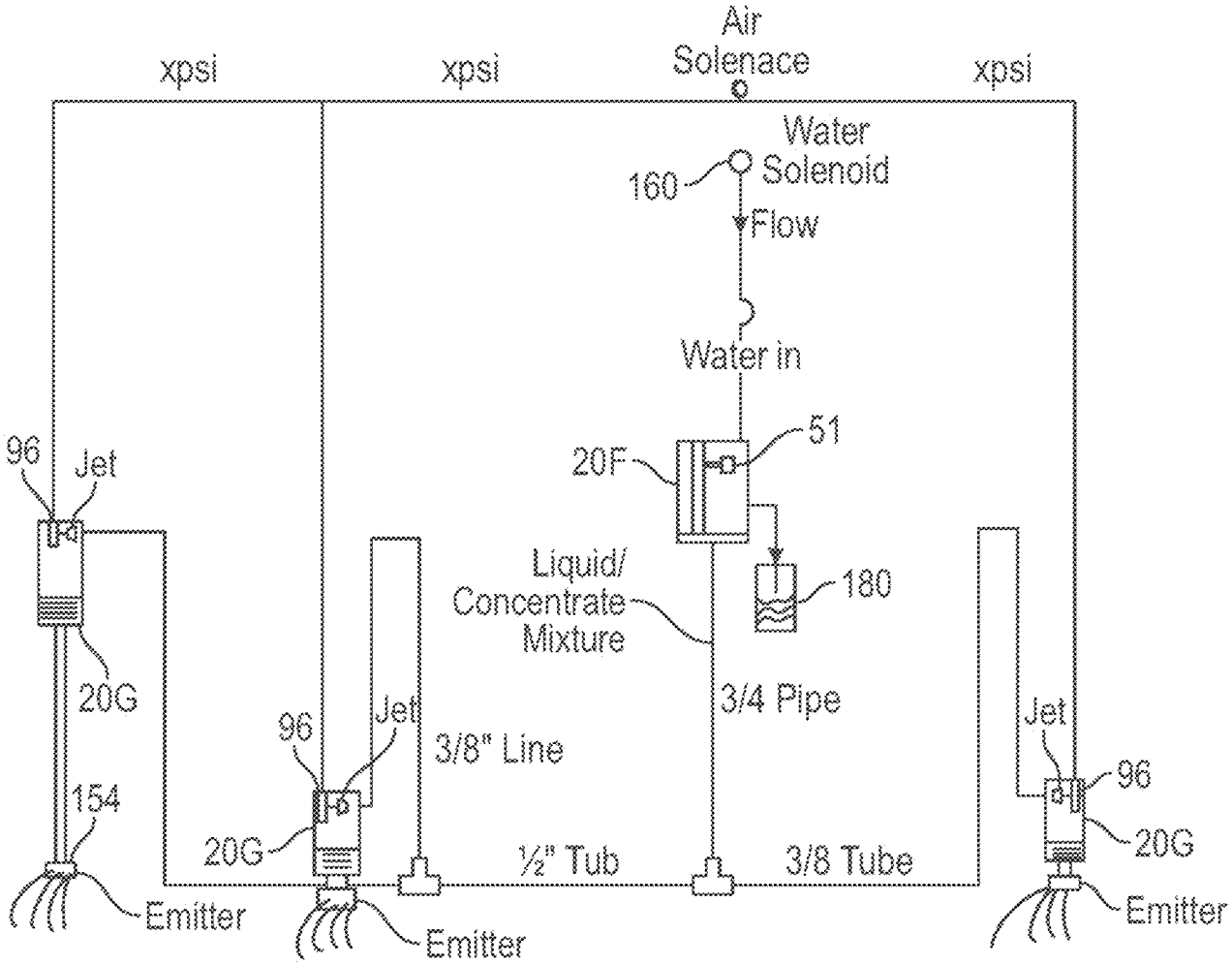
FIG. 26 illustrates a diagrammatic view of an exemplary apparatus that mixes liquid and foam concentrate in one housing and mixes the mixture of liquid and foam concentrate with air in one or more separate housing to produce and dispenses foam.

FIG. 26 illustrates an exemplary embodiment of the apparatus 10, 10' that separates mixing of liquid and foam concentrate from producing and dispersing foam. More specifically, FIG. 26 illustrates a housing, for example such as the above described housing 26F that contains liquid flow member and foam concentrate flow member as well as the mixing chamber 70 with the liquid jet 51. The liquid/concentrate mixture is communicated to one or more spate housings, for example such as the housing second 20G that includes gas flow control member 96 and the screen member 130 or 200. The second housing 20G is in a connection with a foam emitter, for example such as above described nozzle 154. Thus, the liquid and concentrate can be mixed in one location with the foam produced and dispersed in one or more different locations through a network of pipes or hoses.

It is to be understood that the apparatus of FIG. 26 is configured for dispersing foam in locations remote from a location that mixes liquid with concentrate.

Figure 27:
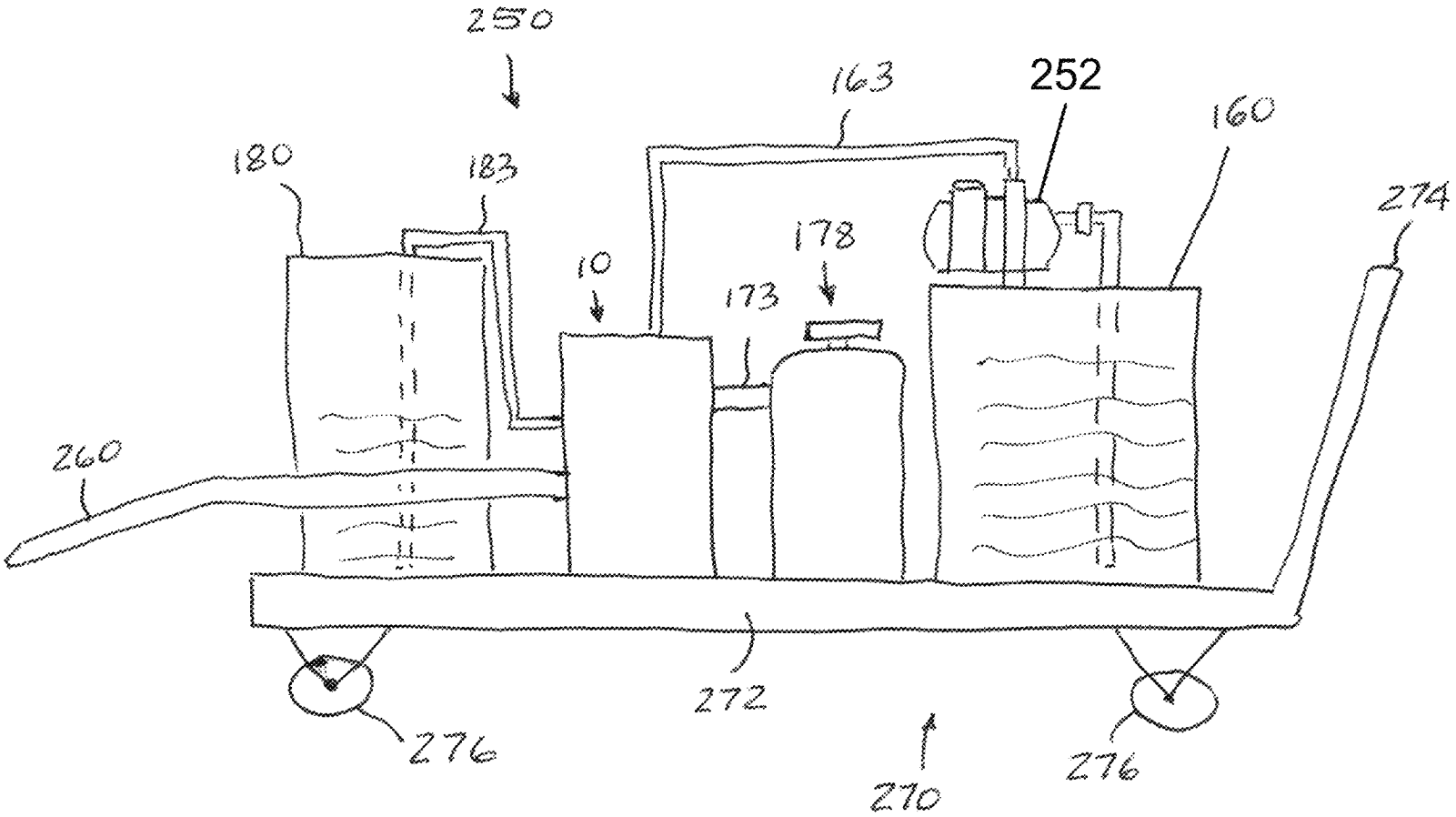
FIG. 27 illustrates a diagrammatic view of an exemplary embodiment of a mobile assembly that utilizes the apparatus of FIG. 1 or FIG. 10.

It is within the scope of this document the apparatus 10, 10' can be integrated into a mobile application, for example such as being mounted on a mobile cart. Now in a reference to FIG. 27, there in is illustrated an exemplary mobile assembly or system 250 that can produce and dispense sanitizing or disinfecting foam. The mobile assembly 250 comprises a mobile cart 270. The mobile cart 270 would at least comprise a base 272 and wheels 276 attached to the base. A handle 274 can be also provided. The apparatus 10 is also mounted on the base 272 and is coupled to a foam dispersing member 260 that can comprise a nozzle. The source of liquid flow is a tank 160 coupled to the apparatus 10 with a hose 163 through a liquid pump 252 to supply liquid flow under pressure. The foam concentrate supply source 180, for example such as another tank is coupled to the apparatus 10 with a hose member 183. A gas flow source 178 can comprise a pressure container connected to the gas flow inlet 92 with the hose 173. The various valves, controls and mounting brackets/components are being omitted in the FIG. 27 for the sake of brevity. Also, FIG. 27 illustrates a serial configuration of all supply sources in a relationship to the apparatus 10, 10', other configurations are also contemplated in this document. In a non-limiting example, the foam dispersing member 260 cam be mounted in front of or behind the tank 160 when viewed in FIG. 27.

In an example, the apparatus 10, 10' can be used within the mobile foam producing unit as disclosed in U.S. Pat. No. 7,516,907 issued to Slone et al. on Apr. 14, 2009 and whose teachings are incorporated in its entirety by reference. Again, the portion of the apparatus 10, 10' directed to forming water/foam concentrate mixture can be separated from the air induction and the screen portion.

Thus, the above described apparatus can improve mobile foam producing and dispersing devices currently in use.

Figure 28:
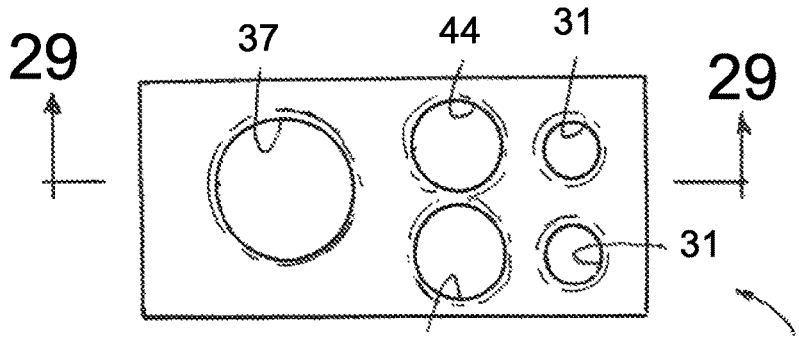
FIG. 28 illustrates a top view of an exemplary apparatus that produces and dispenses foam.
Figure 30:
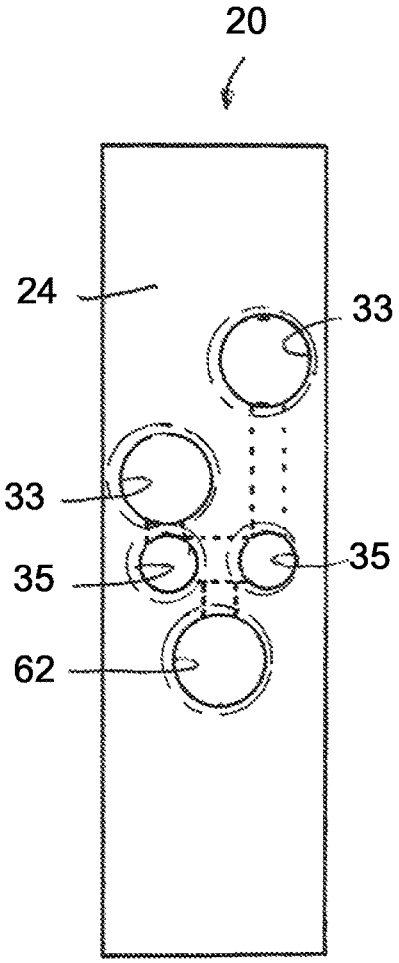
FIG. 30 illustrates a side elevation view of the apparatus of FIG. 28.
Figure 29:
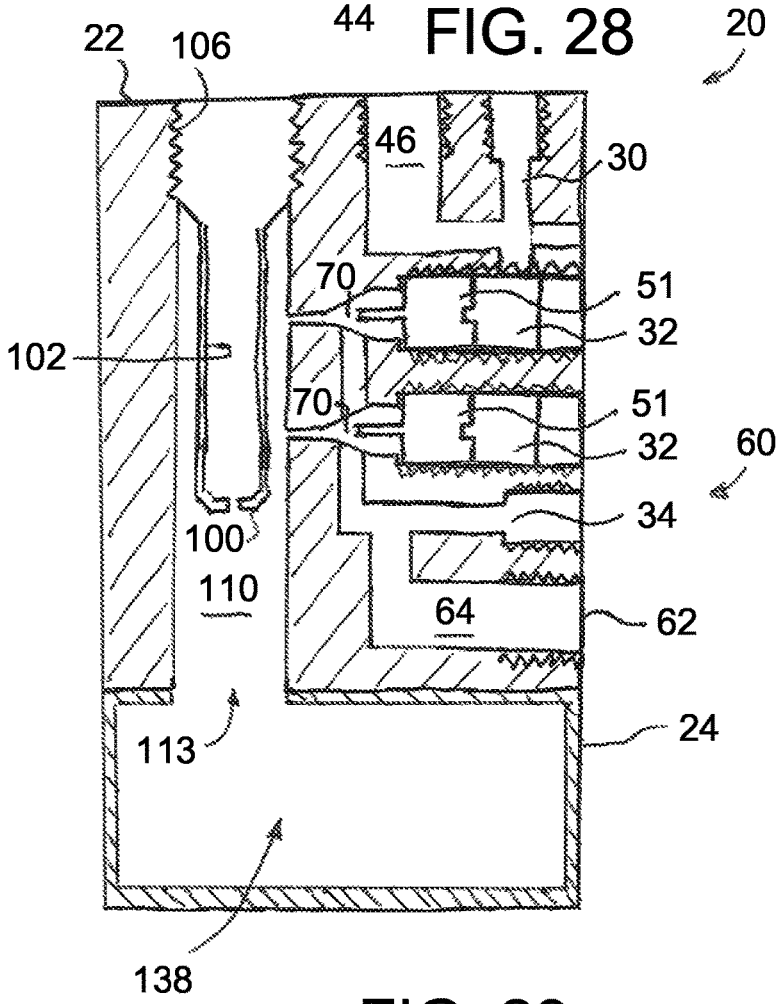
FIG. 29 illustrates a cross-sectional view along lines 29-29 of the apparatus of FIG. 28.

FIGS. 28-30 illustrate an exemplary embodiment of a dual use apparatus that can operate on two separate liquids and a single concentrate, or a same liquid, whose pressure and/or flow rate being tuned to different concentrates. FIG. 30 also illustrates that it is not necessary to align ports 33 with the port 62 and/or the gas flow jet 96.

It will be understood that by employing removable components, the apparatus is easily cleaned and serviced, particularly when a blockage occurs within port(s) and/or passageway(s) due to contaminants in any one of the liquid flow, concentrate flow and gas flow. Little to no chemical is exposed to the operator when the needle is removed, and any chemical that exits the port, however little, would likely push, or carry out any foreign debris.

Utilizing the needle valve for adjusting liquid and/or concentrate flow, there is surface area all around the needle where by the intent there is a space between the surface of the water jet and the body of the water jet is narrower than the jet, preventing a partial blockage from fully disrupting flow. When used, needle valves eliminate a need for interchangeable orifices that require more than desired effort to clean when blockage occurs or event to change for use with different concentrate or pressures.

The type of testing and requirements for dispersed mechanical foam depends on application. Sanitizing or disinfecting foam generator(s) or foam generating device(s) have been generally used in food, pharmaceutical and health care industries to maintain a controlled environment with minimal introduction of outside biological contaminants. A common application is to place sanitizing or disinfecting foam generator(s) or foam generating device(s) at the entry points of controlled areas to sanitize vehicle wheels and human footwear. In floor sanitizing or disinfecting applications, it may be desirable for a density of the mechanical foam 2 to be of a shaving cream consistency/viscosity, essentially being a clinging type foam that adheres to a shoe sole or tire thread, and maintain this density for a longer period of time before being transformed (dissolved) into liquid state. It is further desired to maintain such dispersed foam at a height that is sufficient to accommodate either a foot traffic or a vehicle traffic, while minimizing foam concentrate usage.

Testing indicated that desirable height, density and longevity of the mechanical foam produced and dispersed by the apparatus 10, 10' for surface sanitizing application has been achieved with a usage of concentrate in a range of between 10,000 particle of concentrate per million of particles of water (ppm) (or 1% by volume) and 19,000 ppm (or 1.9% by volume), with optimum foam height, density and longevity being achieved with a usage of concentrate in a range of between 16,000 ppm (or 1.6% by volume) and 19,000 ppm (or 1.9% by volume) and in the range of between 12,000 ppm (or 1.2% by volume) and 18,000 ppm (or 1.8% by volume). At about 16,000 ppm (or 1.6% by volume), the mechanical foam maintained its height and density for about 100 minutes.

Adequate height, density and longevity of the mechanical foam produced and dispersed by the apparatus 10, 10' has been also achieved with a usage of concentrate in a range of between 19,000 ppm (or 1.9% by volume) and 28,000 ppm (or 2.8% by volume) and between 3,900 ppm (or 0.39% by volume) and 10,000 ppm (or 1.0% by volume), more particularly in the range between 7,000 ppm (or 0.7% by volume) and 10,000 ppm (or 1.0% by volume). It must be noted that Food and Drug Administration (FDA) requires a minimum concertation of 3,900 ppm (or 0.39% by volume) for food surfaces. It has been found that when concentration is below 3,900 ppm (or 0.39 by volume) or above 28,000 ppm (or 2.8% by volume), the longevity of the mechanical foam reduced in time, necessitating more frequent dispersion of the foam but providing a sufficient disinfecting action. Foam concentrate usage above 28,000 ppm (or 2.8% by volume) can be still adequate in some applications, where the cost of foam concentrate is not a prevailing factor. Foam concentrate can be also used at a concertation of about 2,500 ppm (or about 0.25% by volume) or greater in accordance with FDA requirements for different applications.

In some embodiments, a combination of water pressure between 50 psi and 60 psi and the air pressure between 40 psi and 60 psi, a 0.12 inch diameter air jet port, and a 0.12 inch diameter water jet, increased foam longevity and achieved foam heights of between 2.65 inches and 2.75 inches, exceeding conventional foam heights.

In an embodiment, a combination of about 50 psi water pressure, about 60 psi air pressure, a 0.12 inch diameter air jet port, a 0.12 inch diameter water jet and a foam flow of about 1.0 gallon s per minute (GPM) produced "stickiest" or "clingiest" foam for a vertical wall application using about 12,000 ppm (about 1.2% by volume) foam concentrate, that can be for example such as Octave, concentrate. In this example, the foam remained adhered to the wall In an embodiment, a combination of about 40 psi water pressure, about 60 psi air pressure, a 0.12 inch diameter air jet port, a 0.12 inch diameter water, and a foam flow of about 1.0 gpm and jet produced "stickiest" or "clingiest" foam for a horizontal floor application using about 4,000 ppm (about 0.4% by volume) foam concentrate, that can be for example such as Octave concentrate.

As it has been described above, mechanical foam for sanitizing or disinfecting application is produced or generated by mixing a foaming sanitizing or disinfecting chemical concentrate with air and water. For optimal performance in sanitizing applications, the mechanical foam should be of a high density and a high build. In other words, the mechanical foam should have an ability to stand high for a desired amount of time without collapsing under its own weight. The foam should be also "clingy". In other words, foam bubble should not collapse and should remain on a shoe sole or tire thread after the initial contact.

A related attribute is foam longevity. The longer a desired period of time the mechanical foam survives before it transforms into liquid, the less frequently it needs to be replaced. This, of course, would result in lower foam concentrate usage, lower utility costs and lower recycling and/or waste related costs.

The monodispersed or uniform structure of the mechanical foam 2 produced by the apparatus 10, 10' essentially comprises a network of interconnected filmed gases or bubbles of substantially the same mass that have been achieved through essentially two-step process. The first step is a cavitation process, by injecting compressed gas, such as air, into a mixing chamber 110 that uses a venturi to draw in a water and chemical solution that is mixed in the mixing chamber 70 prior to entering into the cavitation chamber. The second step is tumbling and regenerating a mixture of air, water and foam concentrate through consistent sized screen members 130, 200. In this two-step process, a strength in the bubbles is developed through a process that is generally known as "lamellae". Lamellae is a Latin word for flake or plate, and is where English gets its word for laminate. The Lamellae of the bubbles increases the strength of the bubble (or stability of a bubble), particularly as a mechanical foam, because when equal sized bubble are suspended together (particularly on a 120 degree axis) the foam creates a natural laminate structure due to the surface chemistry of the colloid mixture infused with gas in a uniform foam generation. This lamellae result from the foam generator is a form of Coalescence that is a strengthening state (which we will call lamellae coalescence) and not a disintegration state, or merging (or merging coalescence). What is meant by a disintegration state, or merging coalescence, is the natural process whereby the adjoining bubbles suspended in a foam break down. During the break down, bubbles will coalesce over time whereby some bubbles will "pop" and some will merge creating a larger bubble with combined trapped gas. This disintegration state is a form of polydispersement, which can be explained as [a colloid dispersed] gas is present, so it divides into gas bubbles of different sizes separated by liquid regions that may form films, [those films become] thinner and thinner when the liquid phase drains out of the system films.

In other words, it can be said that an organized, uniform, monodisperse, lamellae, foam will eventually dispense by coalescence [merging] into larger lamellae until the individual bubbles lose their lamellae and become a polydisperse of unequal size, whereby the liquid falls out of the film of the bubbles, collectively, until the foam is in a liquid state and no longer functional as a foam.

Ultimately, foam production is the process of nucleating bubbles with a colloid solution and gas with a stable film. When the film loses stability, due to liquid removal, the surface tension decreases. When the surface tension (1) decreases or (2) cannot sustain the pressure differential or (3) there is a state of pulsation, or (4) a foreign substance such as dirt or fat come in contact with the bubble, the bubble will rupture (due to entropy via the adiabatic process) or the bubble will coalesce to a larger bubble due to the merging process, until entropy takes place, whereby work is performed inside of the bubble whereby the bubble's surface cannot support the work and the bubble "pops".

It is believed herein that the apparatus 10, 10' initially produces a monodispersed bubbles that after a time period in the emitted environment coalesce by converting into a polydispersed state until the entropy process has run its course and no foam, or bubbles, remain.

It has been found that pressure differential can be a key feature in forming, producing or generating the desired mechanical foam. While conventional foam generating devices can operate with air pressure at low PSI but high cubic feet per minute (CFM), the above described apparatus 10, 10' can operate with air pressure at high PSI and low CFM. Air pressure and CFM are two very different factors within the same world. While both are measurements, the energy spent to produce air pressure is measured in an energy-to-CFM ratio. Pressure does not affect energy usage directly, CFM is how much volume of compressed air released, which relates to how much energy will need to be used to reproduce the air lost. So with a low PSI with a high CFM, conventional foam generating devices use more energy.

Accordingly, the above described apparatus 10, 10' is advantageous in using less water and foam concentrate chemicals to generate the required mechanical foam consistency as compared with conventional devices. Thus, the advantage of the apparatus 10, 10' is in reduced waste water treatment (due to lower foam concentrate and water usage requirements) and lower operating costs.

In an embodiment, the apparatus 10, 10' is not limited to sanitizing or disinfecting application and can be used in fire-fighting application, car washes and the like applications requiring mechanical foam or foam-like substance generation and dispersion.

In an embodiment, a size compactness of the apparatus 10, 10' is well suited for providing the apparatus 10, 10' as a hand-held device or even integrating it into a nozzle of a fire-fighting equipment.

In an embodiment, the apparatus 10, 10' can be adapted for non-foam generation and dispersion. In an exemplary embodiment, the apparatus 10, 10' can be adapted for use in a food application.

In this embodiment, the foam concentrate can be replaced with a fructose or a corn syrup substance that is to be mixed with water for a purpose of glazing or coating a food product, for example such as a doughnut. Or foam concentrate can be replaced with a mono sodium gluconate (MSG). In this embodiment, the gas flow control member may not be required.

In an embodiment, the apparatus 10, 10' that produces and dispenses mechanical foam can be used to syphon or gravity fed. When the apparatus is in a gravity fed configuration, a solenoid valve can be used. It is not necessary to position the apparatus 10, 10' above the container 180 with the foam concentrate in a vertical direction. In other words, the apparatus 10, 10' can be positioned below the container 180 with the foam concentrate in the vertical direction. Any additional pressure of the foam concentrate can be advantageously accommodated by an adjustment of the internally mounted foam concentrate control valve 63.

In an embodiment, the apparatus that produces and dispenses mechanical foam can be used with a supplied premix that enters one of the water inlet 44 and foam concentrate port 63, with the other one from the water inlet 44 and foam concentrate port 63 being closed or eliminated in its entirety.

In an embodiment, the apparatus 10, 10' that produces and dispenses mechanical foam runs best on a less dense viscosity (closer to water less like syrup). In a non-limiting example, a sanitizer chemical was diluted 50/50, water/chemical, with better results with less chemical. The sanitizer chemical can be an acid sanitizer/disinfectant.

In an embodiment, the apparatus that produces and dispenses mechanical foam can be used as a mix chamber for other applications.

In an embodiment, a pump can be used instead of syphon or gravity. In a non-limiting example, the pump can include a diaphragm pump.

In an embodiment, the apparatus can be constructed from several materials, such as stainless steel, plastic or other, as well as a combination of different materials. In a non-limiting example, metallic (steel) inserts can be integrated into a plastic housing during a molding process to increase a life of later machined threads for receiving needle valve and/or pressure reducing members.

In an embodiment, the above described housing 20, 20' with all passages, chambers and cavities can be manufactured by a 3D printing method.

In an embodiment, the above described housing 20, 20' with all passages, chambers and cavities can be manufactured from a polymer material by a molding process.

In an embodiment, the above described housing 20, 20' with all passages, chambers and cavities can be manufactured from a metallic material, for example such as a stainless steel, by a casting process.

In an embodiment, a chemical concentrate can be delivered under pressure, for example from a pressurized tank (container) instead of a reliance on a gravity or a syphon type action. A pressure regulator as well as valves can be used in this embodiment. Delivery of chemical concentrate under pressure eliminates a need for a venturi.

In an embodiment, the apparatus 10, 10' that produces and dispenses mechanical foam improves generation and retention of the foam mixture that reduces cost and improves quality of cleaning efforts as well as reduces waste water treatment costs. Generated foam holds for a longer period of time before conversion into liquid.

In an embodiment, the apparatus 10, 10' that produces and dispenses mechanical foam can be employed in Food and Beverage Plants where sanitizing chemicals are used.

In an embodiment, the apparatus 10, 10' that produces and dispenses mechanical foam can be employed in car washes or other applications where soapy foam is needed.

In an embodiment, the apparatus 10, 10' that produces and dispenses mechanical foam reduces the amount the CFM of air used reducing the energy needed to run an air compressor.

In an embodiment, the apparatus 10, 10' that produces and dispenses mechanical foam reduces water usage to generate required amount and consistency of foam mixture.

In an embodiment, the apparatus 10, 10' that produces and dispenses mechanical foam can be used with chemical containers and premixed chemical systems.

In an embodiment, the apparatus 10, 10' can be used as a degreaser with hot/cold water with the two solenoid-controlled concentrates. The method would comprise, degreasing, then sanitizing with foam or soap and then rinsing with water only where both air and concentrate inlets are closed by their solenoids.

In an embodiment, the apparatus 10, 10' can be used in a paint application that requires a hardener, or an epoxy coating that needs a hardener which is usually pretty viscous.

In an embodiment, the apparatus 10, 10' can be used in a construction product, for example such as a spray foam, where a part A and part B are under pressure and the two are combined together and the foam is broadcast onto a wall. In a non-limiting example, the foam adheres to the wall and then expands due to a chemical reaction. This method can be used to replace insulation in walls, attics, and crawl spaces under homes. Furthermore, a pump can be used to force part A into the apparatus 10, 10' that would draw part B with air being added to broadcast the foam, thus providing a new delivery method which would not require use of existing pressure vessels and utilize common air compressors or other conventional supply sources of air.

In an embodiment, a method for a foam disinfection of a surface using a foam producing and dispensing apparatus comprises mixing water under pressure with a disinfectant in a first chamber, mixing a mixture of water and disinfectant with air under pressure in a second chamber, passing the mixture of water, disinfectant and air through a stack of screen members, and dispersing the foam onto the surface.

In an embodiment, a method of producing and dispensing a mechanical foam comprises drawing, with a flow of water under pressure, a foam disinfectant into a first mixing chamber, mixing the water and foam disinfectant in the first mixing chamber, drawing, with a flow of air under pressure, a mixture of the water and foam disinfectant into a second mixing chamber, mixing the air with the mixture of water and foam disinfectant in the second chamber, passing a mixture of air, water and foam disinfectant through a stack of screen members in a third chamber, all screen members having an identical size and arrangement of openings, and dispensing said mechanical foam through a port in said third chamber.

In an embodiment, an apparatus that produces and dispenses mechanical foam comprises a housing; a water flow member comprising: a water flow inlet port in an exterior surface of the housing, the water flow inlet port in a fluid communication with a supply source of water flow under a first pressure, a water passageway, the water passageway defining a water flow outlet port, a water flow control member in a water communication with the water passageway, the water flow control member controlling a rate of flow of water from the water flow inlet port through the water passageway, and a water flow jet comprising one end thereof disposed adjacent the water flow outlet port, a first aperture disposed through the water flow jet in a water flow communication with the water flow outlet port and in a direction of water flow, the first aperture having a cross-sectional area thereof being smaller than a cross-sectional area of the water flow outlet port, the water flow jet is configured to generate a water flow under a second pressure, the second pressure being less than the first pressure; a foam concentrate flow member comprising: a foam concentrate inlet port in the exterior surface of the housing, the foam concentrate inlet port in an operative communication with a supply source of a foam concentrate flow, a foam concentrate passageway in a communication with the foam concentrate inlet port, the foam concentrate passageway defining a foam concentrate outlet port, and a foam concentrate flow control member in an operative communication with the foam concentrate passageway, the foam concentrate flow control member controlling a rate of flow of the foam concentrate from the foam concentrate inlet port through the foam concentrate passageway; a first mixing chamber receiving a smaller end of the water flow jet and being in a communication with the foam concentrate outlet port, the first mixing chamber comprising a frustoconical shape, the first mixing chamber configured to receive the water flow through the axial aperture in the water flow jet and the foam concentrate flow through the foam concentrate outlet port, the second pressure being sufficient to generate a suction of the foam concentrate flow into the first mixing chamber and further generate a homogeneous water and foam concentrate mixture; an air flow member comprising: an air inlet port in the exterior surface of the housing, the air inlet port in an operative communication with a supply source of air flow under a third pressure, an air flow passageway in a communication with the air inlet port and in a direct communication with the first mixing chamber, and an air flow jet disposed in the air flow passageway, the air flow jet comprising: one end thereof positioned adjacent the air inlet port, an opposite second end, a second aperture disposed though the air flow jet in a direction of air flow, the second aperture in an air flow communication with the air inlet port, and a cross-sectional area of the air flow jet being smaller than a cross-sectional area of the air passageway, the air flow jet being in an operative communication with the air flow inlet member to generate an air flow under a second pressure external to the opposite second end; a second mixing chamber configured to receive the homogeneous water and foam concentrate mixture from the first mixing chamber due to an air flow from the air flow jet, the air flow under the third pressure being sufficient to draw the homogeneous water and foam concentrate mixture into the second mixing chamber where the homogeneous water and foam concentrate mixture mixes with the air flow to produce a foam solution flow; a foam augmentation chamber disposed in a flow path of the foam solution flow; a screen member positioned in the foam augmentation chamber, the screen member comprises perforated screens disposed in a spaced apart relationship with each other or at an inclined to each other in a path of the foam solution flow, the foam solution flow passes through perforations within the perforated screens and exits the screen member as the mechanical foam; and a foam dispersion port in the exterior surface of the housing, the foam dispersion port in a flow communication with the foam augmentation chamber to disperse the mechanical foam external to the housing.

A feature of this embodiment is that the apparatus can further comprise a connection with the supply source of the water flow.

A feature of this embodiment is that the connection comprises an ON/OFF valve.

A feature of this embodiment is that the apparatus can further comprise the supply source of water flow, the supply source of water flow being at least one of a water main, a stationary container, a portable container, and a mobile container.

A feature of this embodiment is that the apparatus can further comprise a connection with the supply source of the foam concentrate.

A feature of this embodiment is that the apparatus can further comprise the supply source of the foam concentrate being one of a stationary container, a portable container, and a mobile container.

A feature of this embodiment is that the apparatus can further comprise a connection with the supply source of the air flow.

A feature of this embodiment is that the connection with the supply source of the air flow can comprise an air pressure regulator.

A feature of this embodiment is that the apparatus can further comprise a foam accumulation chamber disposed downstream of and in a flow communication with the foam augmentation chamber after the screen member, the foam accumulation chamber receiving the mechanical foam passed through the screen member, the foam dispersion port being also in a flow communication with the foam accumulation chamber.

In an embodiment, an apparatus that produces and dispenses mechanical foam comprises a housing; a means within the housing for generating a homogeneous mixture of a liquid and a foam concentrate; a means within the housing for generating a foam solution flow, the foam solution flow comprising a homogeneous mixture of the liquid, the foam concentrate and a gas; a screen member, positioned within the housing downstream of the foam solution flow, the screen member converts the foam solution flow into the mechanical foam; and a means for dispersing the mechanical foam.

A feature of this embodiment is that the means within the housing for generating the homogeneous mixture of the liquid and the foam concentrate comprises: a liquid flow member comprising: a liquid flow inlet port in an exterior surface of the housing, the liquid flow inlet port in a fluid communication with a supply source of liquid flow under a first pressure, a liquid passageway, the liquid passageway defining a liquid flow outlet port, a liquid flow control member in a liquid communication with the liquid passageway, the liquid flow control member controlling a rate of flow of liquid from the liquid flow inlet port through the liquid passageway, and a liquid flow jet comprising one end thereof disposed adjacent the liquid flow outlet port, a first aperture disposed through the liquid flow jet in a liquid flow communication with the liquid flow outlet port and in a direction of liquid flow, the first aperture having a cross-sectional area thereof being smaller than a cross-sectional area of the liquid flow outlet port, the liquid flow jet is configured to generate a liquid flow under a second pressure, the second pressure being less than the first pressure; a foam concentrate flow member comprising: a foam concentrate inlet port in the exterior surface of the housing, the foam concentrate inlet port in an operative communication with a supply source of a foam concentrate flow, a foam concentrate passageway in a communication with the foam concentrate inlet port, the foam concentrate passageway defining a foam concentrate outlet port, and a foam concentrate flow control member in an operative communication with the foam concentrate passageway, the foam concentrate flow control member controlling a rate of flow of the foam concentrate from the foam concentrate inlet port through the foam concentrate passageway; and a first mixing chamber receiving a smaller end of the liquid flow jet and being in a communication with the foam concentrate outlet port, the first mixing chamber comprising a frustoconical shape, the first mixing chamber configured to receive the liquid flow through the axial aperture in the liquid flow jet and the foam concentrate flow through the foam concentrate outlet port, the second pressure being sufficient to generate a suction of the foam concentrate flow into the first mixing chamber and further generate a homogeneous liquid and foam concentrate mixture.

A feature of this embodiment is that he means within the housing for generating the homogeneous mixture of the liquid and the foam concentrate comprises: a liquid flow member comprising: a liquid flow inlet port in an exterior surface of the housing, the liquid flow inlet port in a fluid communication with a supply source of liquid flow under a first pressure, a liquid passageway, the liquid passageway defining a liquid flow outlet port, and a liquid flow jet comprising one end thereof disposed adjacent the liquid flow outlet port, a first aperture disposed through the liquid flow jet in a liquid flow communication with the liquid flow outlet port and in a direction of liquid flow, the first aperture having a cross-sectional area thereof being smaller than a cross-sectional area of the liquid flow outlet port, the liquid flow jet is configured to generate a liquid flow under a second pressure, the second pressure being less than the first pressure; a foam concentrate flow member comprising: a foam concentrate inlet port in the exterior surface of the housing, the foam concentrate inlet port in an operative communication with a supply source of a foam concentrate flow, a foam concentrate passageway in a communication with the foam concentrate inlet port, the foam concentrate passageway defining a foam concentrate outlet port; and a first mixing chamber receiving a smaller end of the liquid flow jet and being in a communication with the foam concentrate outlet port, the first mixing chamber comprising a frustoconical shape, the first mixing chamber configured to receive the liquid flow through the axial aperture in the liquid flow jet and the foam concentrate flow through the foam concentrate outlet port, the second pressure being sufficient to generate a suction of the foam concentrate flow into the first mixing chamber and further generate a homogeneous liquid and foam concentrate mixture.

A feature of this embodiment is that the means within the housing for generating the homogeneous mixture of the liquid and the foam concentrate comprises: a liquid flow inlet port in an exterior surface of the housing, the liquid flow inlet port in a fluid communication with a supply of liquid flow under a first pressure, a foam concentrate inlet port in the exterior surface of the housing, the foam concentrate inlet port in an operative communication with a supply of a foam concentrate flow; and a venturi member in a liquid communication with the liquid flow inlet port and in a communication with the foam concentrate inlet port, the venturi member configured to generate a suction, with the liquid flow from the liquid flow inlet port, of the foam concentrate flow from the foam concentrate inlet port into the first mixing chamber and further generate a homogeneous mixture of the liquid and the foam concentrate.

A feature of this embodiment is that the means within the housing for generating the foam solution flow comprises: a gas flow inlet member comprising: a gas inlet port in the exterior surface of the housing, the gas inlet port in an operative communication with a supply of gas flow under a pressure, a gas passageway in a communication with the gas inlet port and with the first mixing chamber, and a gas flow jet disposed in the gas passageway, the gas flow jet comprising: one end thereof positioned adjacent the gas inlet port, an opposite second end, a second aperture disposed though the gas flow jet in a direction of gas flow, the second aperture in a gas flow communication with the gas inlet port, and a cross-sectional area of the gas flow jet being smaller than a cross-sectional area of the gas passageway, the gas flow jet being in an operative communication with the gas flow inlet member to generate a gas flow under a second pressure external to the opposite second end; a mixing chamber configured to receive the homogeneous mixture of liquid and foam concentrate from the means within the housing for generating the homogeneous mixture of liquid and foam concentrate due to an gas flow from the gas flow jet, the gas flow under the pressure being sufficient to draw the homogeneous mixture of liquid and foam concentrate into the mixing chamber where the homogeneous mixture of liquid and foam concentrate mixes with the gas flow to produce the mechanical foam.

A feature of this embodiment is that the means within the housing for generating the foam solution flow comprises: a gas inlet port in the exterior surface of the housing, the gas inlet port in an operative communication with a supply of gas flow under pressure; and a venturi member in a communication with the gas inlet port and the means within the housing for generating the homogeneous mixture of liquid and foam concentrate, the venturi member configured to generate a suction, due to a gas flow from the gas flow jet and further generate the mechanical foam.

A feature of this embodiment is that the means for dispersing the mechanical foam comprises: a foam accumulation chamber disposed downstream of the foam augmentation chamber after the screen stack; and a foam dispersion port in the exterior surface of the housing, the foam dispersion port in a communication with the screen member to disperse the mechanical foam external to the housing.

A feature of this embodiment is that the means for dispersing the mechanical foam comprises: a foam dispersion port in the exterior surface of the housing the foam dispersion port in a communication with the screen member to disperse the mechanical foam external to the housing; a foam dispersion member positioned at a distance from the housing; and a connection between the foam dispersion port and the foam dispersion member.

A feature of this embodiment is that the apparatus can further comprise a connection with the supply source of the liquid.

A feature of this embodiment is that the connection comprises an ON/OFF valve.

A feature of this embodiment is that the apparatus can further comprise the supply source of the liquid, being one of fixed tank, a movable tank, a portable container, a mobile tank and a liquid main.

A feature of this embodiment is that the liquid is water.

A feature of this embodiment is that the foam concentrate is one of an aqueous film-forming foams (AFFFs), Class A foams, Class B foams, Class C foams, wetting agents, high-expansion foam concentrates, and protein foams.

A feature of this embodiment is that the apparatus can further comprise a connection with the supply source of the foam concentrate.

A feature of this embodiment is that the connection comprises a pump.

A feature of this embodiment is that the apparatus can further comprise the supply source of the foam concentrate, being one of a packaging tote, a pail, a fixed atmospheric tank, a movable tank, a portable container, and a mobile container A feature of this embodiment is that the apparatus can further comprise a connection with the supply source of the gas.

A feature of this embodiment is that the connection comprises a gas pressure regulator.

A feature of this embodiment is that the gas is an air or an inert gas.

In an embodiment, an apparatus that produces and dispenses mechanical foam, comprises a housing; a water flow member comprising: a water flow inlet port in an exterior surface of the housing, the water flow inlet port in a fluid communication with a supply of water flow under a first pressure, a water passageway, the water passageway defining a water outlet port, a water flow control member in a water communication with the water passageway, the water flow control member controlling a rate of flow of the water, and a water flow jet comprising one end thereof disposed adjacent the water outlet port, a first aperture disposed through the water flow jet in a water communication with the water outlet port and in a direction of water flow, the first aperture having a cross-sectional area thereof being smaller than a cross-sectional area of the water outlet port, the water flow jet is configured to generate a water flow under a second pressure, the second pressure being less than the first pressure; a foam concentrate flow member comprising: a foam concentrate inlet port in the exterior surface of the housing, the foam concentrate inlet port in an operative communication with a supply of a foam concentrate flow, a foam concentrate passageway in a communication with the foam concentrate inlet port, the foam concentrate passageway defining a foam concentrate outlet port, and a foam concentrate flow control member in an operative communication with the foam concentrate passageway, the foam concentrate flow control member; controlling a rate of flow of the foam concentrate; a first mixing chamber positioned adjacent an opposite end of the water flow jet and in a communication with the foam concentrate outlet port, the first mixing chamber comprising a frustoconical shape, the first mixing chamber configured to receive the water flow through the axial aperture in the water flow jet and the foam concentrate flow through the foam concentrate outlet port, the second pressure being sufficient to generate a suction of the foam concentrate flow into the first mixing chamber and further generate a homogeneous mixture of the water and the foam concentrate; an air flow inlet member comprising: an air inlet port in the exterior surface of the housing, the air inlet port in an operative communication with a supply of air flow under a third pressure, an air passageway in a communication with the air inlet port and with the first mixing chamber, and an air flow jet disposed in the air passageway, the air flow jet comprising: one end thereof positioned adjacent the air inlet port, an opposite second end, a second aperture disposed though the air flow jet in a direction of air flow, the second aperture in an air flow communication with the air inlet port, and a cross-sectional area of the air flow jet being smaller than a cross-sectional area of the air passageway, the air flow jet being in an operative communication with the air flow inlet member to generate an air flow under a second pressure external to the opposite second end; a second mixing chamber configured to receive water and foam concentrate mixture from the first mixing chamber due to an air flow from the air flow jet, the air flow under the third pressure being sufficient to draw the water and foam concentrate mixture into the second mixing chamber where the water and foam concentrate mixture mixes with the air flow to produce a flow of the mechanical foam; and a foam dispersion port in the exterior surface of the housing, the foam dispersion port in a communication with the second mixing chamber to disperse the flow of the mechanical foam external to the housing.

In an embodiment, a method of sanitizing an area with a mechanical foam, the method comprises: mixing a liquid and a sanitizing foam concentrate in a first chamber to produce a first mixture; mixing the first mixture with air in a second chamber to produce a second mixture, the second chamber being in a direct flow communication with a straight passageway from the first mixing chamber; passing the second mixture through a mechanical screen in a third chamber to generate the mechanical foam; and dispensing the mechanical foam from the third chamber onto the area.

In an embodiment, a method of sanitizing a hard nonporous surface area comprising covering the surface area with an effective amount of mechanical foam sufficient to disinfect the area, the mechanical foam comprises less than 1 percent by volume sanitizing foam concentrate; about 21 percent by volume liquid; and a remaining percent by volume air.

A feature of this embodiment is that the less than 1% by volume comprises about 0.02% by volume.

In an embodiment, a method of sanitizing a hard nonporous surface area comprising covering the area with an effective amount of a mechanical foam comprising: about 2 percent by weight sanitizing foam concentrate; and about 98 percent by weight liquid.

In an embodiment, a method of sanitizing a production facility hard nonporous surface area comprising covering the surface area with an effective amount of mechanical foam comprising: less than 1 percent by volume sanitizing foam concentrate; about 21 percent by volume liquid; and a remaining percent by volume air.

In an embodiment, a method of producing and dispensing a mechanical foam comprises: mixing a flow of water under pressure with a disinfectant in a first chamber; mixing a mixture of water and disinfectant with air under pressure in a second chamber; passing the mixture of water, disinfectant and air through a stack of screen members in a third chamber; and dispensing the mechanical foam through a port in the third chamber.

In an embodiment, a method of producing and dispensing a mechanical foam comprises: drawing, with a flow of water under pressure, a foam disinfectant into a first mixing chamber; mixing the water and foam disinfectant in the first mixing chamber; drawing, with a flow of air under pressure, a mixture of the water and foam disinfectant into a second mixing chamber; mixing the air with the mixture of water and foam disinfectant in the second chamber; passing a mixture of air, water and foam disinfectant through a stack of screen members in a third chamber, all screen members having an identical size and arrangement of openings; and dispensing the mechanical foam through a port in the third chamber.

In an embodiment, an apparatus that produces and dispenses mechanical foam comprises: a housing; an adjustable water flow member disposed within the housing in a flow communication with a supply source of water flow; an adjustable foam concentrate flow member disposed within the housing in a flow communication with a supply source of foam concentrate flow; a first mixing chamber in a flow communication with the adjustable foam concentrate flow member, the first mixing chamber comprising an outlet; a water pressure reducing member mounted within the housing with a portion thereof disposed within the first mixing chamber and a through bore extending axially through a length of the water pressure reducing member, the through bore in a communication with the adjustable water flow member to circulate the water flow under a first pressure within the first mixing member, the water flow circulating under the first pressure within the first mixing chamber sufficient to draw a foam concentrate from the adjustable foam concentrate flow member for mixing with the water flow circulating under the first pressure prior to exiting the outlet; a second mixing chamber in a flow communication with the outlet from the first mixing chamber, the second mixing chamber comprising an outlet; an air pressure reducing member mounted within the housing, the air pressure reducing member with a portion thereof disposed within the second mixing chamber and with a through bore extending axially through a length of the air pressure reducing member, the through bore of the air pressure reducing member being in a flow communication with a supply source of air flow to circulate the air flow under a second pressure within the second mixing member, the air flow circulating under the second pressure within the second mixing chamber sufficient to draw a mixture of the water and the foam concentrate from the outlet of the first mixing chamber for mixing with the air flow circulating under the second pressure; a third mixing chamber in a direct flow communication with the outlet from the second mixing chamber, the third mixing chamber comprising a port in a flow communication with an external environment to the housing; and a screen member disposed within the third mixing chamber, the screen member configured to convert a mixture of air, water and foam concentrate exiting the outlet of the second mixing chamber into the mechanical foam, the mechanical foam being dispersed through the port during operation of the apparatus.

In an embodiment, a screen cartridge is provided for an apparatus that mixes two or more substances together, the cartridge comprising: a cartridge housing comprising an end wall and a peripheral side wall upstanding on the end wall to define a hollow interior and an opening opposite the end wall, the cartridge housing connectable to a housing of the apparatus; a port through the end wall of cartridge housing; perforated members disposed within the hollow interior during use of the screen cartridge; and flexible members, each flexible member from the flexible members configured to couple at an interior thereof to a peripheral edge of a respective perforated member and deform at an exterior thereof when positioned within the hollow interior in a contact with an interior surface of the peripheral side wall; and the flexible members being further sized to space a pair of perforated screens at a distance from each other, the distance sufficient to stabilize bubbles generated during mixture of the two or more substances together.

In an embodiment, a two-step method of cleaning, sanitizing and rinsing a surface, using the apparatus of any above of the described embodiments, comprises: cleaning a surface with a detergent composition comprising: an alkalinity source selected from the group consisting of an alkali metal carbonate, alkali metal hydroxide, alkali metal silicate, alkali metal metasilicate, and combinations thereof; from about 0.01-40 wt-% of a phosphinosuccinic acid adduct comprising a phosphinosuccinic acid and mono-, bis- and oligomeric phosphinosuccinic acid adducts; and sanitizing and rinsing the surface with a sanitizing rinse composition comprising: a C1-C22 peroxycarboxylic acid; a C1-C22 carboxylic acid; hydrogen peroxide; and at least one nonionic defoaming surfactant and at least one nonionic wetting surfactant.

The chosen exemplary embodiments of the claimed subject matter have been described and illustrated, to plan and/or cross section illustrations that are schematic illustrations of idealized embodiments, for practical purposes so as to enable any person skilled in the art to which it pertains to make and use the same. As such, variations from the shapes the illustrations as a result, for example, of manufacturing techniques and/or tolerances, are to be expected. It is therefore intended that all matters in the foregoing description and shown in the accompanying drawings be interpreted as illustrative and not in a limiting sense. For example, a region illustrated or described as flat may, typically, have rough and/or nonlinear features. Moreover, sharp angles that are illustrated may be rounded. Thus, the regions illustrated in the figures are schematic in nature and their shapes are not intended to illustrate the precise shape of a region and are not intended to limit the scope of the present claims. It will be understood that variations, modifications, equivalents and substitutions for components of the specifically described exemplary embodiments of the invention may be made by those skilled in the art without departing from the spirit and scope of the invention as set forth in the appended claims.

As used herein, the terms "adapted" and "configured" mean that the element, component, or other subject matter is designed and/or intended to perform a given function. Thus, the use of the terms "adapted" and "configured" should not be construed to mean that a given element, component, or other subject matter is simply "capable of" performing a given function but that the element, component, and/or other subject matter is specifically selected, created, implemented, utilized, programmed, and/or designed for the purpose of performing the function. It is also within the scope of the present disclosure that elements, components, and/or other recited subject matter that is recited as being adapted to perform a particular function may additionally or alternatively be described as being configured to perform that function, and vice versa. Similarly, subject matter that is recited as being configured to perform a particular function may additionally or alternatively be described as being operative to perform that function.

It should be appreciated that reference throughout this specification to "one embodiment" or "an embodiment" means that a particular feature, structure or characteristic described in connection with the embodiment is included in at least one embodiment of the present invention. Therefore, it is emphasized and should be appreciated that two or more references to "an embodiment" or "one embodiment" or "an alternative embodiment" in various portions of this specification are not necessarily all referring to the same embodiment or the same variation. Furthermore, the particular features, structures or characteristics may be combined as suitable in one or more embodiments of the invention.

Similarly, it should be appreciated that in the foregoing description of embodiments, various features are sometimes grouped together in a single embodiment, figure, or description thereof for the purpose of streamlining the disclosure aiding in the understanding of one or more of the various inventive aspects. This method of disclosure, however, is not to be interpreted as reflecting an intention that the claimed subject matter requires more features than are expressly recited in each claim. Rather, as the following claims reflect, inventive aspects lie in less than all features of a single foregoing disclosed embodiment. Thus, the claims following the detailed description are hereby expressly incorporated into this detailed description.

To the extent that the appended claims have been drafted without multiple dependencies, it should be noted that all possible combinations of features which would be implied by rendering the claims multiply dependent are explicitly envisaged and should be considered part of the invention. Any element in a claim that does not explicitly state "means for" performing a specified function, or "step for" performing a specified function, is not to be interpreted as a "means" or "step" clause as specified in 35 U.S.C. § 112, ¶6. In particular, any use of "step of" in the claims is not intended to invoke the provision of 35 U.S.C. § 112, ¶6.

Unless otherwise indicated, all numbers expressing quantities of elements, optical characteristic properties, and so forth used in the specification and claims are to be understood as being modified in all instances by the term "about." Accordingly, unless indicated to the contrary, the numerical parameters set forth in the preceding specification and attached claims are approximations that can vary depending upon the desired properties sought to be obtained by those skilled in the art utilizing the teachings of the present subject matter. At the very least, and not as an attempt to limit the application of the doctrine of equivalents to the scope of the claims, each numerical parameter should at least be construed in light of the number of reported significant digits and by applying ordinary rounding techniques. Notwithstanding that the numerical ranges and parameters setting forth the broad scope of the claimed subject matter are approximations, the numerical values set forth in the specific examples are reported as precisely as possible.

Any numerical value, however, inherently contains certain errors necessarily resulting from the standard deviations found in their respective testing measurements.

The recitation of numerical ranges by endpoints includes all numbers subsumed within that range (e.g. 1 to 5 includes 1, 1.5, 2, 2.75, 3, 3.80, 4, and 5).

Anywhere the term "comprising" is used, embodiments and components "consisting essentially of" and "consisting of" are expressly disclosed and described herein."

Furthermore, the Abstract is not intended to be limiting as to the scope of the claimed subject matter and is for the purpose of quickly determining the nature of the claimed subject matter.

What is claimed is:

1. An apparatus that produces and dispenses mechanical foam, comprising:

a housing;

a water flow member comprising:

a water flow inlet port in an exterior surface of said housing, said water flow inlet port in a fluid communication with a supply source of water flow under a first pressure, a water passageway, said water passageway defining a water flow outlet port, a water flow control member in a water communication with said water passageway, said water flow control member controlling a rate of flow of water from said water flow inlet port through said water passageway, and a water flow jet comprising one end thereof disposed adjacent said water flow outlet port, a first aperture disposed through said water flow jet in a water flow communication with said water flow outlet port and in a direction of water flow, said first aperture having a cross-sectional area thereof being smaller than a cross-sectional area of said water flow outlet port, said water flow jet is configured to generate a water flow under a second pressure, said second pressure being less than said first pressure;

a foam concentrate flow member comprising:

a foam concentrate inlet port in said exterior surface of said housing, said foam concentrate inlet port in an operative communication with a supply source of a foam concentrate flow, a foam concentrate passageway in a communication with said foam concentrate inlet port, said foam concentrate passageway defining a foam concentrate outlet port, and a foam concentrate flow control member in an operative communication with said foam concentrate passageway, said foam concentrate flow control member controlling a rate of flow of the foam concentrate from said foam concentrate inlet port through the foam concentrate passageway;

a first mixing chamber receiving a smaller end of said water flow jet and being in a communication with said foam concentrate outlet port, first mixing chamber comprising a frustoconical shape, said first mixing chamber configured to receive the water flow through an axial aperture in said water flow jet and the foam concentrate flow through said foam concentrate outlet port, said second pressure being sufficient to generate a suction of the foam concentrate flow into said first mixing chamber and further generate a homogeneous water and foam concentrate mixture to be drawn through a passageway from said first mixing chamber;

an air flow member comprising:

an air inlet port in said exterior surface of said housing, said air inlet port in an operative communication with a supply source of air flow under a third pressure, an air flow passageway in a communication with said air inlet port and in a direct communication with said passageway from said first mixing chamber, and an air flow jet disposed, during use, in said air flow passageway, said air flow jet comprising:

one end thereof positioned adjacent said air inlet port, an opposite end, a second aperture disposed though said air flow jet in a direction of air flow, said second aperture in an air flow communication with said air inlet port, and a peripheral gap between an interior surface of said air flow passageway and an exterior surface of said air flow jet, said peripheral gap defined by a cross-sectional area of said air flow jet being smaller than a cross-sectional area of said air passageway, said air flow jet being in an operative communication with said air flow inlet member to generate an air flow under a second pressure external to said opposite second end, said passageway from said first mixing chamber being disposed between said one and said opposite ends of said air flow jet, said passageway being further disposed to deliver said homogeneous water and foam concentrate mixture from said first mixing chamber into said peripheral gap;

a second mixing chamber configured to receive said homogeneous water and foam concentrate mixture from said first mixing chamber through said peripheral gap due to an air flow from said air flow jet, said air flow under said third pressure being sufficient to draw said homogeneous water and foam concentrate mixture into said second mixing chamber where said homogeneous water and foam concentrate mixture mixes with said air flow to produce a foam solution flow;

a foam augmentation chamber disposed in a flow path of said foam solution flow;

a screen member positioned, during said use, in said foam augmentation chamber, said screen member comprises perforated screens disposed in a spaced apart relationship with each other or at an inclined to each other in a path of said foam solution flow, said foam solution flow passes through perforations within said perforated screens and exits said screen member as said mechanical foam; and a foam dispersion port in said exterior surface of said housing, said foam dispersion port in a flow communication with said foam augmentation chamber to disperse said mechanical foam external to said housing.

2. The apparatus, according to claim 1, further comprising a connection with the supply source of the water flow.

3. The apparatus, according to claim 1, further comprising the supply source of water flow, the supply source of water flow being at least one of a water main, a stationary container, a portable container, and a mobile container.

4. The apparatus, according to claim 1, further comprising a connection with the supply source of the foam concentrate.

5. The apparatus, according to claim 1, further comprising the supply source of the foam concentrate being one of a stationary container, a portable container, and a mobile container.

6. The apparatus, according to claim 1, further comprising a connection with the supply source of the air flow.

7. The apparatus, according to claim 1, further comprising a controller.

8. The apparatus, according to claim 1, further comprising a foam accumulation chamber disposed downstream of and in a flow communication with said foam augmentation chamber after said screen member, said foam accumulation chamber receiving said mechanical foam passed through said screen member, said foam dispersion port being also in a flow communication with said foam accumulation chamber.

9. An apparatus that produces and dispenses mechanical foam, comprising:

a housing;

a means for generating a homogeneous mixture of a liquid and a foam concentrate within said housing;

a means for generating a foam solution flow within said housing, said foam solution flow comprising a homogeneous mixture of said liquid, said foam concentrate and a gas, said means for generating said foam solution flow comprising:

a gas flow inlet member comprising:

a gas inlet port in an exterior surface of said housing, said gas inlet port in an operative communication with a supply of gas flow under a first pressure, a gas passageway in a communication with said gas inlet port and with said means for generating said homogeneous mixture of said liquid and said foam concentrate, and a gas flow jet disposed, during use, in said gas passageway, said gas flow jet comprising:

one end thereof positioned, during said use, adjacent said gas inlet port, an opposite end spaced apart from said one end along a length of said gas flow jet, an aperture disposed though said length of said gas flow jet in a direction of gas flow, said aperture in a gas flow communication with said gas inlet port, and a peripheral gap between an interior surface of said gas passageway and an exterior surface of said gas flow jet, said peripheral gap defined by a cross-sectional area of said gas flow jet in a plane being normal to said length thereof being smaller than a cross-sectional area of said gas passageway, said gas flow jet being, during said use, in an operative communication with said gas flow inlet member to generate a gas flow under a second pressure external to said opposite end, said means for generating said homogeneous mixture of said liquid and said foam concentrate comprising a passageway disposed between said one and said opposite ends of said gas flow jet, said passageway being further disposed to deliver said homogeneous mixture of said liquid and said foam concentrate into said peripheral gap; and a mixing chamber configured to receive said homogeneous mixture of the liquid and the foam concentrate from said passageway through said peripheral gap due to a gas flow from said gas flow jet, said gas flow under said second pressure being sufficient to draw said homogeneous mixture of the liquid and the foam concentrate from said passageway into said mixing chamber;

a screen member, positioned, during said use, within said mixing chamber and downstream of said foam solution flow, said screen member converts said foam solution flow into a mechanical foam; and a means for dispersing said mechanical foam.

10. The apparatus of claim 9, wherein said means for generating said homogeneous mixture of the liquid and the foam concentrate comprises:

a liquid flow member comprising:

a liquid flow inlet port in an exterior surface of said housing, said liquid flow inlet port in a fluid communication with a supply source of liquid flow under a first pressure, a liquid passageway, said liquid passageway defining a liquid flow outlet port, a liquid flow control member in a liquid communication with said liquid passageway, said liquid flow control member controlling a rate of flow of liquid from said liquid flow inlet port through said liquid passageway, and a liquid flow jet comprising one end thereof disposed adjacent said liquid flow outlet port, a first aperture disposed through said liquid flow jet in a liquid flow communication with said liquid flow outlet port and in a direction of liquid flow, said first aperture having a cross-sectional area thereof being smaller than a cross-sectional area of said liquid flow outlet port, said liquid flow jet is configured to generate a liquid flow under a second pressure, said second pressure being less than said first pressure;

a foam concentrate flow member comprising:

a foam concentrate inlet port in said exterior surface of said housing, said foam concentrate inlet port in an operative communication with a supply source of a foam concentrate flow, a foam concentrate passageway in a communication with said foam concentrate inlet port, said foam concentrate passageway defining a foam concentrate outlet port, and a foam concentrate flow control member in an operative communication with said foam concentrate passageway, said foam concentrate flow control member controlling a rate of flow of the foam concentrate from said foam concentrate inlet port through the foam concentrate passageway; and a mixing chamber receiving a smaller end of said liquid flow jet and being in a communication with said foam concentrate outlet port, said mixing chamber comprising a frustoconical shape, said mixing chamber configured to receive the liquid flow through an axial aperture in said liquid flow jet and the foam concentrate flow through said foam concentrate outlet port, said second pressure being sufficient to generate a suction of the foam concentrate flow into said mixing chamber and further generate said homogeneous mixture of the liquid and the foam concentrate, said homogeneous mixture to be drawn from said mixing chamber through said passageway.

11. The apparatus of claim 9, wherein said means within said housing for generating said homogeneous mixture of the liquid and the foam concentrate comprises:

a liquid flow member comprising:

a liquid flow inlet port in an exterior surface of said housing, said liquid flow inlet port in a fluid communication with a supply source of liquid flow under a first pressure, a liquid passageway, said liquid passageway defining a liquid flow outlet port, and a liquid flow jet comprising one end thereof disposed adjacent said liquid flow outlet port, a first aperture disposed through said liquid flow jet in a liquid flow communication with said liquid flow outlet port and in a direction of liquid flow, said first aperture having a cross-sectional area thereof being smaller than a cross-sectional area of said liquid flow outlet port, said liquid flow jet is configured to generate a liquid flow under a second pressure, said second pressure being less than said first pressure;

a foam concentrate flow member comprising:

a foam concentrate inlet port in said exterior surface of said housing, said foam concentrate inlet port in an operative communication with a supply source of a foam concentrate flow, a foam concentrate passageway in a communication with said foam concentrate inlet port, said foam concentrate passageway defining a foam concentrate outlet port; and a mixing chamber receiving a smaller end of said liquid flow jet and being in a communication with said foam concentrate outlet port, said mixing chamber comprising a frustoconical shape, said mixing chamber configured to receive the liquid flow through an axial aperture in said liquid flow jet and the foam concentrate flow through said foam concentrate outlet port, said second pressure being sufficient to generate a suction of the foam concentrate flow into said mixing chamber and further generate said homogeneous mixture of the liquid and the foam concentrate, said homogeneous mixture to be drawn from said mixing chamber through said passageway.

12. The apparatus of claim 9, wherein said means for generating said homogeneous mixture of the liquid and the foam concentrate comprises:

a liquid flow inlet port in an exterior surface of said housing, said liquid flow inlet port in a fluid communication with a supply of liquid flow under a pressure, a foam concentrate inlet port in said exterior surface of said housing, said foam concentrate inlet port in an operative communication with a supply of a foam concentrate flow; and a venturi member in a liquid communication with said liquid flow inlet port and in a communication with the foam concentrate inlet port, said venturi member configured to generate a suction, with the liquid flow from said liquid flow inlet port, of the foam concentrate flow from said foam concentrate inlet port into a mixing chamber and further generate said homogeneous mixture of the liquid and the foam concentrate, said homogeneous mixture to be drawn from said mixing chamber through said passageway.

13. The apparatus of claim 9, wherein said means for dispersing said mechanical foam comprises:

a foam augmentation chamber containing said screen member;

a foam accumulation chamber disposed downstream of said foam augmentation chamber after said screen member; and a foam dispersion port in said exterior surface of said housing, said foam dispersion port in a communication with said screen member to disperse said mechanical foam external to said housing.

14. The apparatus of claim 9, wherein said means for dispersing said mechanical foam comprises:

a foam dispersion port in said exterior surface of said housing, said foam dispersion port in a communication with said screen member to disperse said mechanical foam external to said housing;

a foam dispersion member positioned at a distance from said housing; and a connection between said foam dispersion port and said foam dispersion member.

15. The apparatus of claim 9, further comprising a connection with a supply source of the liquid, said connection comprises an ON/OFF valve.

16. The apparatus of claim 9, wherein said foam concentrate is one of an aqueous film-forming foams (AFFFs), Class A foams, Class B foams, Class C foams, wetting agents, high-expansion foam concentrates, and protein foams.

17. The apparatus of claim 9, further comprising a connection with a supply source of the foam concentrate, being one of a packaging tote, a pail, a fixed atmospheric tank, a movable tank, a portable container, and a mobile container.

18. The apparatus of claim 9, further comprising a bore through a surface of said housing, said bore being sized to receive said gas flow jet therethrough.

19. The apparatus of claim 9, further comprising a venturi disposed adjacent said opposite end of said gas flow jet, said venturi comprising a frustoconical inner surface and an axial aperture.

20. The apparatus of claim 9, wherein said screen member comprises a stack of perforated members spaced apart from each other with spacers.

21. The apparatus of claim 9, wherein said housing comprises two portions and wherein said screen member is disposed within a lower portion from said two portions during said use of said apparatus.

22. The apparatus of claim 9, wherein said screen member comprises a plurality of perforated panels disposed at an incline to each other.

23. An apparatus that produces and dispenses mechanical foam, comprising:

a housing;

an adjustable water flow member disposed within said housing in a flow communication with a supply source of water flow;

an adjustable foam concentrate flow member disposed within said housing in a flow communication with a supply source of foam concentrate flow;

a first mixing chamber in a flow communication with said adjustable foam concentrate flow member, said first mixing chamber comprising a first outlet;

a water pressure reducing member mounted within said housing with a portion thereof disposed within said first mixing chamber and a through bore extending axially through a length of said water pressure reducing member, said through bore in a communication with said adjustable water flow member to circulate said water flow under a first pressure within said first mixing member, said water flow circulating under said first pressure within said first mixing chamber sufficient to draw a foam concentrate from said adjustable foam concentrate flow member for mixing with said water flow circulating under said first pressure prior to exiting said first outlet;

a second mixing chamber in a flow communication with said outlet from said first mixing chamber, said second mixing chamber comprising a second outlet;

an air pressure reducing member positionable within said housing, said air pressure reducing member comprising a portion thereof disposed within said second mixing chamber, a peripheral gap between an exterior surface of said portion and an interior surface of said second mixing chamber, and a through bore extending axially through a length of said air pressure reducing member, said through bore of said air pressure reducing member being in a flow communication with a supply source of air flow to circulate the air flow under a second pressure within said second mixing member, said air flow circulating under said second pressure within said second mixing chamber sufficient to draw a mixture of the water and the foam concentrate from said first outlet into said peripheral gap and for mixing with said air flow circulating under said second pressure, said first outlet being disposed between ends of said air pressure reducing member;

a third mixing chamber in a direct flow communication with said second outlet, said third mixing chamber comprising a port in a flow communication with an external environment to said housing; and a screen member disposed, during use, within said third mixing chamber, said screen member configured to convert a mixture of air, water and foam concentrate exiting said second outlet into said mechanical foam, said mechanical foam being dispersed through said port during operation of said apparatus.

24. The apparatus of claim 23, wherein said air pressure reducing member comprises a pair of frustoconical end portions joined with a middle straight portion, said through bore extending through said pair of frustoconical end portions and said middle straight portion, said outlet from said first mixing chamber being connected to said middle straight portion.

25. The apparatus of claim 24, further comprising a passageway into said middle straight portion, said passageway being disposed, during said use, above said outlet from said first mixing chamber.

26. The apparatus of claim 23, wherein each of said adjustable water flow member and said adjustable foam concentrate flow member comprises a needle valve.

* * * * *